US012781461B2

(12) United States Patent
Lundell et al.

(10) Patent No.: US 12,781,461 B2
(45) Date of Patent: Nov. 3, 2026

(54) SEGMENTED WALL AND LANDSCAPING BLOCK SYSTEMS WITH LUG PROCESSES

(71) Applicant: Keystone Retaining Wall Systems LLC, Minneapolis, MN (US)

(72) Inventors: Robert John Lundell, Stillwater, MN (US); John Walter Turgeon-Schramm, Watertown, MN (US)

(73) Assignee: Keystone Retaining Wall Systems LLC, Minneapolis, MN (US)

( * ) Notice: Subject to any disclaimer, the term of this patent is extended or adjusted under 35 U.S.C. 154(b) by 107 days.

(21) Appl. No.: 18/618,457

(22) Filed: Mar. 27, 2024

(65) Prior Publication Data

US 2024/0401299 A1 Dec. 5, 2024

Related U.S. Application Data

(60) Provisional application No. 63/505,625, filed on Jun. 1, 2023.

(51) Int. Cl.
*E02D 29/02* (2006.01)

(52) U.S. Cl.
CPC ..... *E02D 29/025* (2013.01); *E02D 29/0266* (2013.01); *E02D 2250/0007* (2013.01)

(58) Field of Classification Search
CPC ..... E02D 29/025; E02D 29/0266; E02D 29/0258; E02D 2600/20; E04C 1/395; E04B 2/32
See application file for complete search history.

(56) References Cited

U.S. PATENT DOCUMENTS

D295,790 S 5/1988 Forsberg
D300,253 S 3/1989 Forsberg
(Continued)

FOREIGN PATENT DOCUMENTS

KR 20110003841 U 4/2011
KR 1824176 * 1/2018
(Continued)

OTHER PUBLICATIONS

International Preliminary Report on Patentability issued in International Application No. PCT/US2022/044156, mailed on Apr. 4, 2024, 8 pages.
(Continued)

*Primary Examiner* — Carib A Oquendo
(74) *Attorney, Agent, or Firm* — Dorsey & Whitney LLP

(57) ABSTRACT

A wall system includes a plurality of landscaping blocks, each comprising a front portion, a back portion, and first and second sidewall portions extending between the front portion and the back portion. An opening is provided, with a perimeter defined along inner surfaces of the front, back and first and second sidewall portions, respectively, and a lug process extends from each of the first and second sidewall portions. A first course can be assembled from a first number of the landscaping blocks, and a second course can be assembled from a second number of the landscaping blocks, stacked vertically with respect to the first course. So that the lug processes extending from the first and second sidewall portions of a landscaping block in the first course engage different openings in an adjacent pair of landscaping blocks in the second course.

39 Claims, 49 Drawing Sheets

(56) References Cited

U.S. PATENT DOCUMENTS

| | | | | |
|---|---|---|---|---|
| D300,863 | S | 4/1989 | McNeely | |
| 4,831,802 | A | 5/1989 | Cromrich et al. | |
| 4,896,999 | A | 1/1990 | Ruckstuhl | |
| 4,963,305 | A | 10/1990 | Cromrich et al. | |
| 4,982,544 | A | 1/1991 | Smith | |
| D317,209 | S | 5/1991 | Forsberg | |
| D341,215 | S | 11/1993 | Blomquist et al. | |
| 5,350,256 | A | 9/1994 | Hammer | |
| 5,353,569 | A * | 10/1994 | Rodrique | E04C 1/395 52/612 |
| D363,787 | S | 10/1995 | Powell | |
| 5,474,405 | A | 12/1995 | Anderson et al. | |
| 5,490,363 | A | 2/1996 | Woolford | |
| 5,505,034 | A | 4/1996 | Dueck | |
| 5,570,551 | A | 11/1996 | Koc et al. | |
| 5,624,211 | A | 4/1997 | Anderson et al. | |
| 5,788,423 | A | 8/1998 | Perkins | |
| 5,820,304 | A | 10/1998 | Sorheim et al. | |
| D405,543 | S | 2/1999 | Shillingburg | |
| D408,930 | S | 4/1999 | Behunin | |
| 5,913,790 | A | 6/1999 | Dawson | |
| 5,941,042 | A | 8/1999 | Dueck | |
| D429,004 | S | 8/2000 | Blomquist et al. | |
| 6,168,354 | B1 | 1/2001 | Martin et al. | |
| D439,989 | S | 4/2001 | Winters | |
| 6,233,897 | B1 | 5/2001 | Jurik | |
| 6,474,036 | B2 | 11/2002 | Martin et al. | |
| D467,009 | S | 12/2002 | Agee | |
| 6,709,201 | B2 | 3/2004 | Race | |
| D500,864 | S | 1/2005 | Klettenberg et al. | |
| D511,579 | S | 11/2005 | Risi et al. | |
| D517,221 | S | 3/2006 | Keys et al. | |
| 7,114,887 | B1 | 10/2006 | Rainey | |
| D537,533 | S | 2/2007 | Strand | |
| D569,010 | S | 5/2008 | Strand et al. | |
| 7,390,146 | B2 | 6/2008 | Rainey | |
| 7,441,887 | B2 | 10/2008 | Senga et al. | |
| 7,445,407 | B2 | 11/2008 | Rainey | |
| D589,163 | S | 3/2009 | Manthei et al. | |
| 7,497,341 | B2 | 3/2009 | Hardy et al. | |
| 7,645,098 | B1 | 1/2010 | Rainey | |
| D633,629 | S | 3/2011 | MacDonald et al. | |
| D645,575 | S | 9/2011 | Bone | |
| D652,153 | S | 1/2012 | Hammer | |
| D655,425 | S | 3/2012 | Wauhop | |
| 8,141,315 | B1 | 3/2012 | Shillingburg | |
| D667,138 | S | 9/2012 | Rainey | |
| 8,607,522 | B2 | 12/2013 | Macdonald | |
| 8,684,633 | B2 | 4/2014 | Rainey | |
| D708,765 | S | 7/2014 | Macdonald | |
| 9,070,261 | B2 | 6/2015 | Hardy | |
| 9,102,079 | B2 | 8/2015 | Scherer | |
| D781,455 | S | 3/2017 | Risi | |
| 9,706,857 | B2 | 7/2017 | Hardy et al. | |
| 9,744,697 | B2 | 8/2017 | Karau | |
| 9,999,993 | B2 | 6/2018 | Karau | |
| D844,857 | S | 4/2019 | Pegg | |
| D846,760 | S | 4/2019 | Lundell et al. | |
| 10,349,755 | B2 | 7/2019 | Dipaolo et al. | |
| D867,620 | S | 11/2019 | Pegg | |
| 10,486,344 | B2 | 11/2019 | Karau | |
| 10,899,049 | B2 | 1/2021 | Karau | |
| 10,907,350 | B1 | 2/2021 | Shillingburg | |
| 11,401,714 | B2 | 8/2022 | Lacroix | |
| 11,554,521 | B2 | 1/2023 | Karau | |
| D980,459 | S | 3/2023 | Bott | |
| D1,017,837 | S | 3/2024 | Freitas | |
| 2002/0023403 | A1 * | 2/2002 | Whitson | E02D 29/025 52/578 |
| 2002/0028114 | A1 * | 3/2002 | Whitson | E02D 29/025 405/284 |
| 2004/0134154 | A1 | 7/2004 | Bott | |
| 2005/0069389 | A1 * | 3/2005 | Shaw | E02D 29/0225 D25/113 |
| 2005/0102949 | A1 * | 5/2005 | Whitson | E04C 1/395 52/596 |
| 2006/0130420 | A1 | 6/2006 | McNear | |
| 2007/0122240 | A1 | 5/2007 | Rainey | |
| 2008/0289283 | A1 | 11/2008 | Shin | |
| 2009/0196695 | A1 | 8/2009 | Rainey | |
| 2011/0162314 | A1 | 7/2011 | Leach et al. | |
| 2011/0318100 | A1 | 12/2011 | Rainey | |
| 2014/0248094 | A1 * | 9/2014 | Walling | E04C 1/00 405/286 |
| 2018/0044915 | A1 | 2/2018 | Castonguay et al. | |
| 2018/0100283 | A1 | 4/2018 | Lonero | |
| 2021/0172171 | A1 | 6/2021 | Macdonald | |
| 2022/0112677 | A1 * | 4/2022 | Stell | E02D 29/025 |
| 2023/0090438 | A1 | 3/2023 | Lundell | |
| 2023/0150174 | A1 | 5/2023 | Karau | |

FOREIGN PATENT DOCUMENTS

| | | | |
|---|---|---|---|
| WO | 2004020207 | A1 | 3/2004 |
| WO | 2006060820 | A1 | 6/2006 |
| WO | 2007059454 | A2 | 5/2007 |
| WO | 2009067642 | A2 | 5/2009 |
| WO | 2010071760 | A1 | 6/2010 |

OTHER PUBLICATIONS

International Search Report and Written Opinion issued in International Application No. PCT/US2022/044156, mailed on Feb. 16, 2023, 12 pages.

"AB Fieldstone Collection", Product information page, retrieved from https://www.allanblock.com/products/fieldstone-collection.aspx retrieved on Mar. 20, 2023, Allan Block.

"BroadStone®", Product information page, retrieved from https://www.keystonehardscapes.com/productfamily/BroadStone retrieved on Mar. 20, 2023, 3 pages, Keystone Hardscapes.

"Classic® 6", Product information page, retrieved from https://rockwoodwalls.com/classic-6 retrieved on Mar. 20, 2023, 10 pages, Rockwood Retaining Walls.

"Classic® 8", Product information page, retrieved from https://rockwoodwalls.com/classic-8 retrieved on Mar. 22, 2023, 10 pages, Rockwood Retaining Walls.

"CornerStone 100 Retaining Wall Block", product information page, retrieved from https://cornerstonewallsolutions.com/cornerstone-100/ retrieved on Mar. 22, 2023, 4 pages.

"CornerStone Positive", Product Information Page, retrieved from https://cornerstonewallsolutions.com/cornerstone-positive/?portfolioCats=4 retrieved on Mar. 22, 2023, 6 pages.

"CornerStone Wall Block", Product information page, customer review oldest date Jul. 21, 2020, available from https://www.homedepot.com/p/CornerStone-Flat-Face-8-in-x-18-in-x-12-in-Grey-Concrete-Retaining-Wall-Block-MF100COSP001/207104149.

"Fortus Square Foot", Product information page, retrieved from https://cornerstonewallsolutions.com/fortus-square-foot/?portfolioCats=4 retrieved on Mar. 22, 2023, 4 page, CornerStone Wall Solutions.

"FrogStone", Product information page, retrieved from https://cornerstonewallsolutions.com/frogstone/?portfolioCats=4 retrieved on Mar. 22, 2023, 6 pages, CornerStone Wall Solutions.

"Glen-Gery Glazed Brick", product listing in masonmasonry.com, announced 2015, retrieved from chrome-extension://efaidnbmnnnibpcajpcglclefindmkaj/https://www.masonsmasonry.com/usercontent/pdfs/Glen-gery-glazed-spec-sheet.pdf.

"GravityStone® Edge", Product information page, retrieved from https://www.westblocksystems.com/gravitystone-edge retrieved on Mar. 20, 2023, 3 pages, WestBlock Systems.

"GravityStone® EnCore", Product information page, retrieved from https://www.westblocksystems.com/gravitystone-encore retrieved on Mar. 20, 2023, 2 pages, WestBlock Systems.

"GravityStone® Tradition", Production information page, retrieved from https://www.westblocksystems.com/gravitystone retrieved on Mar. 22, 2023, 4 pages, WestBlock Systems.

(56) References Cited

OTHER PUBLICATIONS

"Hewnstone Face Walls Design and Installation", Announced in YouTube on Apr. 12, 2015, available from https://www.youtube.com/watch?app=deskto&v=TwnWJRZRgjU.
"Hewnstone Face Walls Design and Installation", Announced in YouTube on Apr. 12, 2015, picture of product described.
"Keystone Compac® Smooth Stone", Retreived from https://www.barkmanconcrete.com/products/hardscapes/walls/product/keystone-compac-smooth-stone/.
"Keystone Sierra Blend Concrete Paver", Product listing, available in lowes.com, customer review oldest date Mar. 12, 2016, available at https://www.lowes.com/pd/Keystone-Campton-Sierra-Blend-Concrete-Paver-Common-6-in-x-18-in-Actual-5-921-in-x017-921-in/50328165.
"Mega-Tandem 3-in-1 Wall System", Production information page, retrieved from https://www.belgardcommercial.com/products/segmental_retaining_walls/mega-tandem# retrieved on Mar. 22, 2023, 3 pages, Belgard.
"MiraStone", Product Information Page, retrieved from https://cornerstonewallsolutions.com/mirastone-retaining-wall/?portfolioCats=4 retrieved on Mar. 22, 2023, 3 pages, CornerStone Wall Solutions.
"Premier 6", Production information page, retrieved from https://rockwoodwalls.com/premier-6 retrieved on Mar. 20, 2023, 2 pages, Rockwood Retaining Walls.
"Premier 8", Production information page, retrieved from https://rockwoodwalls.com/premier-8 retrieved on Mar. 20, 2023, 2 pages, Rockwood retaining Walls.
"ProMuro Wall Block", product information page, customer review oldest date May 23, 2017, retrieved from https://www.homedepot.com/Pavestone-ProMuro-6-in-x-18-in-x-12-in-Harvest-Blend-Concrete-Retaining-Wall-Block-40-Pcs-30-sq-ft-Pallet-11016079/301043.
"Tandem® Wall System", Production Information Page, retrieved from https://www.belgard.com/tandem/ retrieved on Mar. 22, 2023, 12 pages, Belgard.
"The Building Blocks of Future Communities and Infrastructure", retrieved from https://magnumstone.com/ retrieved on Mar. 20, 2023, 8 pages, Magnum Stone Retaining Walls.
"Trinity Segmental Block Wall System", Product information page, retrieved from https://earthwallproducts.com/retaining-wall-systems/trinity/ retrieved on Mar. 22, 2023, 6 pages, Earth Wall Products.
"Vertica Pro® Retaining Wall System, Straight Face", Product information page, retrieved from https://anchordiamond.com/walls/vertica-pro-retaining-wall-system-straight-face retrieved on Mar. 22, 2023, 8 pages, Anchor Diamond.
"Vertica® Retaining Wall System, Straight Face", Product information page, retrieved from https://anchordiamond.com/walls/vertica-retaining-wall-system-straight-face retrieved on Mar. 22, 2023, Anchor Diamond.
"RidgeRock Plus", Product brochure, Mar. 22, 2021, 2 pages, RidgeRock Retaining Walls, Charlotte, NC.
Ridgerock Gravity Link System, product brochure 3 pages, Jun. 14, 2021, RidgeRock Retaining Walls, Inc.
"GeoHold Retaining Wall Systems; Straight Individual Block Details", Product specification, Anchor Diamond, 2023.
"Geohold: Retaining Wall Straight Split Face", Product brochure, Anchor Diamond Group, 2023.

* cited by examiner

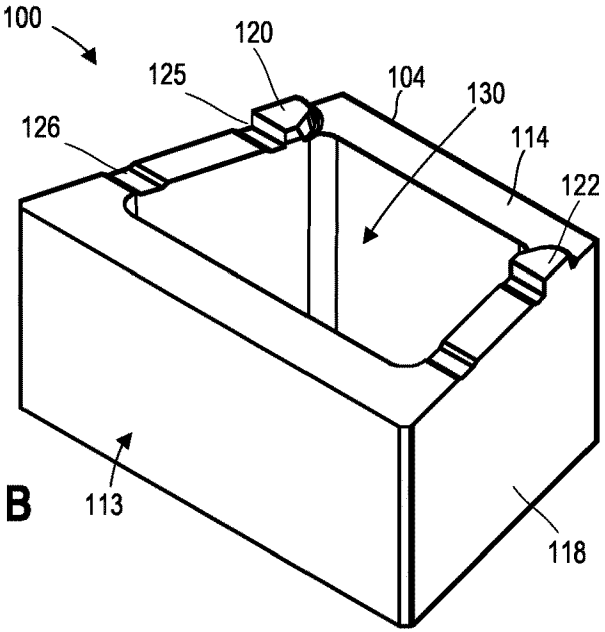
FIG. 1B
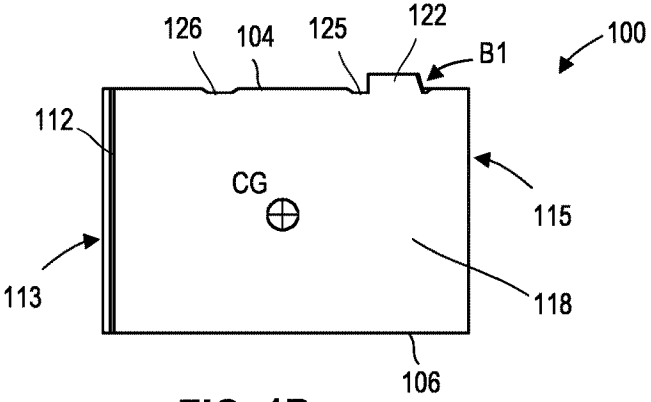
FIG. 1D
FIG. 1A
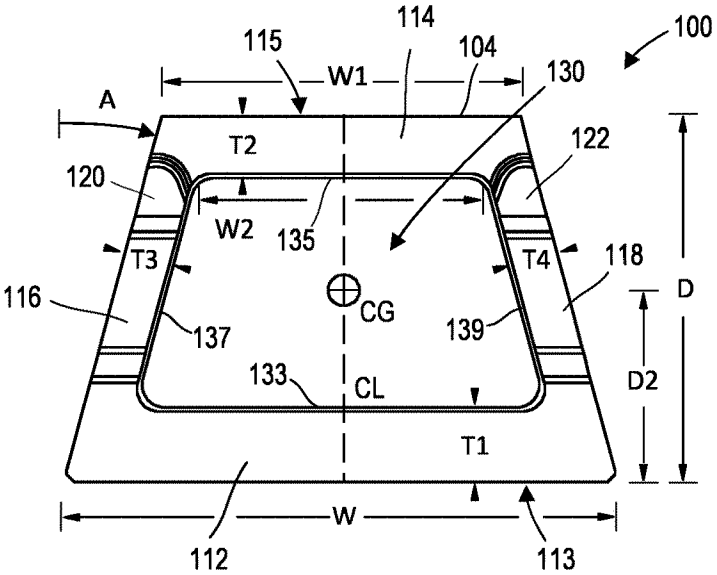
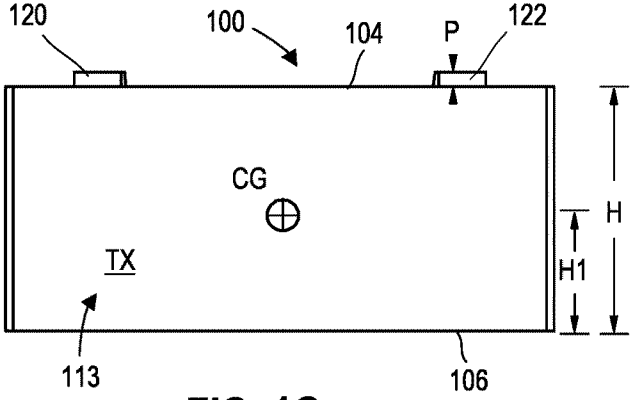
FIG. 1C

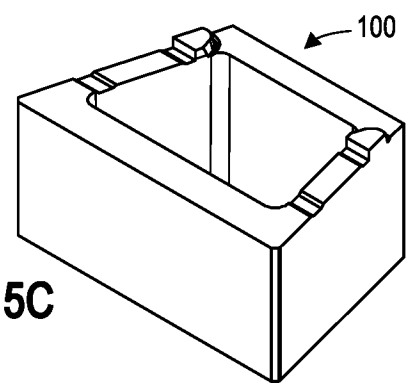
FIG. 5A
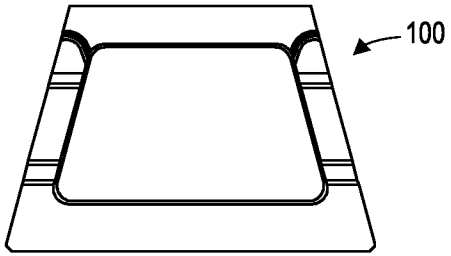
FIG. 5B
FIG. 5C
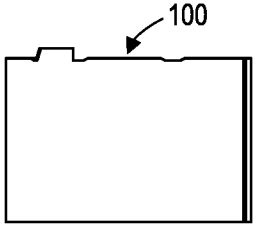
FIG. 5D
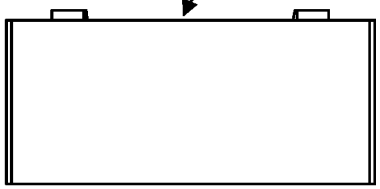
FIG. 5E
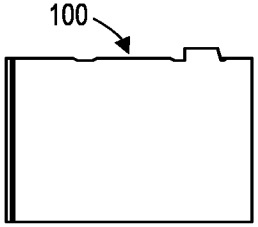
FIG. 5F
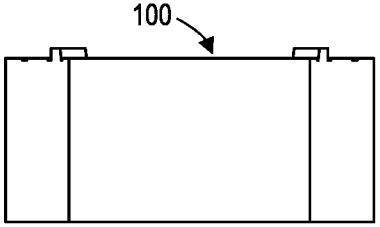
FIG. 5G
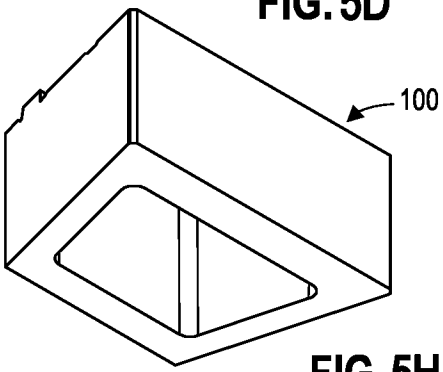
FIG. 5H
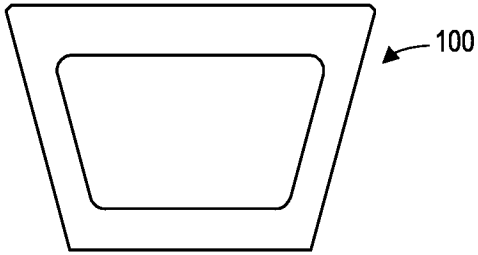
FIG. 5I
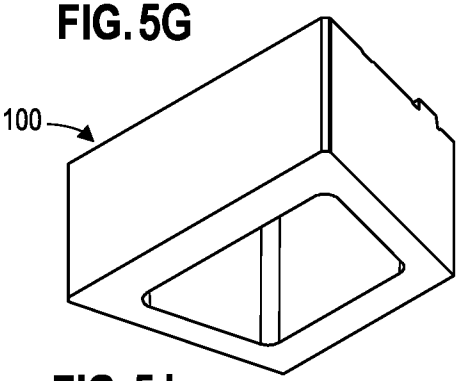
FIG. 5J

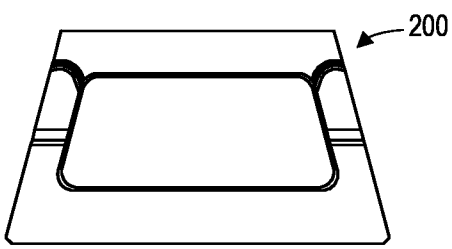
FIG. 10A
FIG. 10B
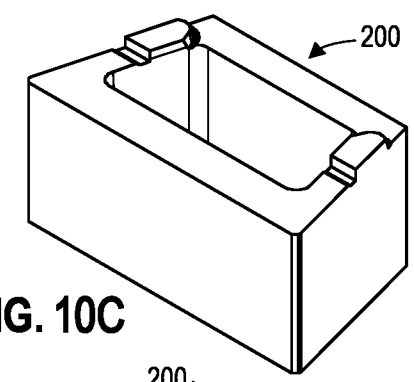
FIG. 10C
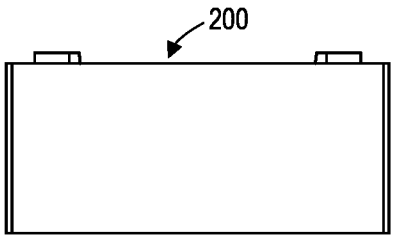
FIG. 10D
FIG. 10E
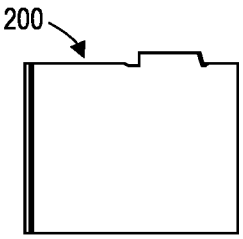
FIG. 10F
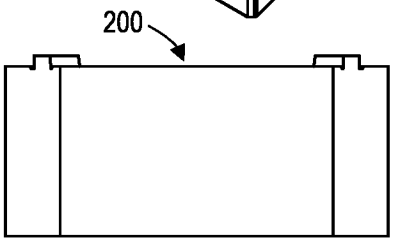
FIG. 10G
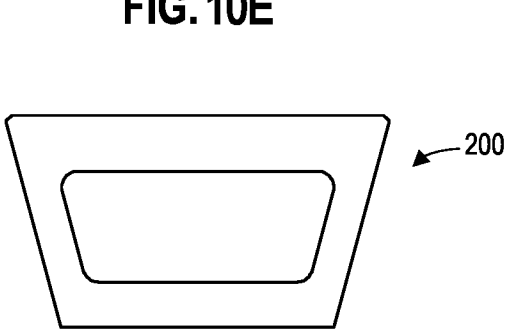
FIG. 10H
FIG. 10I
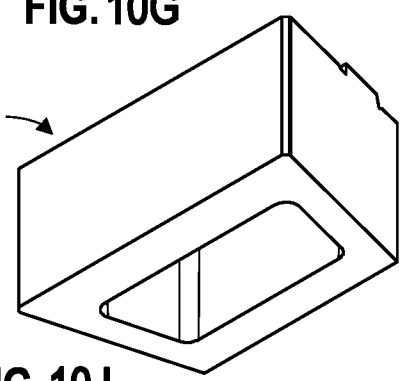
FIG. 10J

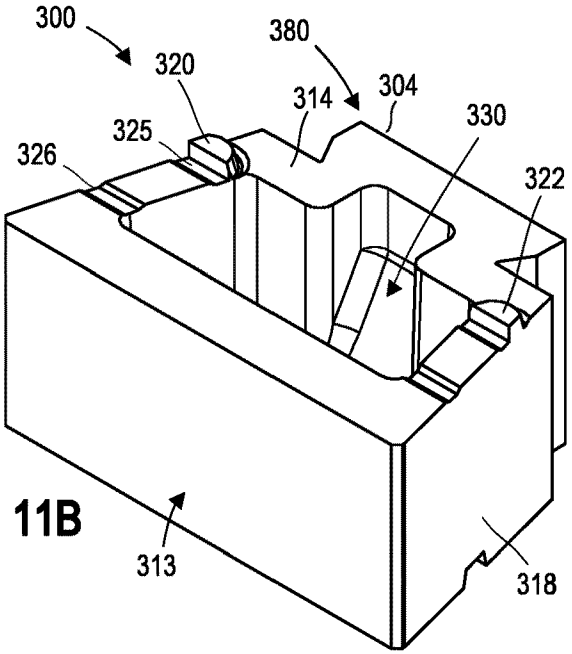
FIG. 11B
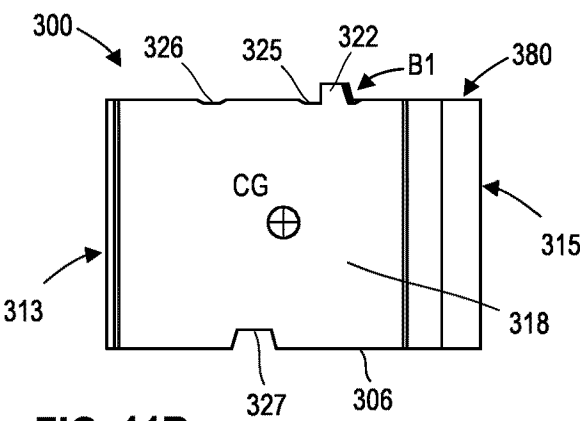
FIG. 11D
FIG. 11A
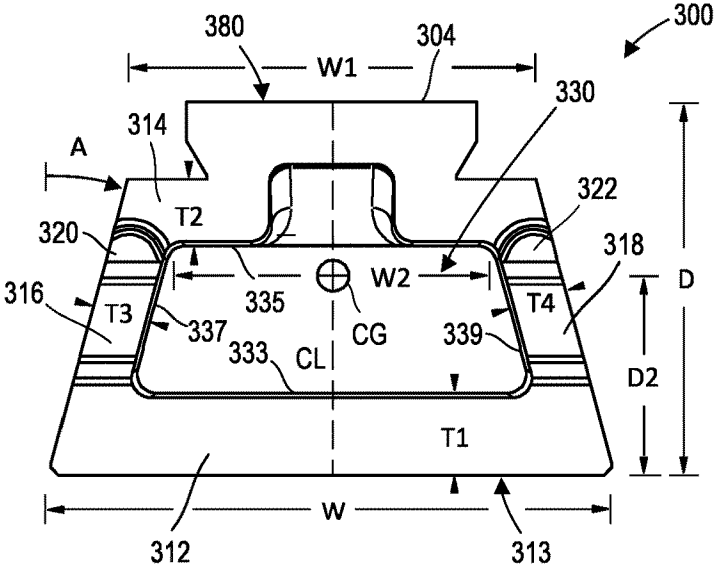
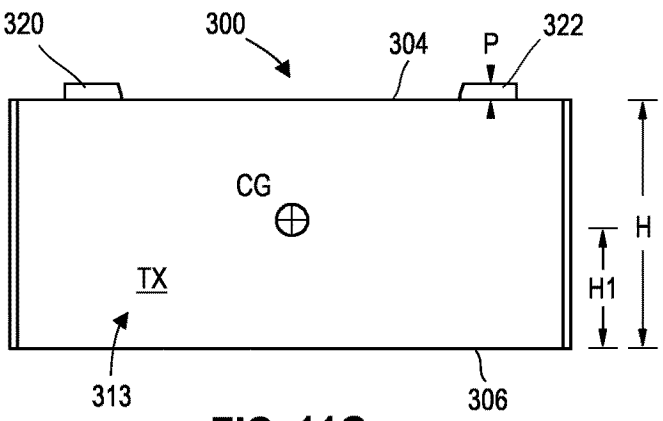
FIG. 11C

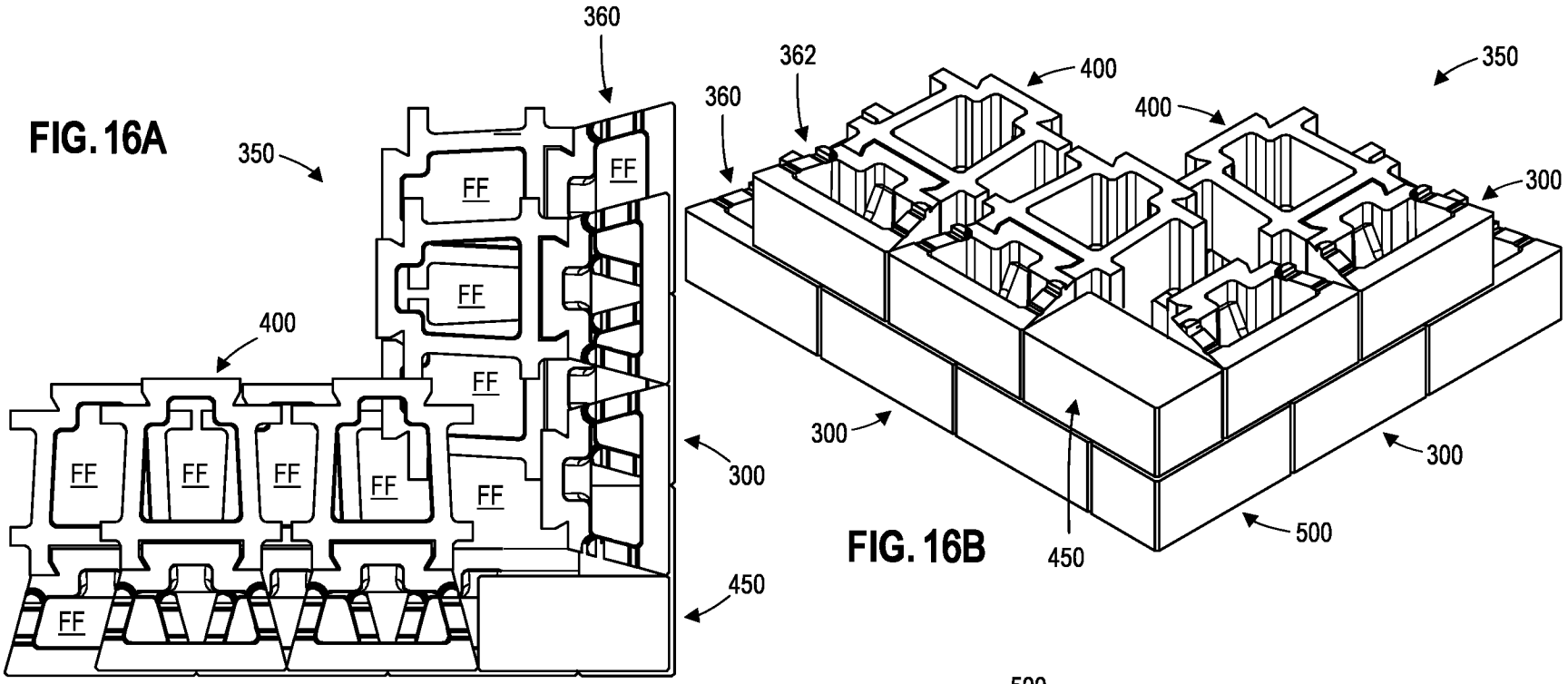
FIG. 16A
FIG. 16B
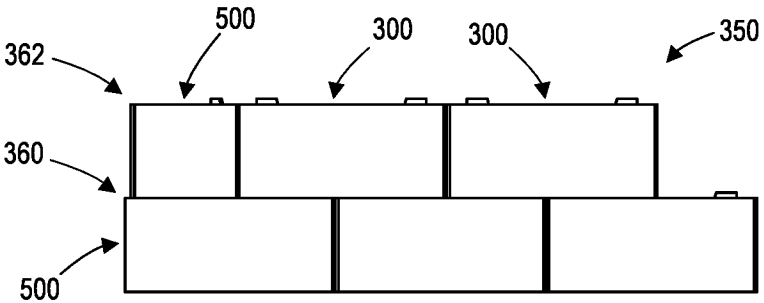
FIG. 16D
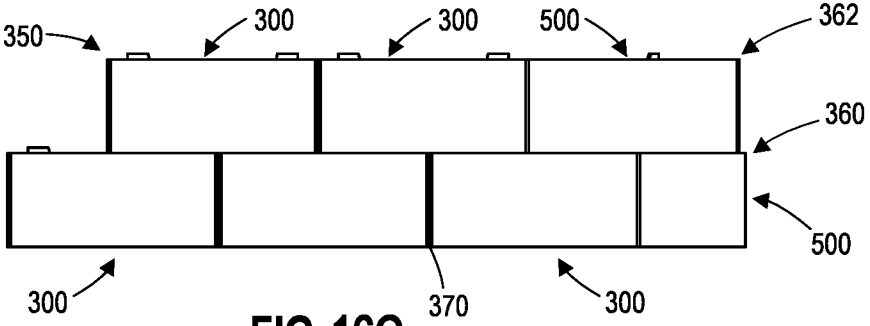
FIG. 16C

400

400

400

400

400

400

400

400

400

400

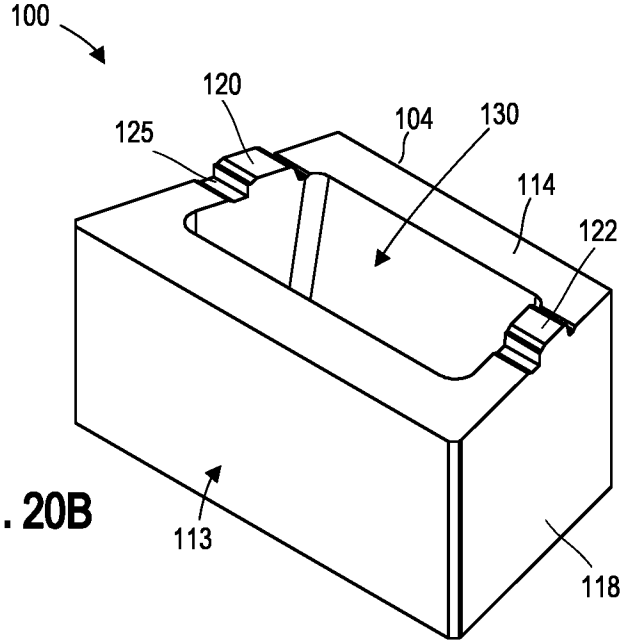
FIG. 20B
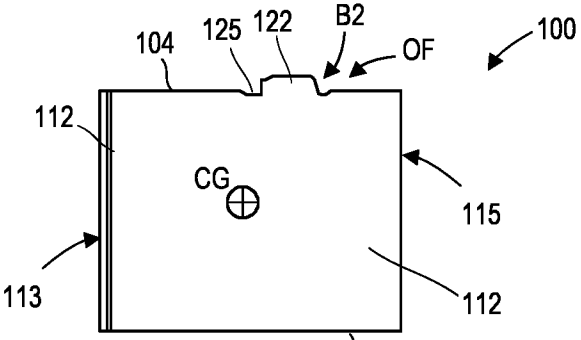
FIG. 20D
FIG. 20A
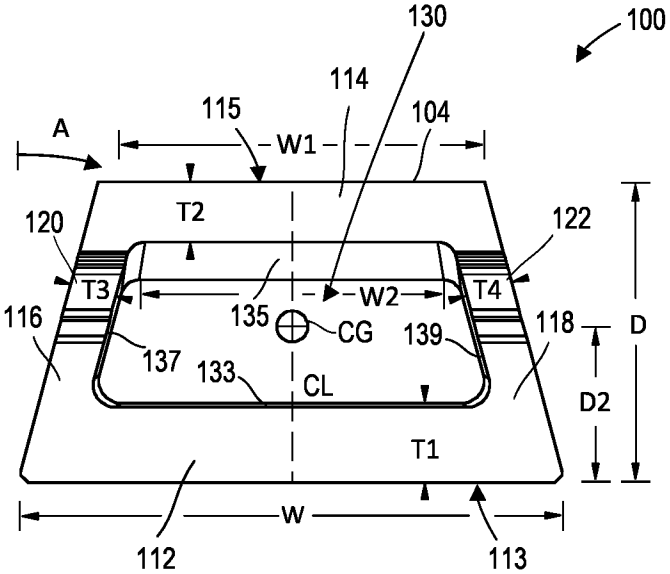
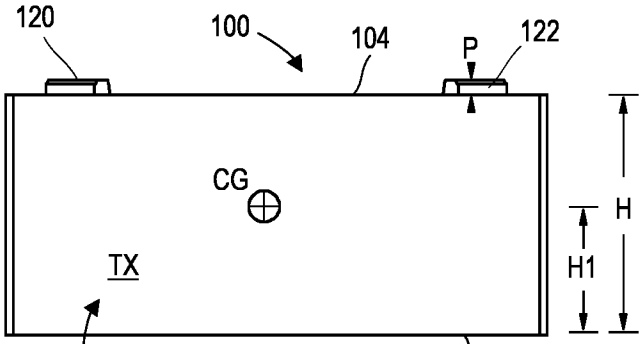
FIG. 20C

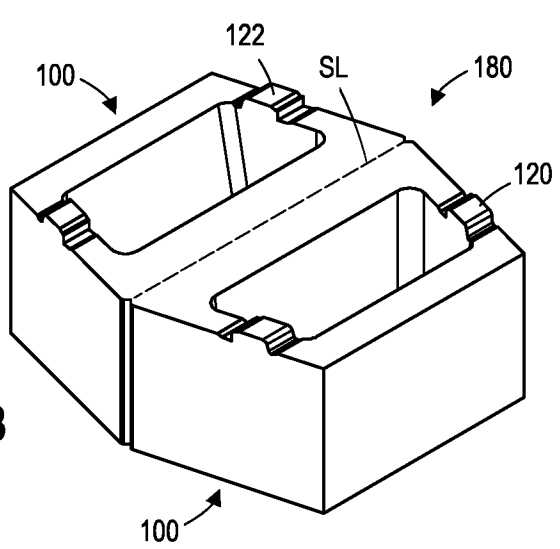
FIG. 24B
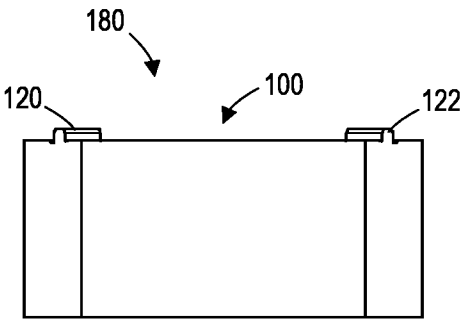
FIG. 24D
FIG.24A
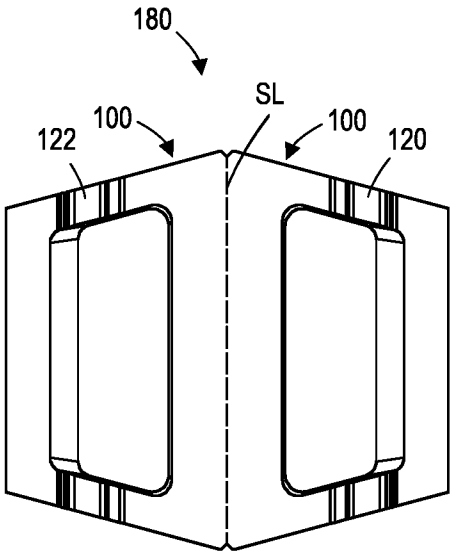
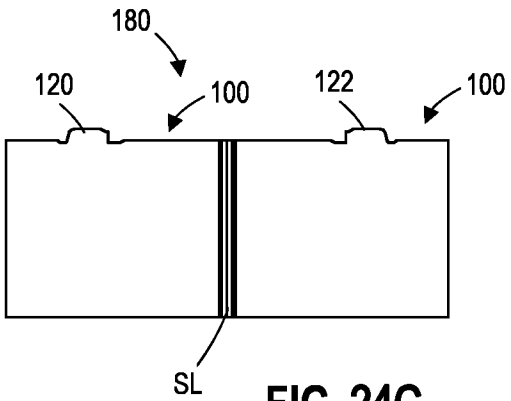
FIG. 24C

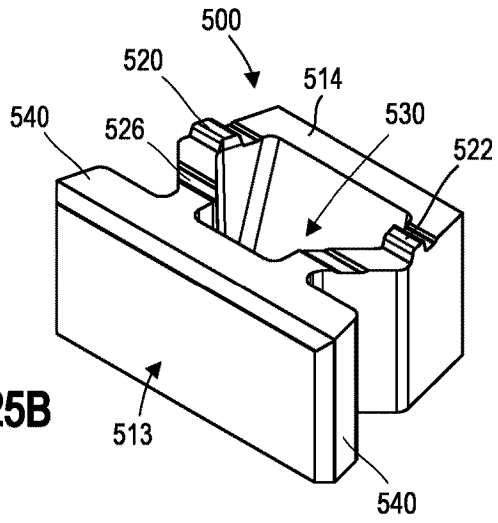
FIG. 25B
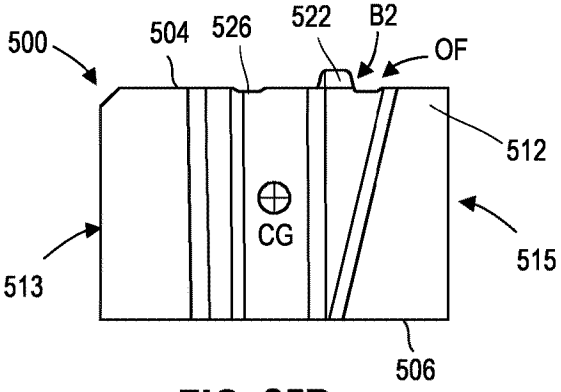
FIG. 25D
FIG. 25A
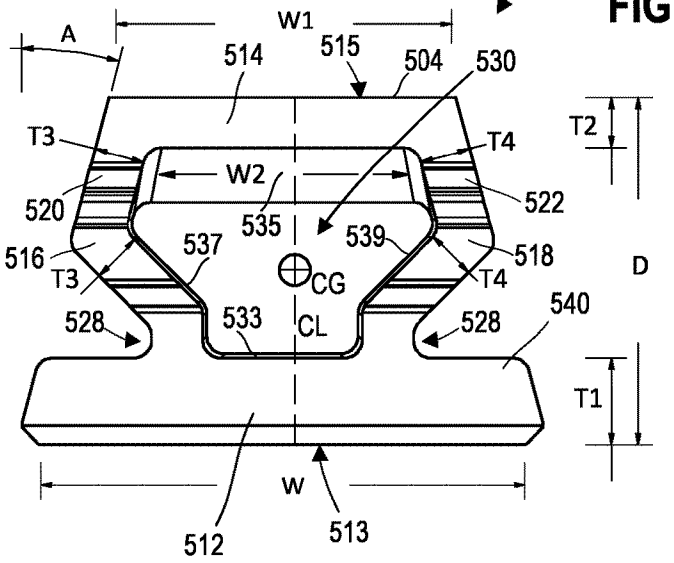
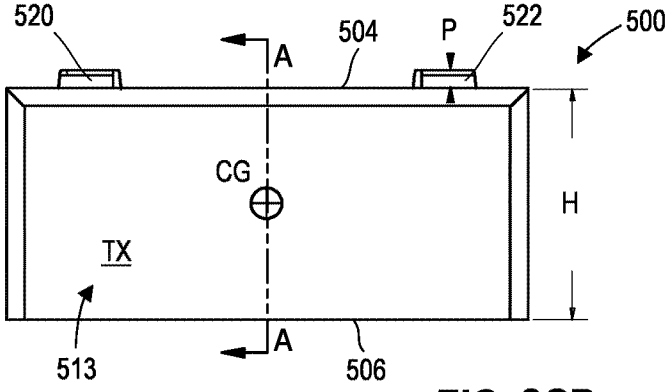
FIG. 2CD

SEGMENTED WALL AND LANDSCAPING BLOCK SYSTEMS WITH LUG PROCESSES

CROSS-REFERENCE TO RELATED APPLICATIONS

This application claims priority to U.S. Provisional Patent Application Ser. No. 63/505,625, filed Jun. 1, 2023, entitled "Segmented Wall Systems having Lug Connections," which is incorporated by reference herein, in the entirety and for all purposes.

FIELD

This application is directed to segmented wall and landscaping block systems with improved inter-block coupling. More generally, the application is directed to segmented wall systems, retaining walls and landscaping block systems with lug-type engagement and coupling features.

BACKGROUND

Segmented wall and landscaping block products are available in a wide variety of materials and styles, adapted for use in retaining walls, partition walls, garden and patio walls, and other landscaping structures. Natural stone, concrete, precast blocks and masonry are commonly used, either alone or in combination with other materials including anchoring and retaining elements, fascia, drainage features, timbers, ties, and other structural components.

Segmented wall systems can be used to construct laid, positioned, and dry-stacked structures without the need for mortar and other binding component. Segmented wall systems can also provide improved structural integrity and durability, combined with a wide range of architectural finishes selected for style, appearance, and other user preferences.

A mold can be used to form the blocks, either singly or multiply in the form of manufacturing modules, for example from dry cast concrete or from aggregate, reinforced fiber or matrix composite materials, combined with cement or another suitable binder. The blocks can be formed as hollow units with internal core structures designed to reduce weight while retaining strength and structural integrity, with a variety of tabs, channels and other elements adapted for anchoring the blocks to a subsurface or reinforced grid, or to one another, for example using locator pins, rods, bars or other mechanical elements. Sidewall liners, stripper shoes and other molding components can also be provided to impart the blocks with textured surfaces and other structural, functional and aesthetic features.

Once completed, the manufacture blocks (or block modules) can be stacked on a pallet or other structure for shipping, and then assembled on location into a segmented wall system or other landscaping structure. Across these applications, there remains a need for additional structural features adapted to improve inter-block coupling during shipment, storage and handling, which are not subject to the limitations of existing prior art designs.

SUMMARY

A segmented wall system includes a plurality of blocks forming first and second courses, extending in a longitudinal direction. The blocks have engagement lugs extending from the top or bottom surface; e.g., along the front or rear portions of the block, on opposing sides of the central opening. The lugs of a selected block in the first course can be adapted to engage the openings of one or more blocks in the second course, for example along one or more of the front, rear, and adjacent side surfaces of the openings in an adjacent pair of blocks in the second course, improving structural stability of the assembled wall system. The lugs can also be adapted for stacking in a nested shipping configuration, reducing shipping volume and limiting relative motion of the stacked blocks, for example where the blocks sit flat, and on the lugs, to decrease the risk of damage during shipment, storage and handling.

EXAMPLES

Depending on application, the wall system can include a plurality of landscaping blocks, each having a front portion, a back portion, and first and second sidewall portions extending between the front portion and the back portion, and an opening having a perimeter defined along the inner surfaces of the front, back and sidewall portions, and a lug process extending from each sidewall portions. First and second courses can be assembled from a number of the landscaping blocks and stacked vertically (on or under) the first course. The lug processes extending from the sidewall portions of a landscaping block in the first course can engage different openings in an adjacent pair of landscaping blocks in the second course. Conversely, the lug processes on adjacent sidewall portions of an adjacent pair of landscaping blocks in the first course can engage the same opening in the same (single) landscaping block in the second course.

Depending on application, the landscaping block can include a front wall portion, a back portion, first and second sidewall portions extending between the front wall portion and the back portion, and an opening defined between the front wall portion, the back portion and the sidewall portions, with the perimeter defined along the corresponding inner surfaces. Lug processes extend from each of the sidewall portions, with beveled surfaces configured to engage different openings in an adjacent pair of similar landscaping blocks, when stacked adjacent (on or under) the landscaping block in a wall system.

Conversely, the beveled surfaces are also configured for the lug processes on adjacent pair of landscaping blocks to engage the same opening of a single such block, when stacked vertically above or below (adjacent) the pair of blocks. For example, the beveled surfaces can be symmetric about the block centerline, and oriented toward the back portion of the landscaping block (and configured to engage the openings in the adjacent pair of landscaping blocks along the inner surfaces of the respective back portions), or oriented toward the front wall portion of the landscaping block (and configured to engage the openings along the inner surfaces of the respective front wall portions).

In some applications, nesting structures are defined along exterior surfaces of the first and second sidewall portions, and adapted to receive the lug processes of additional landscaping blocks stacked in an adjacent layer for shipping or storage. The nesting structures can be adapted to limit lateral motion of the landscaping blocks in the adjacent layer, by engagement with the respective lugs. For example, the nesting structures can be adapted for landscaping blocks in the adjacent layer to have a reversed or rotated orientation, when stacked for shipping or storage. The nesting structures can be adapted for the landscaping blocks in the adjacent layer to have a stacked shipping or storage height that is the same as the installed height of the landscaping block, when assembled into a wall system. Methods of assembling the blocks into a wall system or shipping configuration are also included.

BRIEF DESCRIPTION OF THE DRAWINGS

FIGS. 1A-ID are top plan, isometric, front elevation and side elevation views of a landscaping block for a segmented wall system, with beveled lug type connections.

FIGS. 5A-5J are top left isometric, top plan, top right isometric, left elevation, front elevation, right elevation, rear elevation, bottom left isometric, bottom plan, and bottom right isometric views of the block in FIGS. 1A-ID, illustrating the overall design.

FIGS. 10A-10J are top left isometric, top plan, top right isometric, left elevation, front elevation, right elevation, rear elevation, bottom left isometric, bottom plan, and bottom right isometric views of the block in FIGS. 6A-6D, illustrating the overall design.

FIGS. 11A-11D are top plan, isometric, front elevation and side elevation views of a base block or base unit for a segmented wall system, with tail unit coupling.

FIGS. 16A-16D are top plan, isometric, front elevation and side elevation views of a segmented wall system with a number of corner blocks forming an outside corner.

FIGS. 20A-20D are top plan, isometric, front elevation and side elevation views of a landscaping block for a segmented wall system, with parallel lug connections.

FIGS. 24A-24D are top plan, isometric, front elevation and side elevation views of a manufacturing module for forming blocks according to FIGS. 20A-20D.

FIGS. 25A-25D are top plan, isometric, front elevation and side section views of a landscaping block for a segmented wall system, with a nesting lug configuration.

Figure 2B:
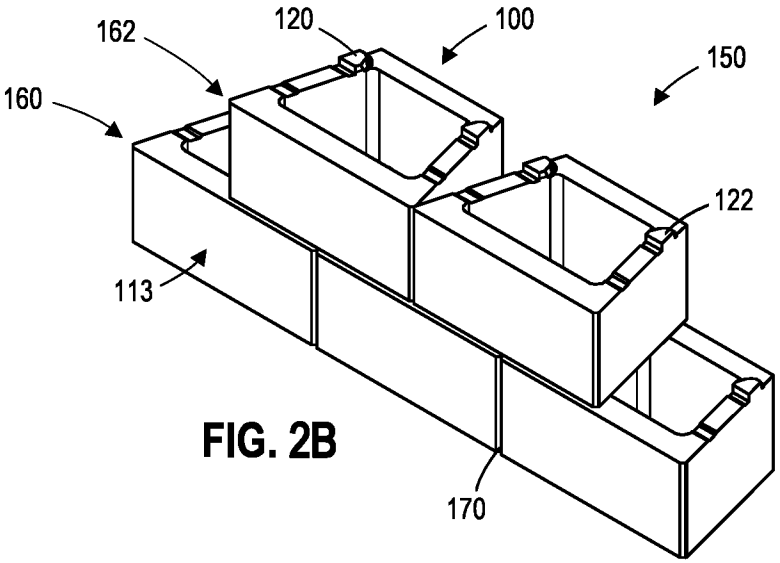
FIGS. 2A-2D are top plan, isometric, front elevation and side elevation views of a segmented wall system assembled from a number of blocks according to FIGS. 1A-ID.

The figures identify elements of the blocks and segmented wall systems using reference numbers and symbols. Not all of the references are repeated for every instance of each element, for example where multiple instances of common elements appear in the same and related drawings, or to improve clarity when describing other, additional features of the drawings, where the common features have already been described, or are understood in the art.

DETAILED DESCRIPTION

Certain details are set forth below to provide an understanding of the present disclosure. These examples can be applied to practice in various combinations, as understood by those of skill in the art, without necessarily including every detail that is disclosed. The applications described here are provided by way of example, and do not limit the scope of the disclosure, except as defined by the appended claims.

More generally, this disclosure includes exemplary applications of segmented wall systems using a variety of landscaping blocks with lug-type engagement features adapted to improve coupling between adjacent courses of blocks. In some examples, the segmented wall system can be constructed from several vertically stacked courses or layers of such blocks. Each course or layer can extend in a longitudinal (e.g., horizontal) direction, with successive courses extending in a transverse (e.g., vertical) direction to define the face of the wall system.

For example, each course can include a set of blocks positioned side-by-side in a substantially level plane. The number of the blocks in each course can be selected based on the desired length of the wall system in the longitudinal direction, and the respective width of the blocks. The number of courses can be selected based on the desired height of the wall system in the transverse (vertical) direction, and the respective installed height.

Lug-type inter-block engagement processes (or "lugs") can be formed on the top or bottom surface of each block, so that the lugs on one (e.g., lower) course engage the openings in one or more blocks of an adjacent (e.g., upper) course. In some examples, the horizontal alignment of the blocks between adjacent courses can be offset so that a pair of lugs on a block on the first course engages the openings of two different, adjacent blocks in the second course.

The lugs can be disposed toward the back wall of the block, and adapted to engage one or more of the respective rear and adjacent side surfaces of the openings in the blocks of successive course. The lugs can be disposed toward the front wall of the block, and adapted to engage one or more of the respective front and adjacent side surfaces of the openings. The lugs can also be provided on either the top or bottom surfaces of the blocks, and the upper and lower orientation of the courses can be reversed or rotated, without loss of generality.

In some examples, the blocks include a pair of symmetrical, opposing lugs formed on a top surface of the block sidewalls, extending between the front and back of the block. The front portion can define the front face of the block, for example with an outward-facing textured surface, opposite the back portion. The front, back and sidewall portions define the inner surfaces of the opening; e.g., as disposed about the block center of gravity in the core region.

The lugs can be beveled, rounded, shaped, or otherwise adapted to engage with or conform to the corresponding surfaces of the openings in the adjacent stacked blocks; e.g., along either the rear or front surface, or along the adjacent side surfaces, or a combination thereof.

In some examples, the segmented wall systems can be assembled by vertically stacking a number of horizontally adjacent blocks to form the successive courses. The geometry of the blocks can be selected so that the lugs of a block in the first course can engage the openings in one or more blocks of the second, adjacent course, in which the blocks are successively stacked. When assembled, the wall system can have a generally linear geometry, or any combination of linear, convex and concave curvature.

The degree of curvature, for example, can be determined by the depth of the blocks and the angle of the block sidewalls, so that they do not interfere with those of the horizontally adjacent blocks. The curvature can also be determined by an angle between the adjacent blocks when assembled into a course, so that the lugs of each block are disposed within the cavities of the blocks in the adjacent (e.g., upper or lower) course, and do not interfere with the respective front, back, or sidewall structures.

Suitable wall systems can also utilize reinforced earth techniques, including, but not limited to, geogrid reinforcement, geosynthetic reinforcement, substantially inextensible materials such as steel matrices, and other reinforcement materials. After placement of a course or layer of the wall system, for example, a geogrid reinforcement material can be placed over the installed blocks, before placement of the successive course. The weight of the upper course on the geogrid material sandwiched between two courses can help hold the geogrid material in place, and, conversely, the geogrid material can help hold the blocks in place, in the successive courses. Additional pins, rods, stakes and other mechanical connectors can also be employed, and fill materials can be used help keep the blocks and geogrid material in place.

Applications

FIG. 1A is a top plan view of a landscaping block or wall block 100 for a segmented wall system, with inter-block engagement processes (or lugs) 120, 122. FIG. 1B is an isometric view of the block 100, and FIG. 1C and FIG. 1D are front and side elevation views, respectively.

In these examples, block 100 is formed of a front wall or front portion 112 defining the front face 113 of block 100, and a back wall or rear portion 114 defining the back surface 115, substantially opposed to and parallel with the front face 113. Block sidewalls (or "neck" portions) 116, 118 extend transversely between front and back wall portions 112, 114; e.g., defining a block side angle (A) as measured from a perpendicular to front face 113 (FIG. 1A). Engagement lugs 120, 122 are defined on the sidewalls or side portions 116, 118 of block 100, extending upward from the top surface 104 adjacent the back wall portion 114, and opposite the bottom surface 106.

Blocks 100 can be made of durable, rugged, weather resistant materials selected for strength and structural integrity, including but not limited to precast concrete (e.g., dry cast or wet cast concrete). Other suitable materials include composite materials, polymers, plastics, reinforced fibers, materials, wood, metal, stone and combinations thereof.

One or both of the front and back surfaces 113, 115 of block 100 can be provided with texturing or other surface features TX; e.g., as indicated in FIG. 1C. Front face 113 can also be provided with a hard split or straight split facing, or unfinished. More generally, any of the front face 113, back surface 115, and exterior surfaces of block sidewalls 116, 118 can be finished, unfinished, textured, untextured, flat, smooth or contoured, depending on application.

The engagement lugs 120, 122 can be defined in a symmetrical sense about the centerline CL of block 100, extending from the top surface 104 of each block sidewall 116, 118 with a common process height (P). Individual blocks 100 and lugs 120, 122 can have a uniform or common size and shape, for example with a standard or uniform installed vertical height H, as defined between the top and bottom surfaces 104, 106, a common width W, as defined at or across the front face 113, and a common depth D, as defined between the front face 113 and the back surface 115. Alternatively, blocks of different sizes and configurations can be used.

One or more grooves or channel features 125, 126 can be formed in either or both of the block sidewalls 116, 118 during the manufacturing process, for example adjacent to the engagement lugs 120, 122 (channel 125), or spaced from lugs 120, 122 along the top surface 104 (channel 126). As shown in FIGS. 1B-ID, for example, channels 125, 126 can be defined transversely across each sidewall 116, 118, extending from the central opening 130 to the exterior of block 100. The width, depth, contour and relative positions of channels 125, 126 may also vary, depending on application and as described herein.

The width W1 of back surface 115 of block 100 can differ from the width W of the front face 113. For example, the width W1 of the back surface 115 may be less than the width W of the front face 113, in order to facilitate the arrangement of blocks 100 into curved wall systems. The width W2 of opening 130 can be defined at or adjacent the back wall portion 114, and selected to accommodate engagement with the lugs 120, 122 of overlaying blocks 100 when assembled into adjacent courses of a segmented wall system, as described herein.

The front, back and side wall portions 112, 114, 116 and 118 of block 100 extend vertically between the upper or top surface (top) 104 of block 100 and lower or bottom surface (bottom) 106, defining a central cavity or opening 130 in the core region. The center of gravity CG of block 100 may be defined inside the opening 130, for example along the midline or centerline CL at distance D1 from the front face 113, and at height H1 from the bottom surface 106, as shown in FIGS. 1A and 1C, respectively. Depending on configuration, a single opening 130 can be formed between opposing front, back, and side wall portions 112, 114, 116 and 118 of block 100, or multiple openings, cavities, or similar apertures 130 can be provided.

The perimeter of opening 130 extends along the inner surfaces of the front, back and side wall portions 112, 114, 116 and 118 of block 100, respectively, with corresponding inside front, rear, and side surfaces 133, 135, 137 and 139 forming the perimeter of opening 130. The thicknesses T1, T2, T3 and T4 of front wall 112, back wall 114, and side walls 116, 118 may vary, depending the dimensions of opening 130, the depth D and width W, W1 of block 100, and the corresponding structural requirements for assembly of blocks 100 into a segmented wall system, or other structure.

The top and bottom surfaces 104, 106 of block 100 are defined by the corresponding upper and lower surfaces of the front, back and side wall portions 112, 114, 116, 188, extending about the perimeter of opening 130. The top and bottom of block 100 can be formed with flat or complementary (e.g., contoured) surfaces 104, 106, and adapted for close stacking of blocks 100 without gaps between vertically adjacent courses. Surfaces 104, 106 can also be provided with textured features.

In order to couple adjacent courses of blocks 100 together, each block 100 includes one or more lug-type processes or protrusions ("lugs") 120, 122; e.g., extending from the top surface 104. For example, a pair of engagement lugs 120, 122 can be defined on the respective side wall portions 116, 118 of block 100, adjacent the back wall portion 114, and extending from the top surface 104 with a common process height (P) as shown in FIGS. 1C and 1D.

Engagement lugs 120, 122 can be positioned directly adjacent the back wall portion 114 of block 100, approximately horizontally aligned with the rear surface 135 of opening 130, where the back wall 114 meets the respective sidewalls 116, 118. Suitable lugs 120, 122 can also be offset from the rear surface 135 of opening 130, as defined along the respective block sidewall 116, 118. This configuration can provide a staggered or inclined wall system 150 with selected setback distance (SB) and setback angle (SA) between successive courses; e.g., as further illustrated according to FIGS. 2A and 2D.

Lugs 120, 122 can be provided with a corner bevel B1 or similar contour oriented toward the back portion 114 of block 100, and adapted to interface with or engage along the rear surface 135 of the opening 130 in a vertically adjacent block 100, when blocks 100 are stacked on top of one another in a segmented wall system. Corner bevels B1 can also engage one or more side surfaces, 137, 139 of the respective opening 130. In some examples, the bevels B1 on lugs 120, 122 can be symmetric, for example as reflected about the block centerline CL as illustrated in FIGS. 1A and 1B.

The rearward-facing and outside surfaces of lugs 120, 122 can be shaped to conform to the rear, side or corner geometry of the openings 130 in one or more overlaying blocks 100, as defined along one or more of the corresponding surfaces 135, 137 and 139, respectively. For example, lugs 120, 122 can be provided with a rounded corner surface or corner bevel B1 along the back and side surfaces, as shown in FIGS. 1A and 1D. Corner bevel B1 can be adapted for engagement of the lugs 120, 122 on a lower-course block 100 with the rear surface 135 and side surfaces 137, 139 of the opening 130 in one or more upper-course blocks 100, when stacked on top of or overlaying the lower-course block 100.

The lug connections can be formed via contact between a pair of lugs 120, 122 formed on the (as-installed) top surface 104 of one block 100 in a lower course or layer, with the rear surface 135 of the opening 130 in one or more blocks 100 of an upper course. In some examples, the horizontal alignment of blocks 100 between the two courses can be offset, so that one lug 120 on a block 100 in the lower course can engage along the rear surface 135 of the opening 130 in a first block 100 of the upper course, and a second lug 122 from the same block 100 in the lower course can engage along the rear surface 135 of the opening 130 in a second block 100 of the upper course, horizontally adjacent to the first block.

Figure 2D:
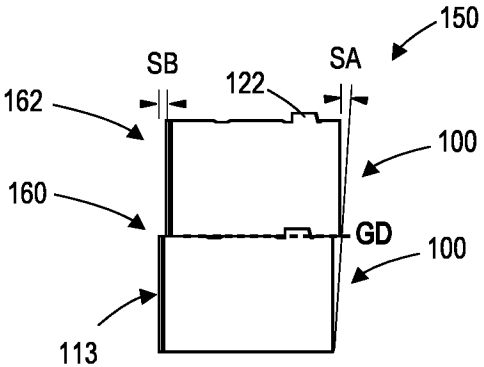
Figure 2A:
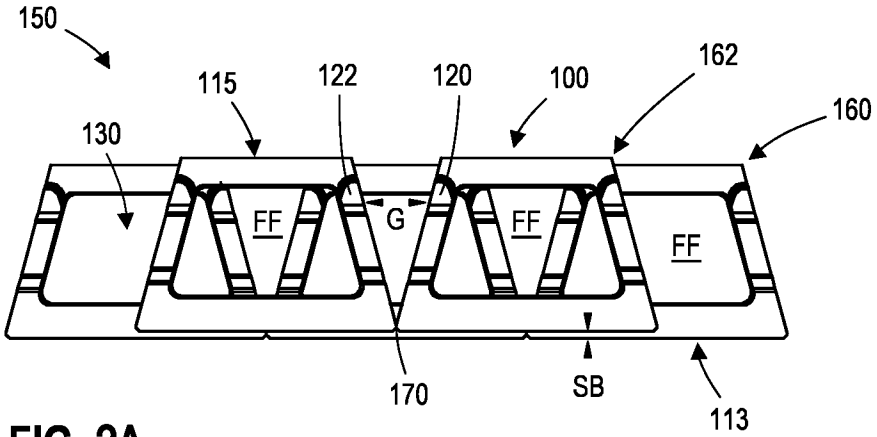
Figure 2C:
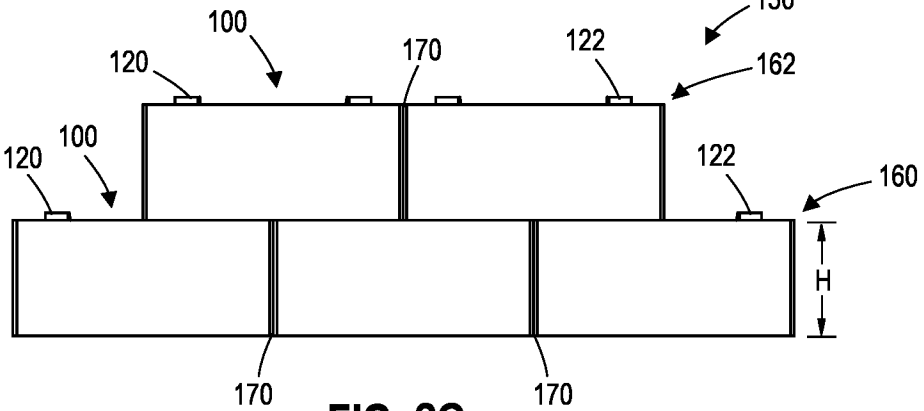

FIG. 2A is a top plan view of a segmented wall system 150, formed with a number of blocks 100 according to FIGS. 1A-1D. FIG. 2B is an isometric view of the wall system 150, and FIGS. 2C and 2D are front and side elevation views, respectively.

Figure 3B:
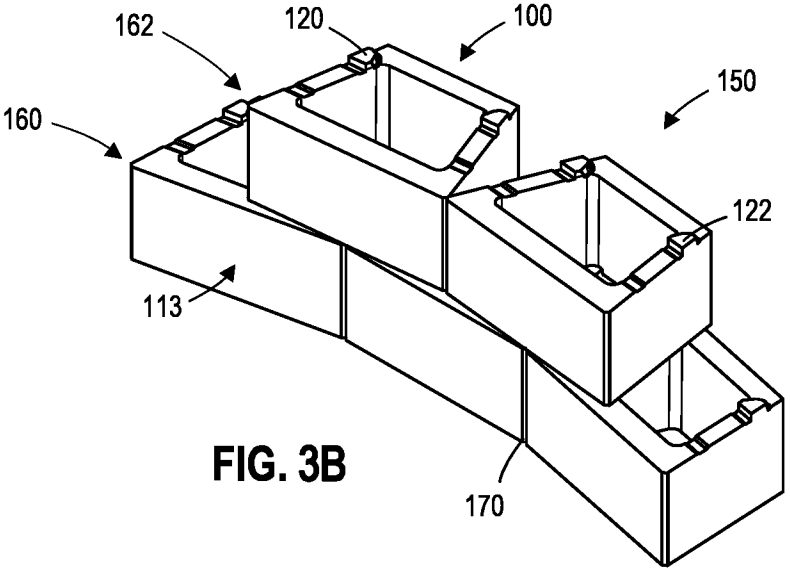
FIGS. 3A-3C are top plan, isometric, and front elevation views of the segmented wall system, in a curved wall application.
Figure 3D:
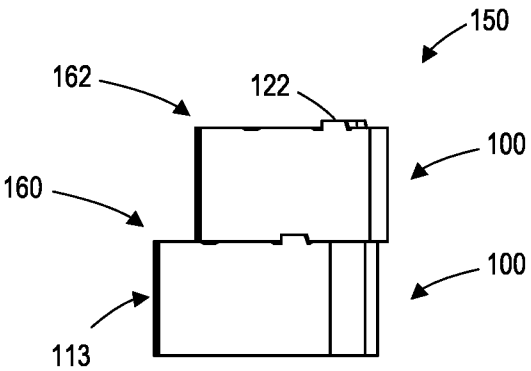
FIG. 3D is a side or section view.
Figure 3A:
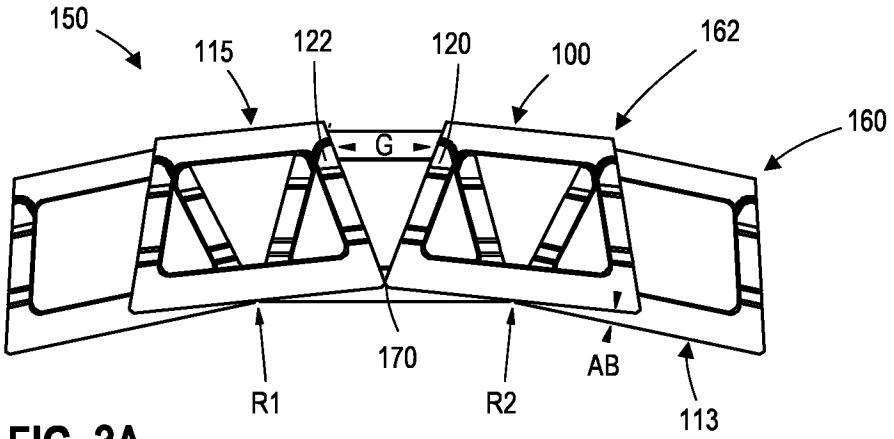
Figure 3C:
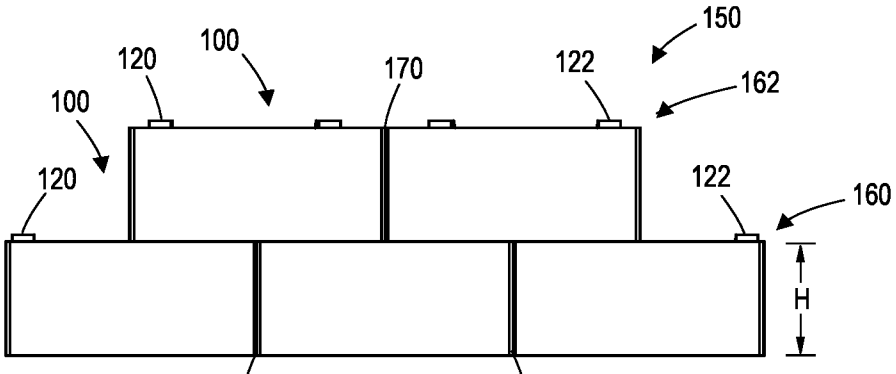

FIG. 3A is a top plan view of the segmented wall system 150, in a curved wall application. FIG. 3B is an isometric view of the wall system 150, and FIGS. 3C and 3D are front and side elevation views, respectively.

Figure 4B:
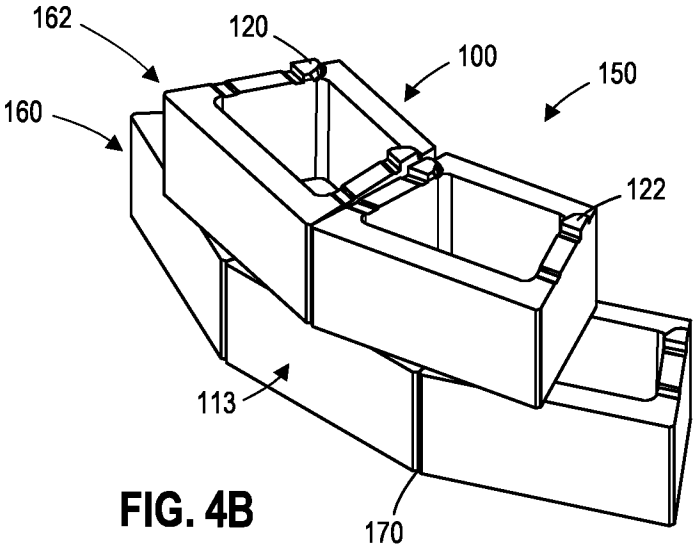
FIGS. 4A-4C are top plan, isometric, and front elevation views of the segmented wall system, with different curvature.
Figure 4D:
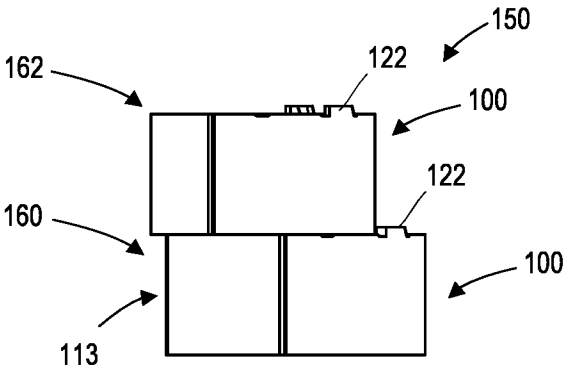
FIG. 4D is a side or section view.
Figure 4A:
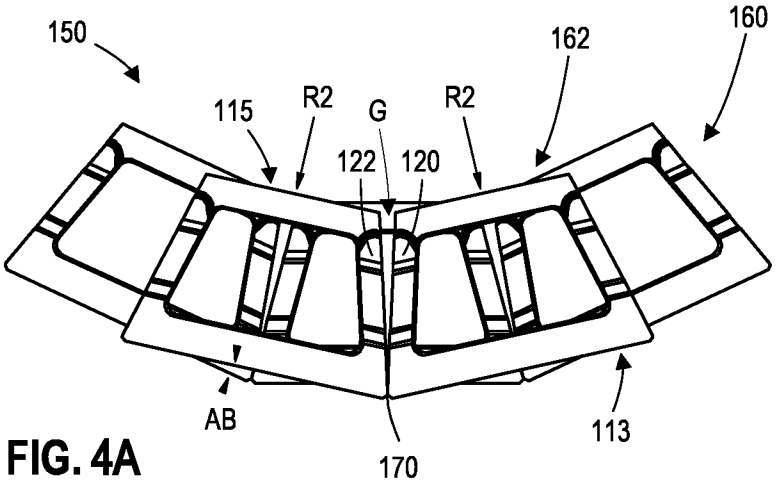
Figure 4C:
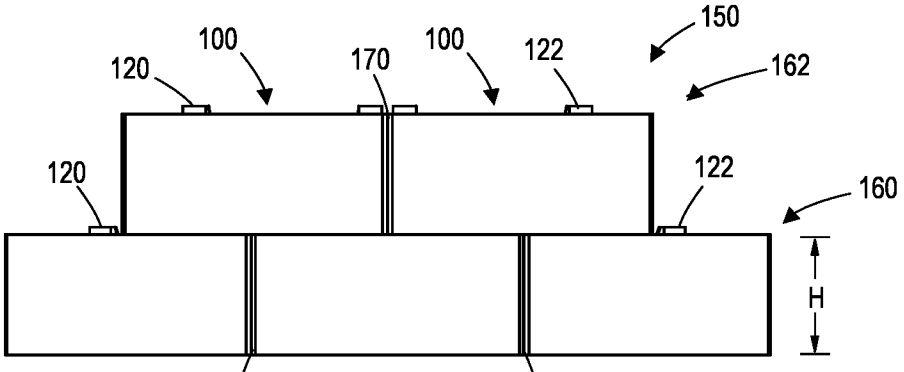

FIG. 4A is a top plan view of the segmented wall system 150, with different curvature. FIG. 4B is an isometric view of the wall system 150, and FIGS. 4C and 4D are front and side elevation views, respectively.

FIGS. 2A-2D, 3A-3D and 4A-4D depict segmented wall systems 150 with various exemplary arrangements of blocks 100. Suitable wall systems 150 can also be formed using any number of blocks 100.

While FIGS. 1A-1D may identify detailed elements and features of block 100 using reference numbers and symbols, these references are not necessarily repeated for every instance of blocks 100 in each wall system 150, for example where common elements appear in the same or related drawings, or to improve clarity when illustrating other relevant features, as described herein, and as understood in the art.

As shown in FIGS. 2A-2D, 3A-3D and 4A-4D, different courses or layers 160, 162 of segmented wall system 150 can be formed from any number of blocks 100. The blocks can be arranged to provide sections of wall system 150 with linear or nonlinear geometry, straight segments, corners, convex or concave curvature, or any combination thereof. Suitable wall systems 150 can also be assembled from any combination of landscaping blocks 100, 200, 300, 500 and 600, with or without one or more tail units 400 and corner blocks 450, as further described herein.

In FIGS. 2A-2D, for example, a straight or linear segmented wall system 150 is shown with first and second (e.g., lower and upper) courses 160, 162, each formed from a number of blocks 100. The blocks 100 abut along a series of interfaces 170 defined between the adjacent front faces 113 of consecutively positioned blocks 100, for example in the form of a vertical interface 170 bisecting the respective planes of the front faces 113, as further illustrated in FIGS. 3B, 3C, 4B and 4C.

In some examples, the geometry of wall system 150 can accommodate the engagement of a pair of lugs 120, 122 on one block 100 in a lower course 160 with the rear surfaces 135 of openings 130 in two adjacent blocks 100 in an upper course 162. The interfaces 170 between abutting blocks 100 can thus be offset or staggered in the adjacent courses 160, 162, for example with the interface 170 between adjacent blocks 100 in the upper course 162 approximately bisecting the corresponding block 100 in lower course 160, as shown in FIG. 2C.

The arrangement of wall system 150 with inter-layer structural couplings provided by engagement of lugs 120, 122 in the openings 130 of adjacent stacked blocks 100 increases stability by adding an interlocking structure between blocks 100 in consecutive courses 160, 162. The openings 130 in blocks 100 can also be packed with a fill material (FF); e.g., as shown in FIG. 2A. The fill material can be selected to improve drainage, for example using gravel, sand, aggregate, or a combination thereof, and to further strengthen the coupling between blocks 100 in adjacent courses 160, 162.

In some applications, wall system 150 can also utilize reinforced earth techniques such as geogrid reinforcement, geosynthetic reinforcement, inextensible materials such as steel rods or a steel matrix, or other reinforcement material (GD) as shown in FIG. 2D. After placement of one (e.g., lower) course or layer 160 of the wall system 150, for example, a suitable geogrid or other reinforcement material can be placed over the first course 160 before installing the next (e.g., upper) course 162. The weight of the upper course 162 and blocks 100 (filled or unfilled) is imposed on the geogrid material, which is sandwiched between two courses 160, 162, holding the geogrid material in place with respect to the wall system 150, and holding the wall system 150 in place with respect to the geogrid material.

FIGS. 3A-3D show portions of a curved (e.g., concave) segmented wall system 150 with two adjacent (lower and upper) courses 160, 162 formed of blocks 100. The curvature of wall system 150 can be defined according to the inside radius of curvature R1, R2, as shown in FIG. 3A. The curvature in turn defines the block wall angle (AB) between the front faces 113 of adjacent blocks 100; e.g. adjacent the corresponding interface 170 as shown.

The curvature may uniform (R1=R2) or may vary (R1≠R2), with each portion of wall system 150 defining a respective wall angle accordingly. A maximum wall angle, in turn, can be defined by the gap distance (G) between the outside edges of the lugs 120, 122 on adjacent blocks 100 in the upper or lower course 160, 162; e.g., as shown in FIG. 3A, as compared to the width W2 of the opening 130 in the overlaying (upper-course) block 100, as defined at the rear surface 135 according to FIG. 1A.

For example, the maximum (concave) block wall angle can be defined so that the gap between the outside edges of lugs 120, 122 on adjacent blocks 100 in lower course 160 is less than or equal to the width W2 along the rear surface 135 of the opening 130 in the overlaying block 100, in the upper course 162. Thus, the lugs 120, 122 on one block 100 in the lower course 160 can be engaged within the openings 130 of two adjacent overlaying blocks 100, in the upper course 162. Conversely, the lugs 122, 120 on two adjacent blocks 100 in the lower course 160 can be engaged within the same opening 130 of the same overlaying block 100, in the upper course 162. This arrangement provides cross-coupling of adjacent blocks 100 in successive courses 160, 162, substantially improving the strength, rigidity and structural integrity of wall system 150.

FIGS. 4A-4D depict a curved (e.g., convex) segmented wall system 150 with two adjacent courses 160, 162. The courses 160, 162 can include any number of blocks 100. The (outside) radius curvature can be uniform (R1=R2) or may vary (R1≠R2), with each portion of wall system 150 defining a respective block wall angle (AB). The maximum convex curvature can be defined by the maximum (convex) block wall angle; e.g. as defined adjacent the interface 170 between adjacent block faces 113. For example, the maximum block wall angle can be defined when the gap (G) between the outer edges of the lugs 120, 122 on adjacent blocks 100 decreases toward zero, at which point the outside edges of the block sidewalls 116, 118 may make contact.

The wall systems 150 in FIGS. 2A-2D, 3A-3D and 4A-4D are exemplary. While the drawings may show wall systems 150 with lower and upper courses 160, 162, for example, suitable systems 150 can include any number of courses. Segmented wall systems 150 can also include number of blocks 100 in each course, whether fewer or more than depicted. Suitable wall systems 150 can also be provided in different shapes and geometries using any combination of landscaping blocks, tail units and corner blocks described herein, with linear or nonlinear geometry, straight segments, corners, convex or concave curvature, or any combination thereof.

FIGS. 5A-5C are top left isometric, top plan, and top right isometric views of a landscaping block 100, e.g. as shown in FIGS. 1A-1D, illustrating the overall block design. FIGS. 5D-5G are left, front, right, and rear elevation views of block 100, and FIGS. 5H-5J are bottom left isometric, bottom plan, and bottom right isometric views, respectively.

Figure 6B:
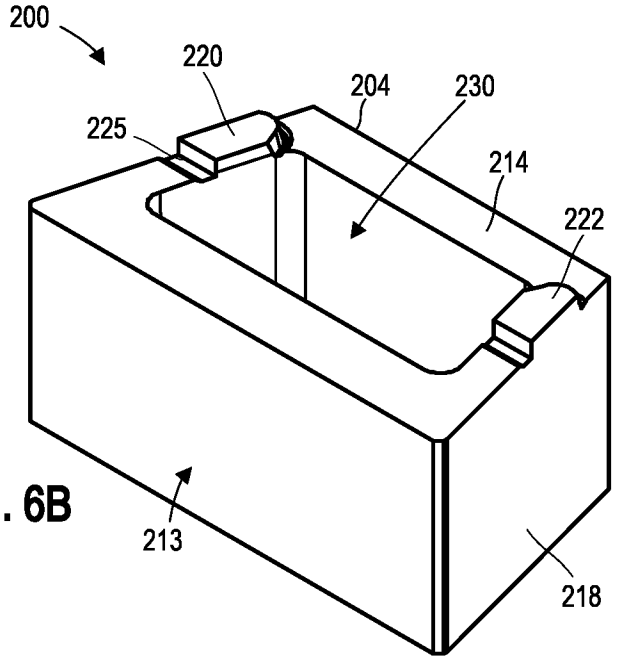
FIGS. 6A-6D are top plan, isometric, front elevation and side elevation views of a landscaping block for a segmented wall system, with extended lug type connections.
Figure 6D:
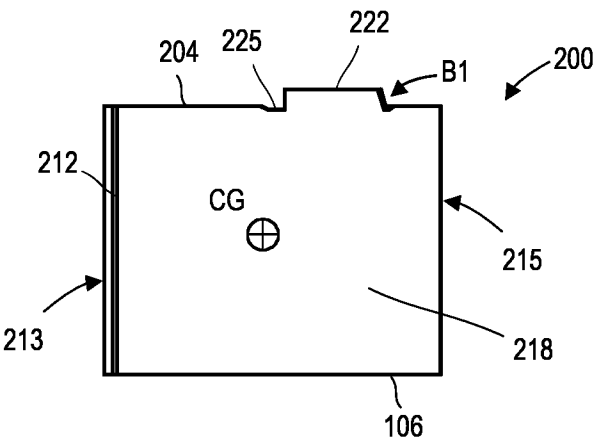
Figure 6A:
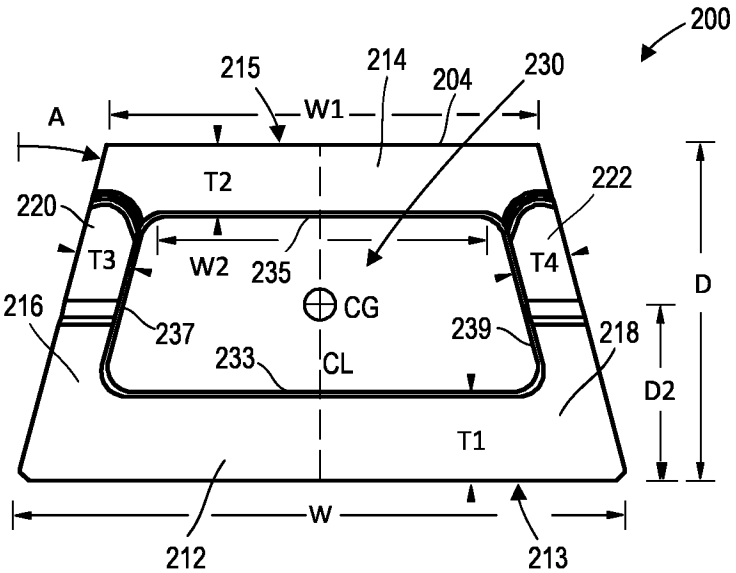
Figure 6C:
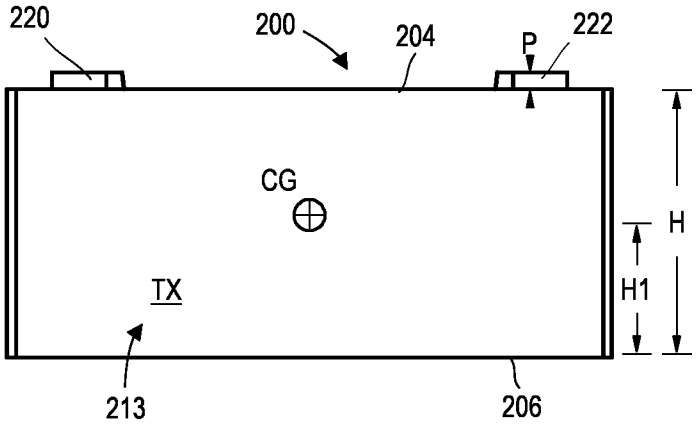

FIG. 6A is top plan view of a landscaping block or wall block 200 for a segmented wall system, with extended inter-block engagement processes (or lugs) 220, 222 formed on the top surface 204 of block sidewalls 216, 218. FIG. 6B is an isometric view of the block 200, and FIGS. 6C and 6D are front and side elevation views, respectively.

In these examples, block 200 is formed of a front wall portion 212 defining the front face 213, and a back wall or rear portion 214 defining the back surface 215, substantially opposed to and parallel with the front face 213. Block sidewalls ("leg" or "neck" portions) 216, 218 extend transversely between front and back walls 212, 214.

Blocks 200 can be made of durable rugged, weather resistant materials selected for structural integrity, including but not limited to precast concrete (e.g., dry cast or wet cast concrete). Other suitable materials include polymers, plastics and reinforced fibers, composite materials, wood, metal and stone, and combinations thereof.

As shown in FIGS. 6A-6D, block 200 has first and second coupling features in the form of engagement lugs 220, 222 extending from the top surface 204, with a common or uniform process height (P). The blocks 200 may also have a uniform or common size and shape; e.g., as defined about the center of gravity CG, or different sizes and shapes. In some applications, for example, blocks 200 have a standard or uniform installed, vertical height H, as defined between the top and bottom surfaces 204, 206, a common width W, as defined at or across the front face 213, and a common depth D, as defined between the front face 213 and the back surface 215.

The width W1 of back surface 215 may vary, and may differ from the width W of the front face 213. For example, the width W1 of the back surface 215 may be less than the width W of the front face 213, in order to facilitate the arrangement of blocks 200 into curved wall structures. The width W2 of opening 230 can also vary, for example as defined at or adjacent the back face 215, in order to engage the lugs 220, 222 of underlaying blocks 200 when assembled into adjacent courses of a segmented wall system, as described herein.

In some examples, blocks 200 have a standard or uniform installed vertical height H, a common width W, and a common depth D. The blocks 200 can be made of a rugged, weather resistant material, such as precast concrete (e.g., dry cast or wet cast). Other suitable materials include plastic, reinforced fibers, wood, metal and stone.

One or more grooves or channel features 225 can be formed in either or both of the block sidewalls 216, 218; e.g., along the top surface 204, adjacent lugs 220, 222. As shown in FIG. 6B, for example, channels 225 extend transversely across each block sidewall 216, 218, from the central opening 230 to the exterior of block 200. The depth of channels 225 may be the same or may vary, as described herein.

One or both of the front and back surfaces 213, 215 of block 200 can be provided with texturing or other surface features TX; e.g., as indicated in FIG. 6C. More generally, any of the exterior surfaces of block 200 can be textured, untextured, smooth, contoured, flat, or provided with a hard split or straight split facing, or unfinished.

Blocks 200 can include at least one cavity, aperture or opening 230 formed between the front wall portion 212 (e.g., defining the front surface 233 of opening 230), and the back portion 214 (defining the rear surface 235 of opening 230). Sidewall portions 216, 218 of block 200 extend between the front and back wall portions 212, 214, defining the side surfaces 237, 239 of opening 230, on the opposing sides of the block 200.

Similarly, the outer surfaces of sidewalls 216, 218 can define the outside surfaces of block 200. The top and bottom surfaces 204, 206 of block 200 can be formed with complementary flat or contoured surfaces to facilitate stacking of blocks 200 on top of one another in adjacent courses of a segmented wall system, as described herein.

In order to connect courses or layers of blocks 200 together, each block 200 can include a pair of engagement lugs 220, 222; e.g., extending from the top surface 204 of block 200. The lugs 220, 222 protruding from the top surface 204 of block 200 can be horizontally aligned with the rear surface 235 of opening 230, and positioned on the block sidewalls 216, 218 proximate the back corner of block 200, where the sidewalls 216, 218 meet back wall 214.

The pair of lugs 220, 222 can be configured to interface with the rear surface 235 of the opening 230 of one or more additional blocks 200, when stacked on top of the first block 200. For example, lugs 220, 222 can be provided with a corner bevel B1 defined by angled or rounded surfaces on the back and side of each lug 220, 222, as shown in FIG. 6A-6D, as adapted for engagement of with one or more rear surface 235 and side surfaces 237, 239 of the openings 230 in adjacent (upper-course) blocks 200, when stacked on top of or overlaying the first (lower-course) block 200.

In some examples, a pair of symmetrical lugs 220, 222 can be provided, for example as reflected about the block centerline CL. Furthermore, the pair of lugs 220, 222 can be flush with the rear surface 235 of the opening 230 or offset along the respective block sidewall 216, 218. This configuration can provide a staggered incline with a selected setback distance (SB) and setback angle (SA) between blocks 200; e.g., when blocks 200 are assembled into successive courses 260, 262 of a wall system 250 according to FIGS. 7A and 7D.

The lug connections can be formed via engagement of a pair of lugs 220, 222 formed on the top surface 204 of block 200, as installed on a lower course or layer, with the rear surface 235 of the openings 230 in one or more blocks 200 on an upper course. In some examples, the horizontal alignment of blocks 200 between courses can be offset so that one lug from a block 200 on the lower course can interface with the rear surface of the opening of a first block 200 on the upper course, and a second lug from the same block 200 on the lower course can interface with the rear surface 235 of the opening 230 of a second block 200, adjacent the first block along the upper course.

Conversely, the lugs 220, 222 on adjacent blocks in a lower course 260 can be engaged within the opening 230 in a single upper course block 200, when the upper-course block 200 is staggered over the adjacent lower-course blocks 200. Depending on application, the upper and lower surface of the blocks can also be interchanged, along with the upper and lower designations of the courses 260 262, and lugs 220, 222 can be adapted for engagement along either the front or rear surfaces of the corresponding cavities 230, as further described herein.

Figure 7B:
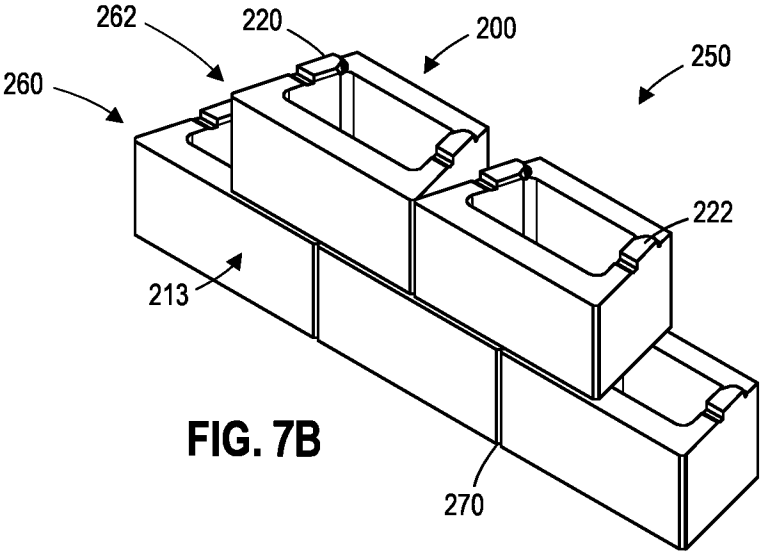
FIGS. 7A-7D are top plan, isometric, front elevation and side elevation views of a segmented wall system assembled from a number of blocks according to FIGS. 6A-6D.
Figure 7D:
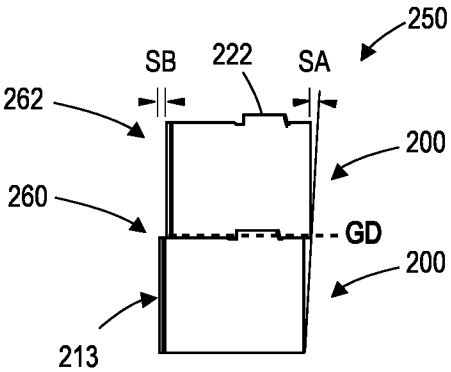
Figure 7A:
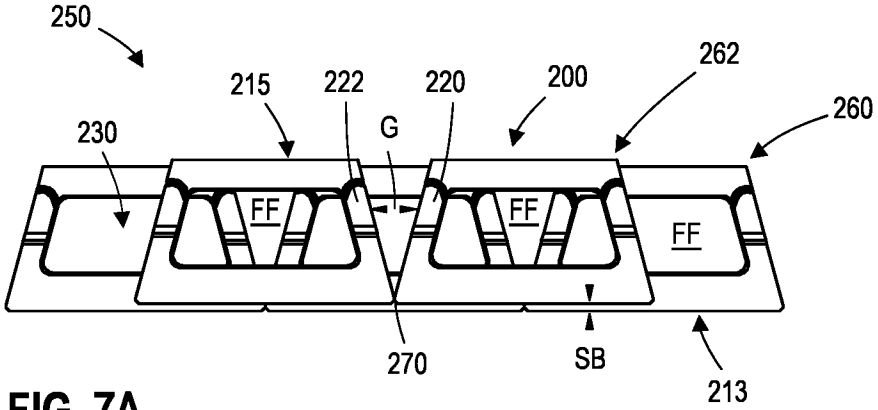
Figure 7C:
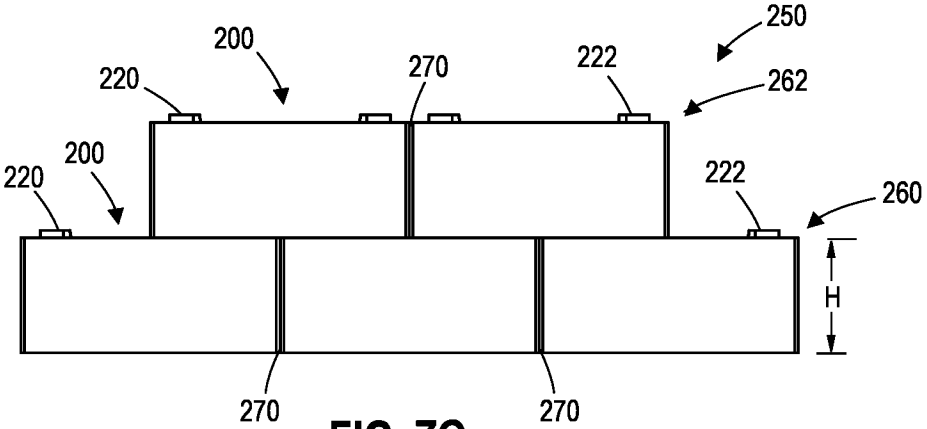

FIG. 7A is a top plan view of a segmented wall system 250, formed with a number of blocks 200 according to FIGS. 6A-6D. FIG. 7B is an isometric view of the wall system 250, and FIGS. 7C and 7D are front and side elevation views, respectively.

Figure 8B:
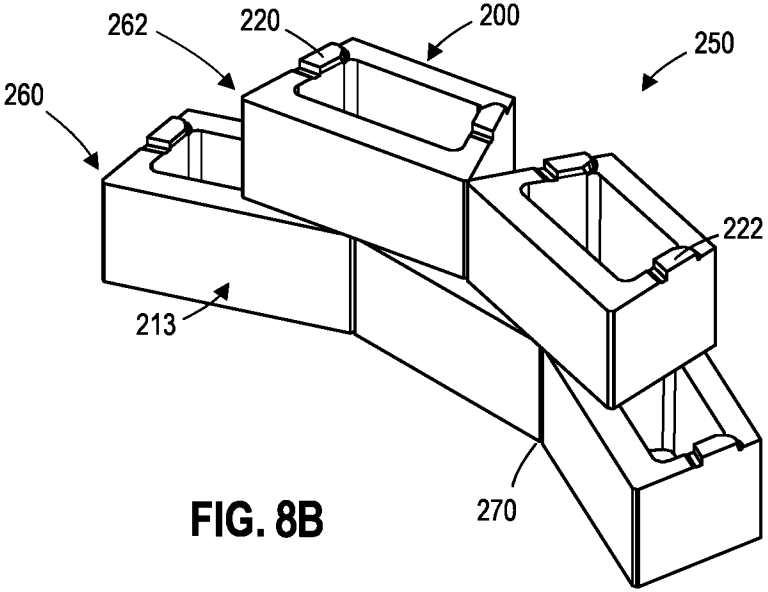
FIGS. 8A-8D are top plan, isometric, front elevation and side elevation views of the segmented wall system, in a curved wall application.
Figure 8D:
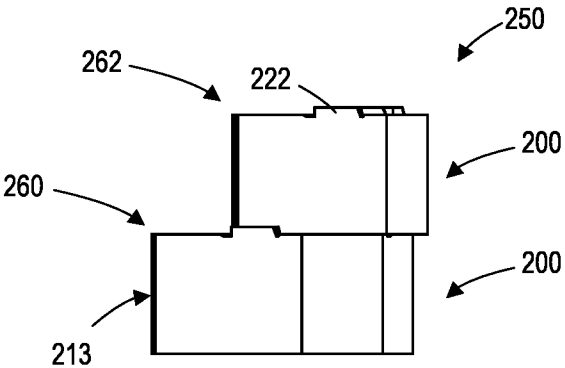
Figure 8A:
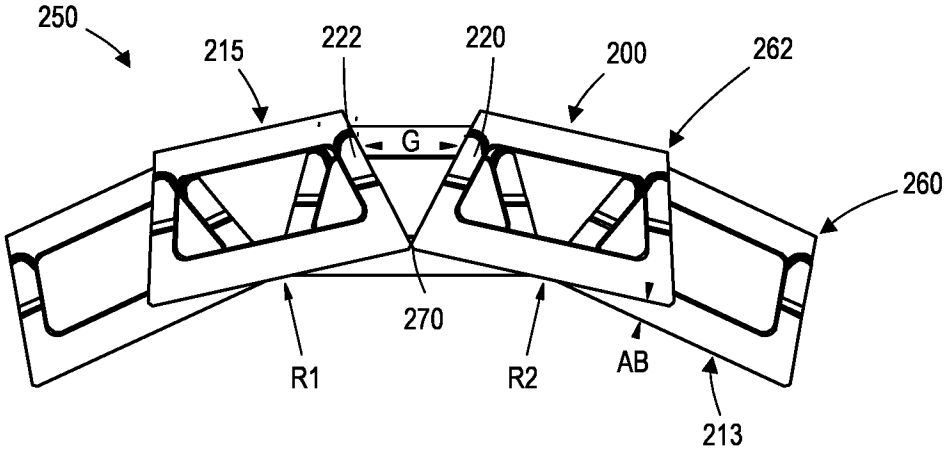
Figure 8C:
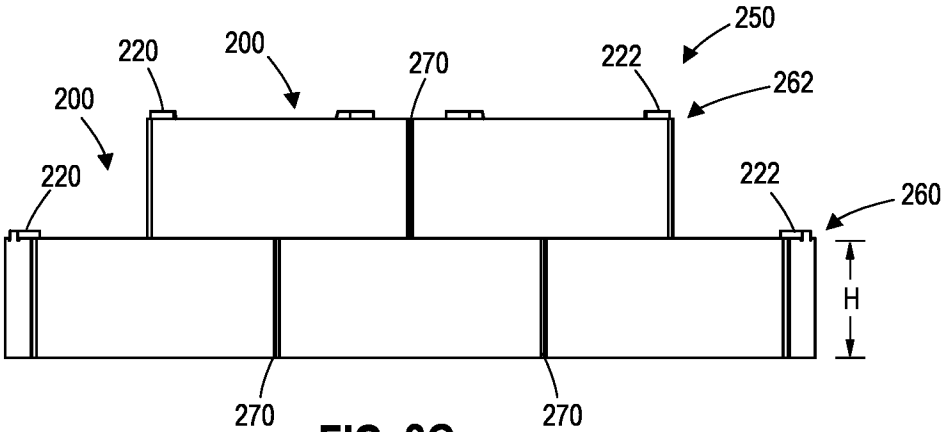

FIG. 8A is a top plan view of the segmented wall system 250, in a curved wall application. FIG. 8B is an isometric view of the wall system 250, and FIGS. 8C and 8D are front and side elevation views, respectively.

Figure 9B:
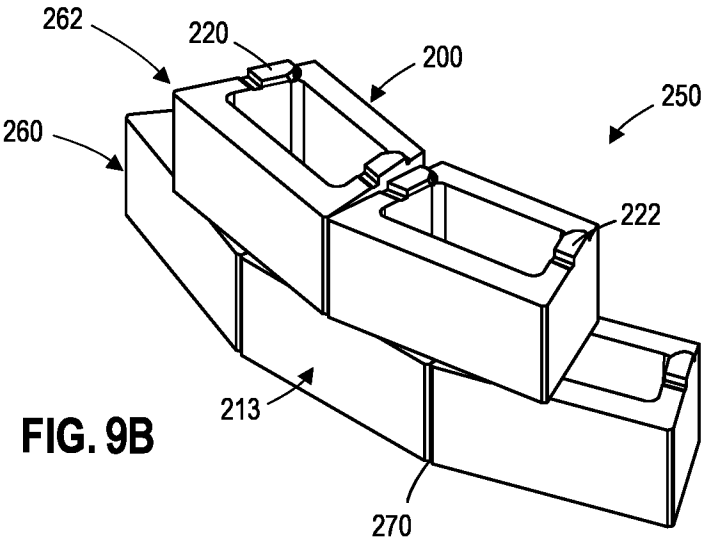
FIGS. 9A-9D are top plan, isometric, front elevation and side elevation views of the segmented wall system, with different curvature.
Figure 9D:
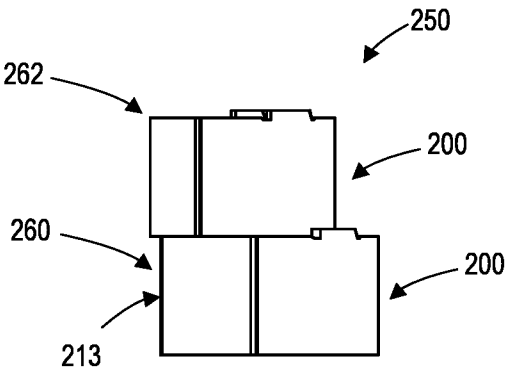
Figure 9A:
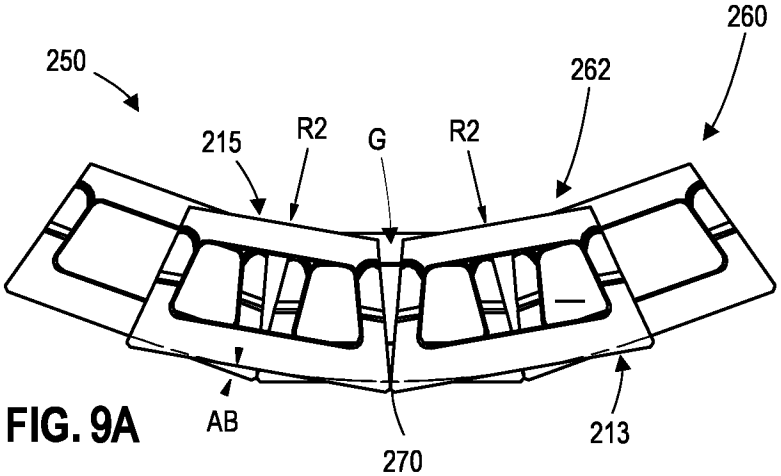
Figure 9C:
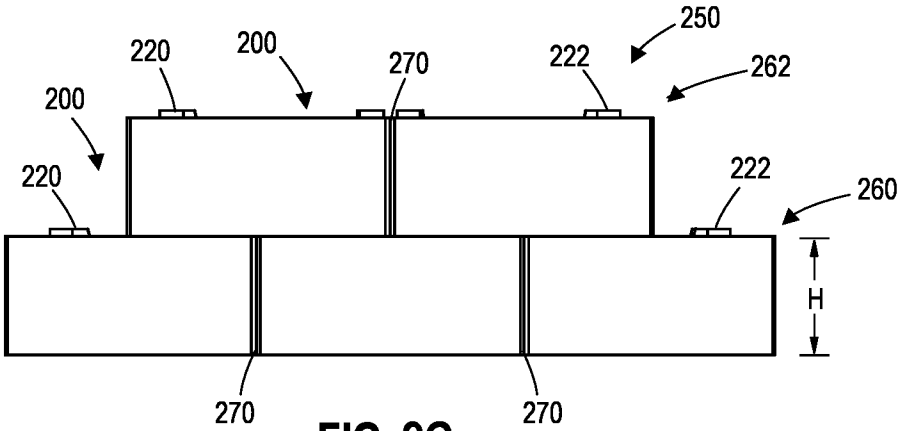

FIG. 9A is a top plan view of the segmented wall system 250 with different curvature. FIG. 9B is an isometric view of the wall system 250, and FIGS. 9C and 9D are front and side elevation views, respectively.

FIGS. 7A-7D, 8A-8D and 9A-9D depict segmented wall systems 250 with various arrangements of blocks 200. Suitable wall systems 250 can also be formed using any number of blocks 200. While FIGS. 6A-6D may identify detailed elements and features using figure references and symbols, moreover, the references are not necessarily repeated for every instance of block 200 and wall system 250, for example where multiple common elements appear in the same or related drawings, or to improve clarity when illustrating other relevant features, as described herein, and as understood in the art.

As shown in FIGS. 7A-7D, 8A-8D and 9A-9D, different courses or layers 260, 262 of segmented wall system 250 can be formed from any number of blocks 200. The blocks can be arranged to provide sections of wall 250 system with linear or nonlinear geometry, straight segments, corners, convex or concave curvature, or any combination thereof.

In FIGS. 7A-7D, for example, a straight or linear segmented wall structure 250 is shown with first and second (e.g., lower and upper) courses 260, 262, each formed from a number of blocks 200. The blocks 200 about along a series of vertical interfaces 270 that bisect the adjacent front faces 213, as further illustrated in FIGS. 8B, 8C, 9B and 9C.

In some examples, the geometry of wall system 250 can accommodate the engagement of lugs 220, 222 on one block 200 in the lower (or bottom) course 260 with the rear surfaces 235 of openings 230 in two adjacent blocks 200 in the upper course 262. The interfaces 270 can thus be staggered, with each upper-course block 200 overlaying a different portion of respective the lower block 200, and the interface 270 between adjacent blocks 200 in the upper course 262 approximately bisecting the corresponding block 200 in lower course 260, as shown in FIG. 7C.

Lugs 220, 222 add stability to the segmented wall system 250 by providing additional coupling between adjacent courses 260, 262, as described above for wall system 150. Similarly, the openings 230 in blocks 200 can be packed with a fill material (FF), for example as shown in FIG. 7A, and a geogrid or reinforcing material (GD) can be disposed between adjacent courses 260, 262, for example as shown in FIG. 7D.

FIGS. 8A-8D show portions of a curved (e.g., concave) segmented wall system 250, with two courses 260, 262 formed of blocks 200 arranged along the inside radii of curvature R1 and R2. The curvature can be uniform (R1=R2) or variable (R1≠R2), with maximum block wall angle (AB) defined according to the gap distance (G) between lugs 220, 222 on adjacent blocks 200 in the lower course 260, so that the lugs 220, 222 fit inside the same opening 230 of the same block 200 in the upper course 262, as illustrated in FIG. 8A, as described above for wall system 150.

FIGS. 9A-9D depict portions of a curved (e.g., convex) segmented wall system 250 with two adjacent courses 260, 262 extending along a curved geometry defined by outside radii of curvature R1, R2. The courses 260, 262 can include any number of blocks 200. The curvature can be uniform (R1=R2) or variable (R1≠R2), each section having a respective radius R1, R2 and corresponding block wall angle (AB), with maximum curvature as the gap G between the outside edges of lugs 220, 222 in adjacent blocks 200 decreases to zero, as illustrated in FIG. 9A.

The segmented wall systems 250 in FIGS. 7A-7D, 8A-8D and 9A-9D are exemplary. While wall systems 250 may be shown with first and second courses 260, 262, suitable wall systems 250 can include any number of courses. Similarly, segmented wall systems 250 can include any number of blocks 200 each course or layer 260, 262, whether fewer or more than depicted. Wall systems 250 can also be assembled from any combination of landscaping blocks, tail units and corner blocks described herein, in any suitable geometry.

FIGS. 10A-10C are top left isometric, top plan, and top right isometric views of a landscaping block 200, e.g. as shown in FIGS. 6A-6D, illustrating the overall block design. FIGS. 10D-10G are left, front, right, and rear elevation views of block 200, and FIGS. 10H-10J are bottom left isometric, bottom plan, and bottom right isometric views, respectively.

Base and Tail Unit Applications

FIGS. 11A-11D are top plan, isometric, front elevation and side elevation views of a landscaping block or base unit 300 for a segmented wall system, with a tail unit or tail block coupling 380 formed on the back portion 314. The block coupling 380 can be used to couple base block 300 with a tail block or tail unit 400, for example as shown in any of FIGS. 12A-12D, 13A-13D, 14A-14D, 15A-15D, 16A-16D, and 17A-17D.

FIGS. 11A-11D show a base block 300 with inter-block engagement processes (or lugs) 320, 322 extending from the top surface 304 of block sidewalls 316, 318, for example a pair of lugs 320, 322 with common process height (P). In these examples, block 300 is formed of a front wall portion 312 defining the front face 313, and a back portion 314, substantially opposite front face 313. Block sidewalls ("leg" or "neck" portions) 316, 318 extend transversely between front and back portions 312, 314.

Blocks 300 can also include one or more apertures, cavities or openings 330, for example disposed about the center of gravity CG and defined between the front wall 312, defining the front surface 333 of opening 330, and the back portion 314, defining the rear surface 335. Block sidewalls 316, 318 extend between the front and back portions 312, 314, with inner surfaces defining the corresponding inside surfaces 337, 339 of opening 330, on the opposing sides (e.g., left and right) of block 300.

One or more grooves or channel features 325, 326 can be formed in either or both block sidewalls 316, 318 during the manufacturing process; e.g., adjacent lugs 320, 322 (channel 325), or spaced from lugs 320, 322 along top surface 304 (channel 326). As shown in FIG. 11B, for example, channels 325, 326 may extend transversely across each sidewall portion 316, 318, from the central opening 330 to the exterior of block 300. A groove or channel 327 can also be formed in the bottom surface 306 of block 300, for example as shown in FIG. 11D.

The outer surfaces of block sidewalls 316, 318 define the exterior surfaces of block 300. The top and bottom surfaces 304, 306 of each block 300 can be provided with complementary flat or contoured surfaces to facilitate stacking, as described herein.

Suitable base blocks 300 can also include a block coupling 380 adapted for coupling to a tail unit 400 when installed in a segmented wall system. For example, one or more blocks 300 can be connected to tail units 400 using a vertical dovetail block coupling 380 extending from the back portion 314 of block 300. In these examples, block coupling 380 extends between the top and bottom surfaces 304, 306 on the back portion 314 of block 300, opposite the front face 313 as shown in FIGS. 11A and 11B.

In order to connect the courses of blocks 300 together when installed in a segmented wall system, each block 300 can include one or more engagement lugs 320, 322; e.g., a pair of lugs 320, 322 extending from the top surface 304 of block 300 at a common process height (P). The lugs 320, 322 can be horizontally-aligned with the rear surface 335 of opening 330, positioned on the block sidewalls 316, 318 adjacent the back portion 314, or where the back portion 314 meets the block sidewalls 316, 318.

Lugs 320, 322 can be configured to interface with the rear surface 335 of the openings 330 of one or more upper-course blocks 300, stacked on top of the adjacent lower-course blocks 300. Lugs 320, 322 can also be aligned with the rear surface 335 of the opening 330, or offset from the rear surface 335 along the respective block sidewall 316, 318. For example, the offset can be selected to produce a staggered incline with a selected setback distance (SB) between successive courses of blocks 300, extending at a corresponding setback angle (SA) when assembled into a wall system 350 according to FIG. 13D.

In some examples, lugs 320, 322 are symmetrical; e.g., as reflected about the common centerline CL of block 300. The rear-facing portions of lugs 320, 322 can be shaped to conform to the corner surface of openings 330 in the upper-course blocks 300, when overlaying one or more lower-course blocks. Lugs 320, 322 can also be provided with a beveled, contoured or rounded shape adapted to interface with the corner geometry defined by the rear surface 335 and adjacent side surfaces 337, 339 of the opening 330 in the upper-course blocks 330.

The lug connections can be formed via contact between the pair of lugs 320, 322 formed on the (as-installed) top surface 304 of block 300 on a lower course or layer with the rear surface 335 of the opening 330 in one or more blocks 300 of an upper course. In some examples, the horizontal alignment of blocks 300 can be offset in successive courses so that one lug 320 on a block 300 in the lower course engages the opening 330 of a first block 300 in the upper course, and a second lug on the same block 300 in the lower course engages the opening 330 of a second block 300, adjacent the first block 300 in the upper course.

Conversely, the lugs 320, 322 on adjacent blocks 300 in the lower course can engage the same opening 330 of the same block 300 in the upper course. This cross-coupling further improves the structural stability of the assembled wall system 350, as described herein.

Figure 12B:
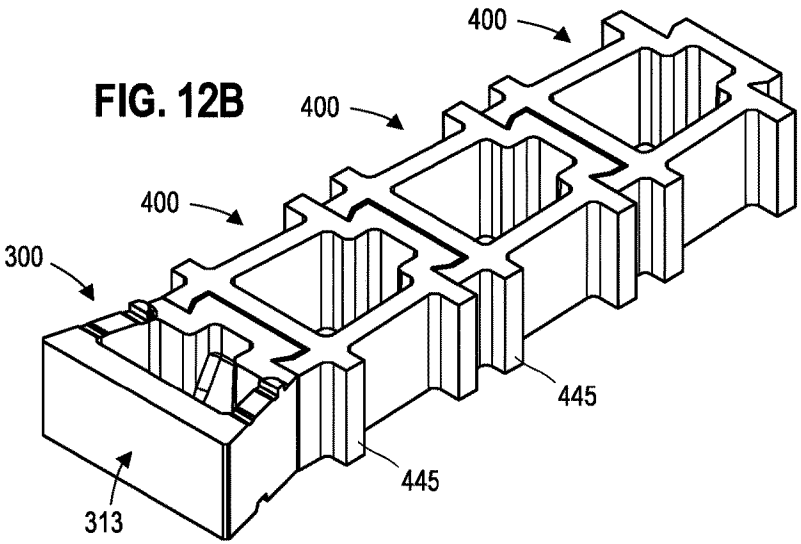
FIGS. 12A-12D are top plan, isometric, front elevation and side elevation views of the base block in FIGS. 11A-11D, coupled to one or more tail units.
Figure 12D:
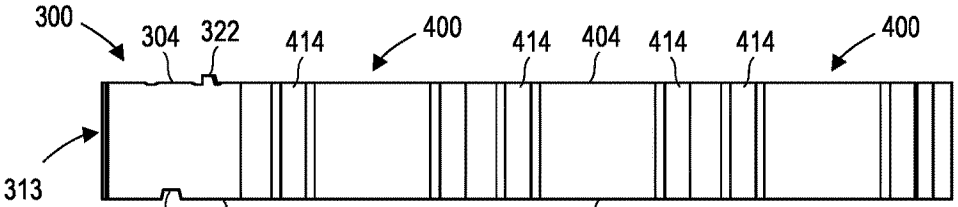
Figure 12A:
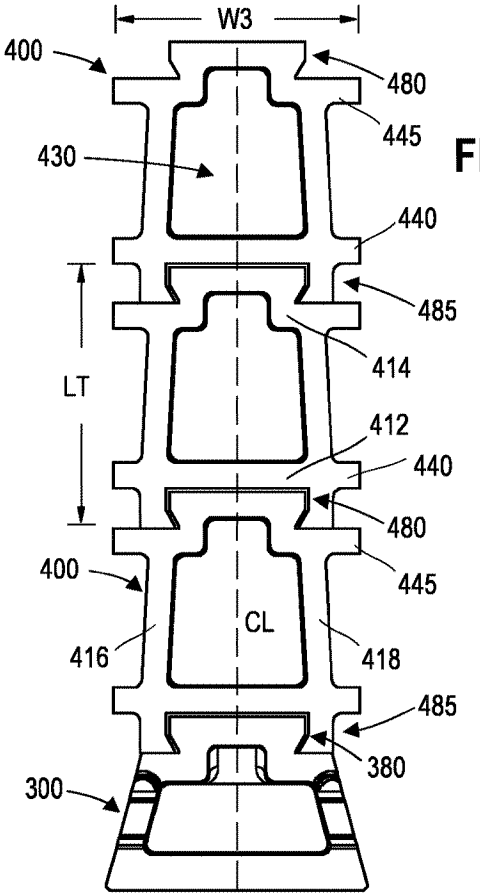
Figure 12C:
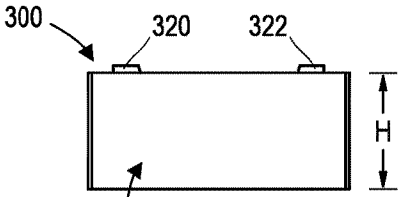

FIG. 12A is a top plan view of a base unit or block 300 according to FIGS. 11A-11D, coupled to one or more tail units 400. FIG. 12B is an isometric view of the landscape and tail units 300, 400, and FIGS. 12C and 12D are front and side elevation views, respectively.

FIGS. 12A-12D depict various perspective views of a base unit or block 300 connected to a tail unit 400 at a coupling 380 on the back portion 314 of block 300, and one or more additional tail units 400 connected at additional couplings 480 on the back of each tail unit 400. A complementary coupling 485 can be provided at the front end of tail unit 400, which is adapted to engage the coupling 380 on the back end of the block 300, or to a similar coupling 480 on the back end of another tail unit 400.

For example, tail unit 400 can include a front portion 412 defining a first (front) end having a complementary coupling 485, which is configured to couple to a dovetail coupling 380 on the back end of the block 300, extending along a common centerline CL. Similarly, the rear wall or back portion 414 of tail unit 400 can define a second opposing (back) end, with a coupling 480 similar to the corresponding (e.g., dovetail) coupling 380 on base block 300.

Base blocks 300 and tail units 400 can be made of a rugged, weather resistant material, including precast concrete (e.g., dry cast or wet cast), composite and polymer materials, reinforced fibers, wood, metal, stone, and combinations thereof. The front portion 412 and back portion 414 of tail unit 400 can be connected by one or more (e.g., left and right) sidewalls 416, 418. The front face 313 of block 300 can be provided with texturing or other surface features TX; e.g., as indicated in FIG. 11C. More generally, any of the exterior surfaces of blocks 300 and 400 can be textured, untextured, finished, unfinished, smooth, contoured, or flat, or provided with a hard split or straight split facing.

The front portion 412 and back portion 414 of tail unit 400 can also include lateral extensions or "wings" 440, 445; e.g., as configured to couple with similar structures on tail units 400 in adjacent layers or courses. For example, tail units 400 can be formed with two lateral sidewall portions 416, 418 that define an opening (aperture or cavity) 430 in the core region of tail unit 400, between the front portion 412 and the back portion 414, with wing portions 440, 445 extending laterally from one or both of the front and back portions 412, 414, respectively.

The outer surfaces of the sidewalls 416, 418 can define the exterior sides of tail unit 400. The top and bottom surfaces 404, 406 of tail unit 400 can be formed as a flat surfaces to facilitate stacking of similar tail units 400 on top of one another, or the top and bottom surfaces 404, 406 can be formed with complementary, contoured surfaces.

Base blocks 300 can each have a first uniform size and shape, and the tail units 400 can each have a second uniform size and shape that is different from that of the blocks 300. In typical examples, base blocks 300 and tail units 400 may have the same vertical height H, as installed in wall system.

The width W3 of tail unit 400 can be the same or similar to that of the base block 300 in order to facilitate coupling of the wing portions 440, 445, or the width W3 of tail unit 400 may be less than that of the block 300. Similarly, the length LT of tail unit 400 can be greater than the face-to-face depth D of base blocks 300, or the length LT of tail unit 400 may be the same or less than the base block depth D.

In some examples, the opposing sidewalls 416, 418 of the tail unit 400 can have a non-parallel relationship defining a block side angle from the front portion to the rear portion; e.g., where the distance between opposing sidewalls 416, 418 is greater toward the front portion 412 of tail unit 400, and less toward the back portion 424. In some examples, the opposing sidewalls 416, 418 may merge together at or near the back end tail unit 400, defining the back portion 424 at the intersection thereof.

The front portion of tail unit 400 can be provided with a complementary coupling 485, which is adapted to engage either the block coupling 380 on base block 300 or a similar coupling 480 on the back of another tail unit 400. For example, the couplings 380, 480 can be configured as female dovetail structures extending from the back portion 314 of block 300 and the back of tail unit 400, respectively, each of which is adapted to engage the complementary (e.g., male dovetail) coupling 485 on the front of tail unit 400.

The complementary coupling 485 can thus be configured to couple the front end of a tail unit 400 to either the back end of a base block 300, or another tail unit 400. The complementary coupling 485 can extend for substantially the entire height of the respective block 300, 400, or the coupling 485 may be reduced in height for structural or assembly purposes.

In particular examples, block coupling 380 is configured as a male dovetail structure extending over more than half of the width W1 of the back portion 314 of the block 300. While FIGS. 11A-11D encompass such a dovetail connection, however, other types of couplings 380, 480 and complementary couplings 485 can be used, including, but not limited to, rounded connections and slotted connections; e.g., where a projecting element on coupling 380, 480 slides into or engages a complementary receiving structure on coupling 485, or vice-versa.

Figure 13B:
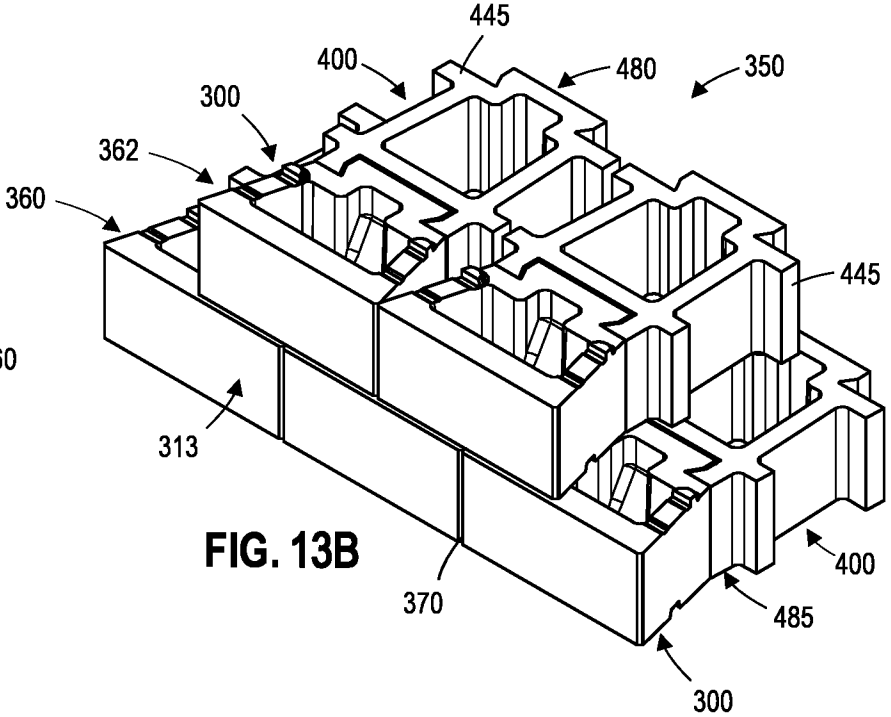
FIGS. 13A-13D are top plan, isometric, front elevation and side elevation views of a segmented wall system assembled from base blocks and tail units according to FIGS. 12A-12D.
Figure 13A:
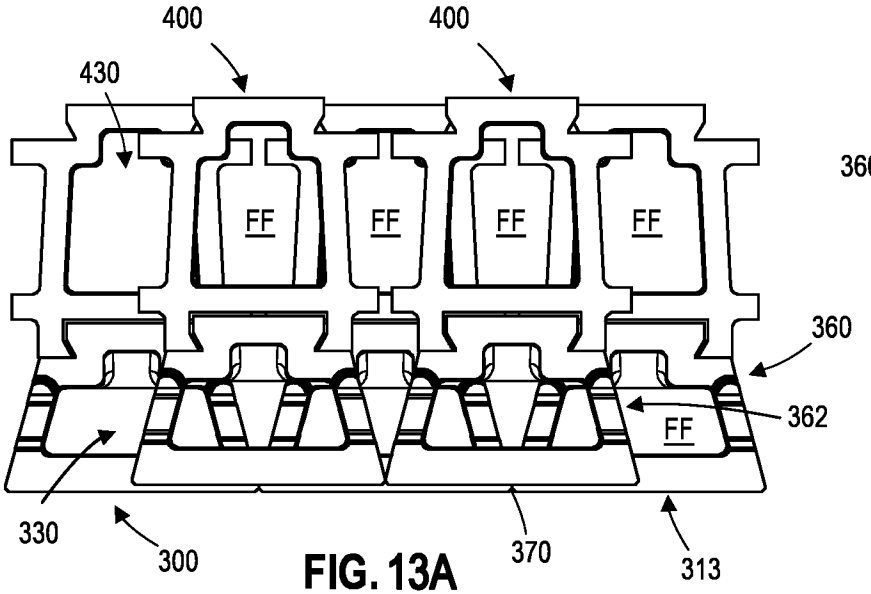
Figure 13D:
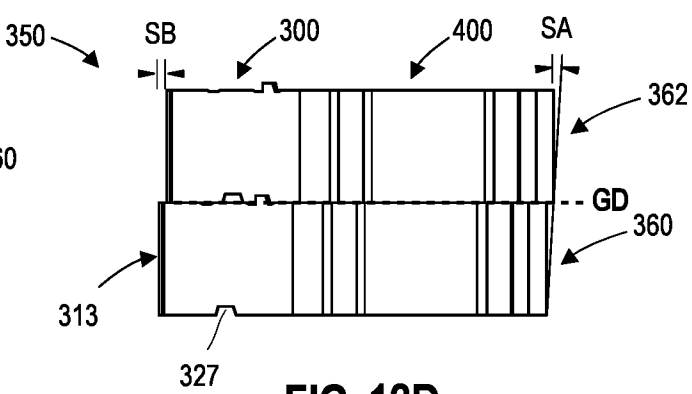
Figure 13C:
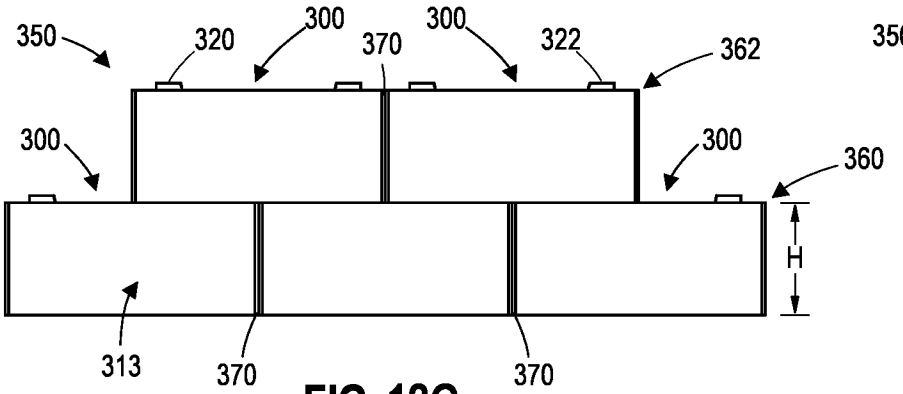

FIG. 13A is a top plan view of a segmented wall system 350, assembled from a number of base units or blocks 300 coupled to tail units 400 according to FIGS. 12A-12D. FIG. 13B is an isometric view of the wall system 350, and FIGS. 13C and 13D are front and side elevation views, respectively. A fill material (FF) can also be provided in the openings 330, 430 of one or more of the blocks 300, 400, and a geogrid material (GD) can be installed between courses 360, 362, for example to strengthen the assembled wall system 350, and to improve drainage.

FIGS. 14A-14D are top plan, isometric, front elevation and side elevation views of the segmented wall system, in a curved wall application.

Figure 14A:
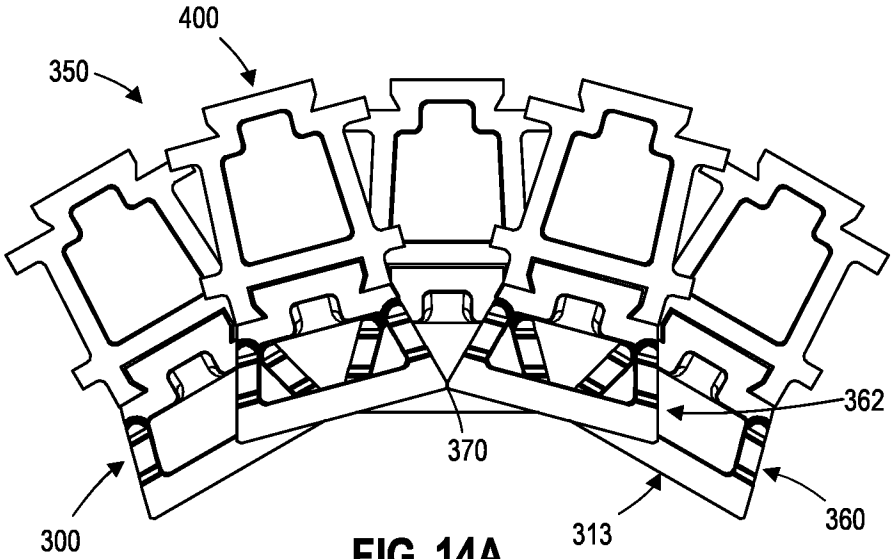
FIGS. 14A-14D are top plan, isometric, front elevation and side elevation views of the segmented wall system, in a curved wall application.
Figure 14B:
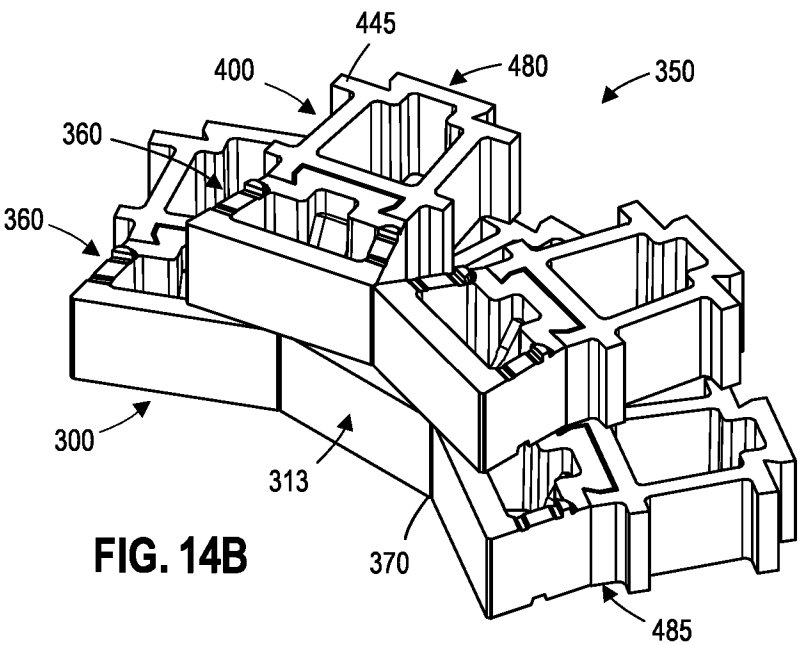
Figure 14C:
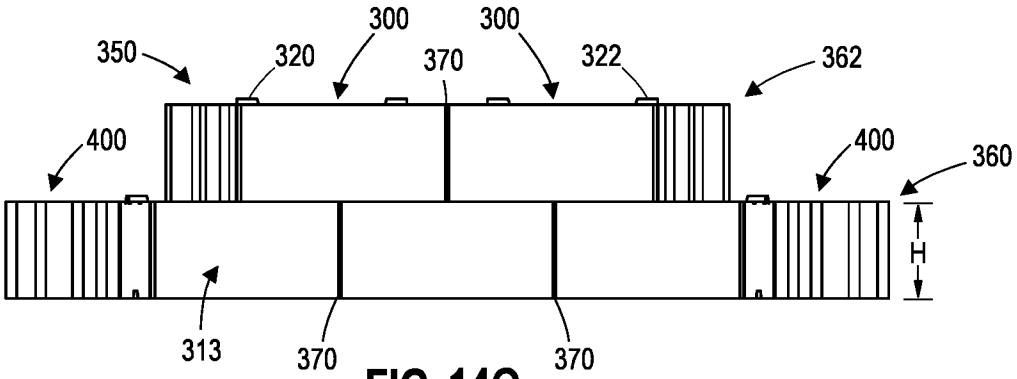
Figure 14D:
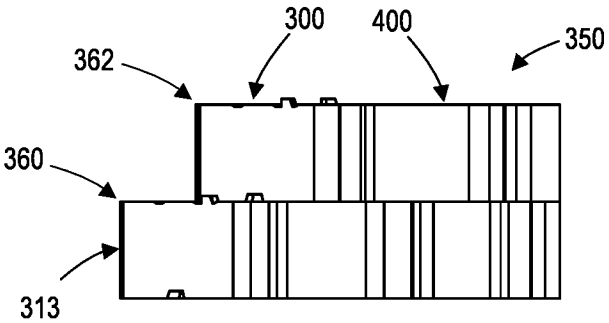

FIG. 14A is a top plan view of segmented wall system 350, in a curved wall application. FIG. 14B is an isometric view of the wall system 350, and FIGS. 14C and 14D are front and side elevation views, respectively.

FIGS. 15A-15D are top plan, isometric, front elevation and side elevation views of the segmented wall system, with different curvature.

Figure 15B:
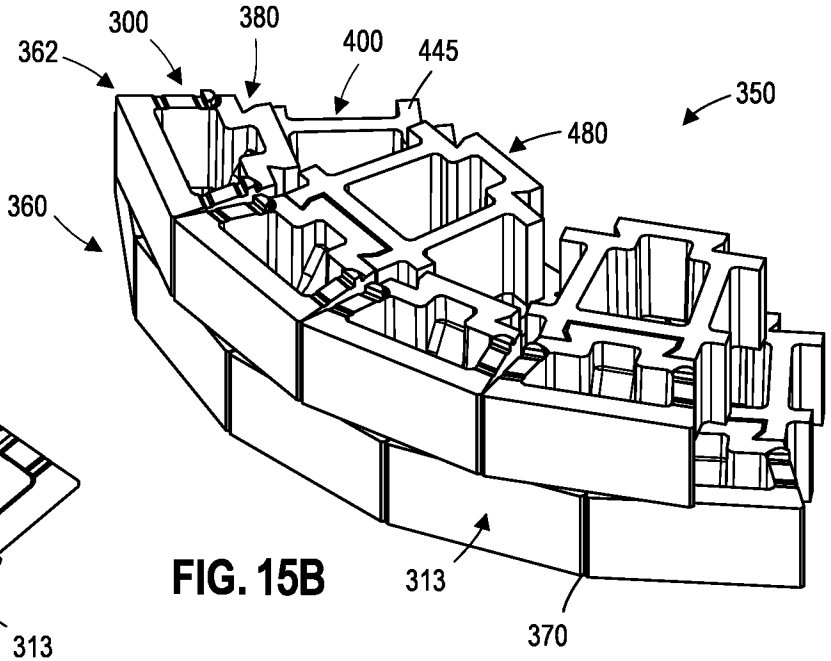
FIGS. 15A-15D are top plan, isometric, front elevation and side elevation views of the segmented wall system, with different curvature.
Figure 15D:
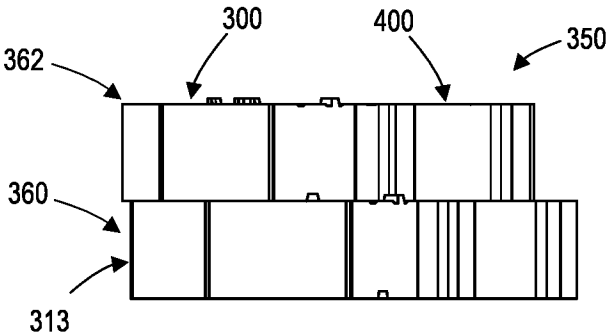
Figure 15A:
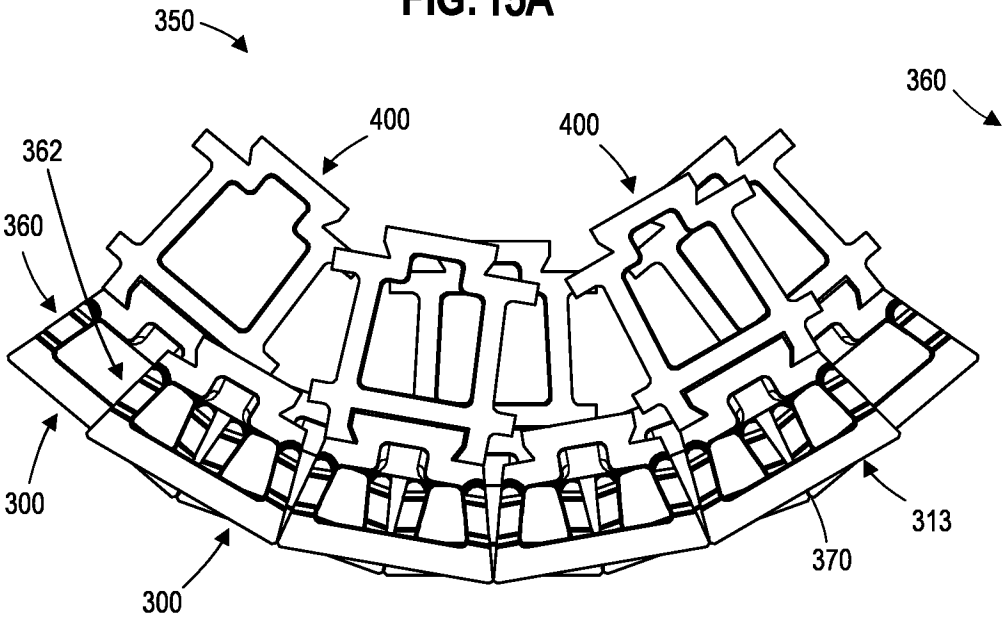
Figure 15C:
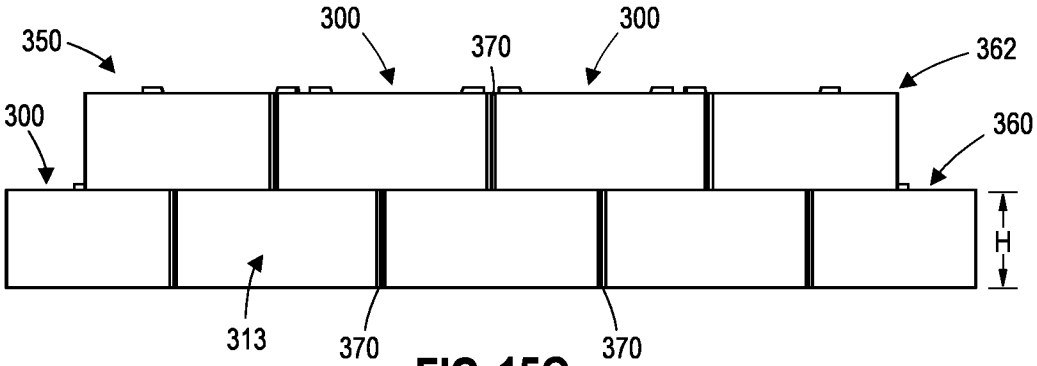

FIG. 15A is a top plan view of segmented wall system 350, with different curvature. FIG. 15B is an isometric view of the wall system 350, and FIGS. 15C and 15D are front and side elevation views, respectively.

FIG. 16A is a top plan view of segmented wall system 350, with a number of corner blocks 450 forming an outside corner. FIG. 16B is an isometric view of the wall system 350, and FIGS. 16C and 16D are front and side elevation views, respectively.

Figure 17B:
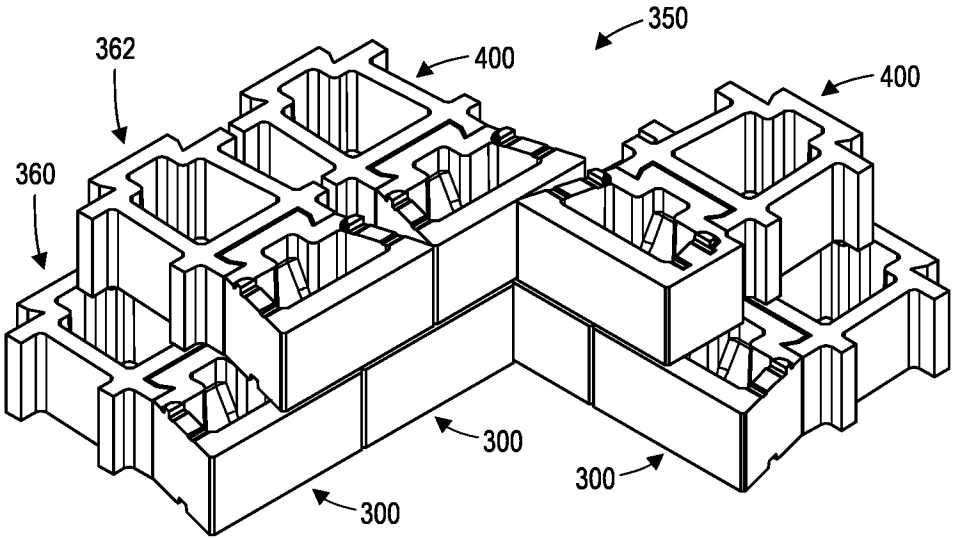
FIGS. 17A-17D are top plan, isometric, front elevation and side elevation views of the segmented wall system, forming an inside corner.
Figure 17D:
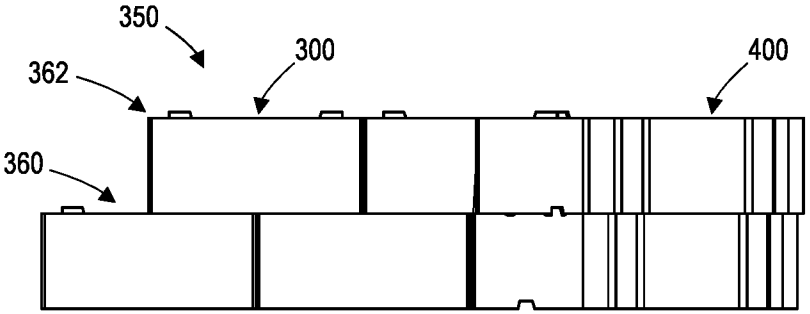
Figure 17A:
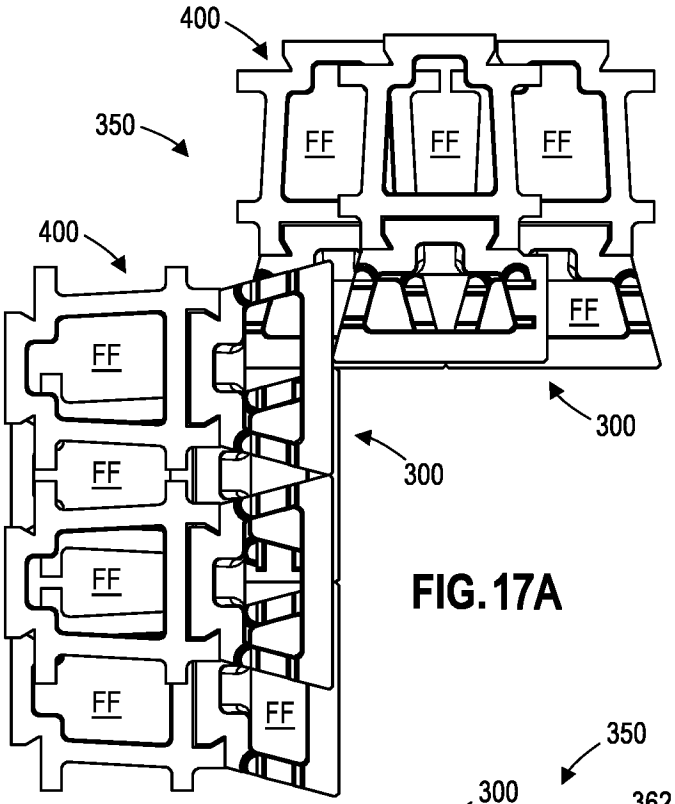
Figure 17C:
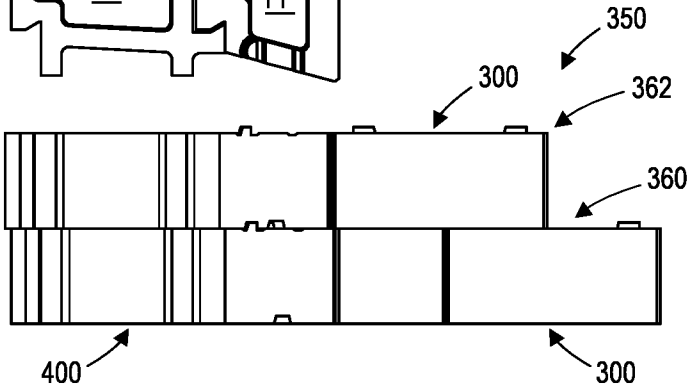

FIG. 17A is a top plan view of segmented wall system 350, forming an inside corner. FIG. 17B is an isometric view of the wall system 350, and FIGS. 17C and 17D are front and side elevation views, respectively.

FIGS. 13A-13D, 14A-14D, 15A-15D, 16A-16D and 17A-17D depict wall systems 350 with various arrangements of base units or blocks 300 and tail units 400. Suitable wall systems 350 can also be formed using any number or combination of blocks 300 and 400. While FIGS. 11A-11D and 12A-12D may identify detailed elements and features using figure references and symbols, moreover, the references are not necessarily repeated for every instance of blocks 300, 400 and wall system 350, for example where multiple common elements appear in the same or related drawings, or to improve clarity when illustrating other relevant features, as described herein, and as readily understood in the art.

As shown in FIGS. 13A-13D, 14A-14D, 15A-15D, 16A-16D and 17A-17D, different courses or layers 360, 362 of a segmented wall system 350 can be formed from any number of base blocks 300, tail units or tail blocks 400, and corner blocks 450. The blocks can be arranged to provide sections of wall system 350 with linear and non-linear geometry, straight segments, corners, convex or concave curvature, or any combination thereof.

In FIGS. 13A-13D, for example, a straight or linear segmented wall system 350 is shown with two (e.g., lower and upper) courses 360, 362, each formed from a number of base blocks 300 and tail units 400. Adjacent blocks 300 abut along interfaces 370, as defined between the corresponding front faces 313, for example a vertical interface 370 bisecting the respective planes of the front faces 313 as described above for wall systems 150 and 250, and as further illustrated in FIGS. 13A, 14B and 15B.

In wall system 350, one or more tail units 400 can be installed behind some or all of the base blocks 300. The geometry of wall system 350 can still accommodate the engagement of pairs of lugs 320, 322 on a block 300 in lower course 360 with the rear surfaces 335 of openings 330 in adjacent blocks 300 in upper course 362. The interfaces 370 between abutting blocks 300 can be offset or staggered in adjacent courses, similarly to wall systems 150 and 250, as described above, and as further illustrated in FIG. 13C.

FIGS. 14A-14D show sections of a curved (e.g., concave) segmented wall system 350, including lower and upper 360, 362 assembled from a combination of base blocks 300 and tail units 400. The curvature of wall system 350 can be uniform (inside radius R1=R2) or variable (R1≠R2). The maximum curvature can be defined by the corresponding block wall angle, as described herein, and according to the gap (G) between lugs 320, 322 on adjacent blocks 300 in the lower course 360, so that the lugs 320, 322 fit inside the same opening 330 of the same block 300 in the upper course 362, as described above for wall systems 150 and 250.

FIGS. 15A-15D show sections of a curved (e.g., convex) segmented wall system 350, including lower and upper courses 360, 362 formed of a combination of base blocks 300 and tail units 400. The curvature can be uniform (outside radius R1=R2) or variable (R1≠R2), with maximum defined by a corresponding block wall angle. Note that for convex curvature, it may not be possible to install tail units 400 behind every base block 300, depending on the available space between blocks.

FIGS. 16A-16D show an outside 90 degree corner section of a segmented wall system 350, including lower and upper courses 360, 362 assembled from a combination of base blocks 300, tail units 400 and corner blocks 450. For example, a stack of corner blocks 450 can be used to form the outside corner of the wall system 350, with base blocks 300 installed adjacent to the corner blocks 450, extending along each side.

In the corner region of wall system 350, some tail units 400 may be omitted as shown, depending on the space available between blocks. Outside the corner region, tail units 400 can be installed behind some or all of the base blocks 300, extending in either or both directions. The openings 350 in blocks 300 and 400 can also be packed with fill material (FF), for example as shown in FIG. 16A.

FIGS. 17A-17D show an inside 90 degree corner section of a segmented wall system 350, including lower and upper courses 360, 362 assembled from a combination of base blocks 300, tail units 400 and corner blocks 450. One or more tail units 400 can be installed behind some or all of the base blocks 300. The stacking of blocks 300 with coupling via lugs 320, 322 adds stability to the segmented wall system 350, by providing an interlocking structure between the adjacent courses 360, 362, as described above for wall systems 150 and 250.

The segmented wall systems 350 in FIGS. 13A-13D, 14A-14D, 15A-15D, 16A-16D and 17A-17D are exemplary. While wall systems 350 are shown with lower and upper courses 360, 362, for example, suitable wall systems 350 can include any number of courses. Segmented wall systems 350 can also include any number of base blocks 300 and tail units 400 in each course, whether fewer or more than depicted. Wall systems 350 can also be assembled from any combination of base blocks, landscaping blocks, tail units and corner blocks described herein, in any suitable geometry.

Figure 18C:
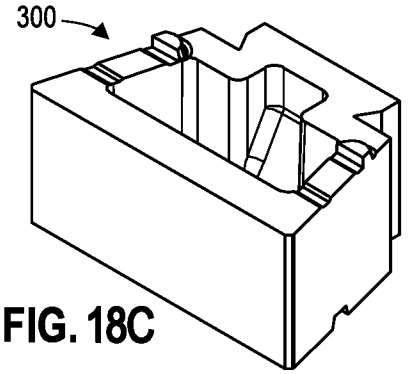
FIGS. 18A-18J are top left isometric, top plan, top right isometric, left elevation, front elevation, right elevation, rear elevation, bottom left isometric, bottom plan, and bottom right isometric views of the base block in FIGS. 11A-11D, illustrating the overall design.
Figure 18G:
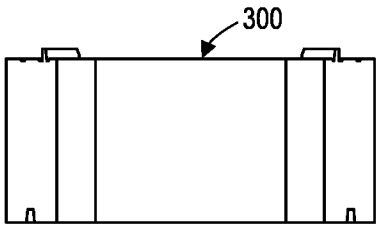
Figure 18J:
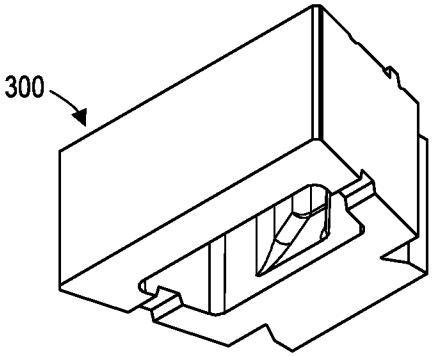
Figure 18F:
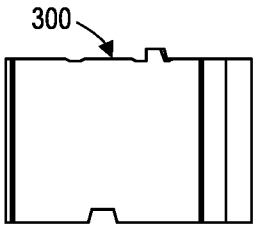
Figure 18B:
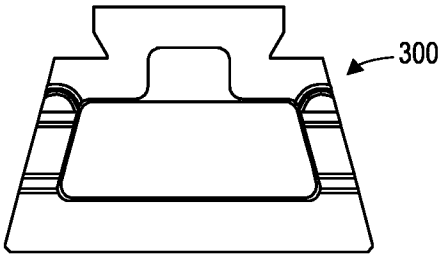
Figure 18E:
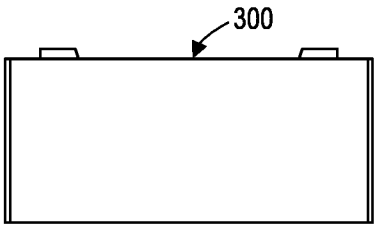
Figure 18I:
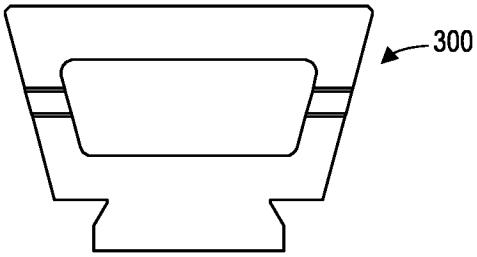
Figure 18A:
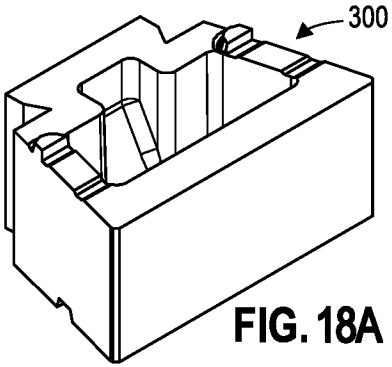
Figure 18D:
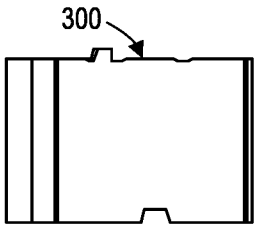
Figure 18H:
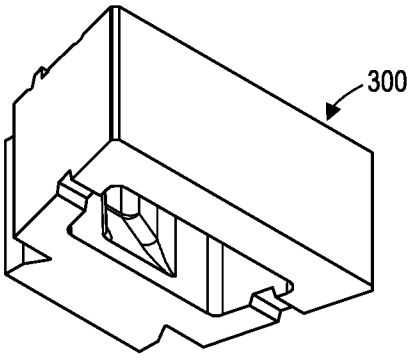

FIGS. 18A-18C are top left isometric, top plan, and top right isometric views of a base block or base unit 300, e.g. as shown in FIGS. 11A-11D, illustrating the overall block design. FIGS. 18D-18G are left, front, right, and rear elevation views of the block 300, and FIGS. 18H-18J are bottom left isometric, bottom plan, and bottom right isometric views, respectively.

Figures 19A, 19B, 19C, 19D, 19E, 19F, 19G, 19H, 19I, 19J:
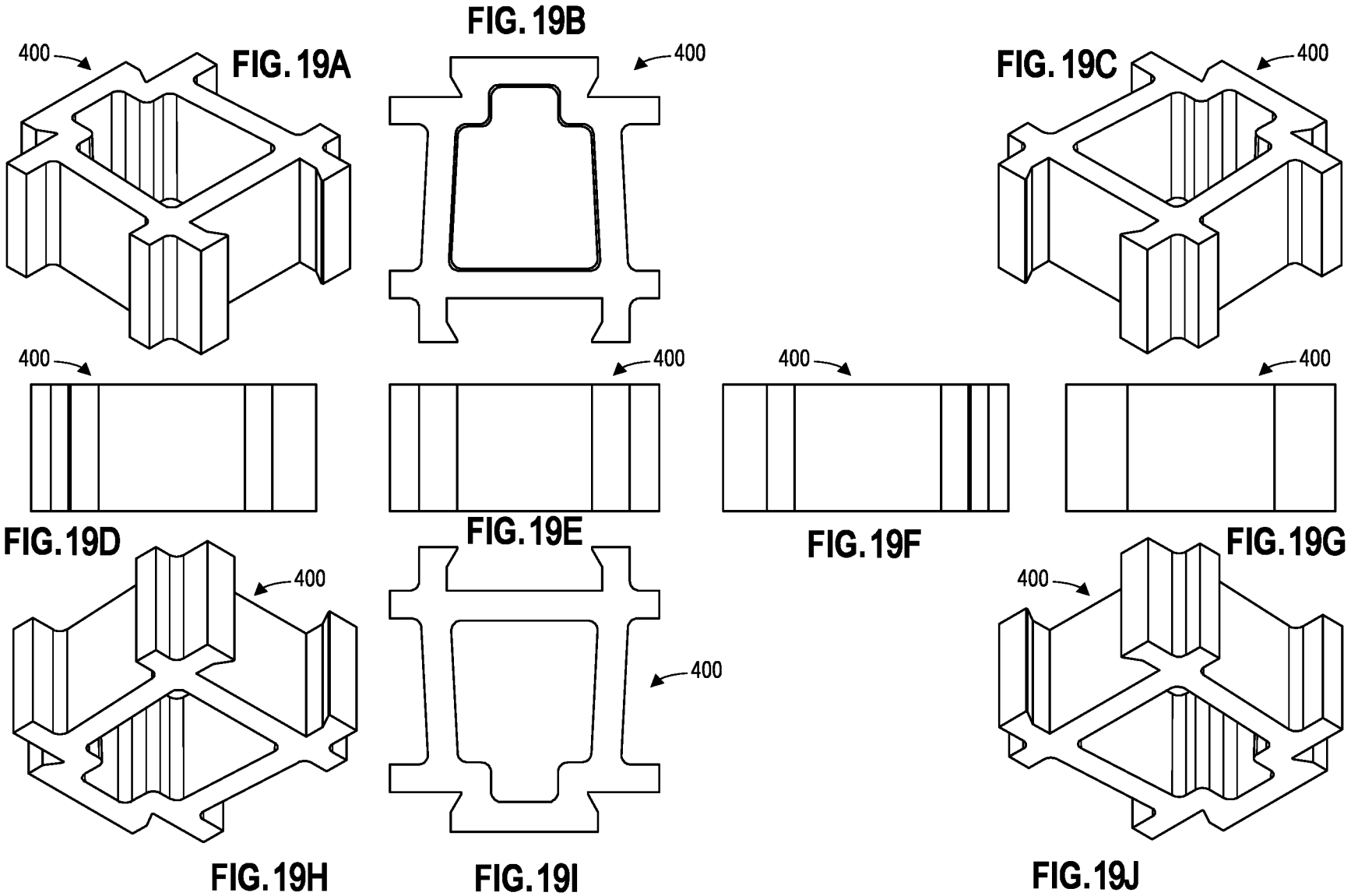
FIGS. 19A-19J are top left isometric, top plan, top right isometric, left elevation, front elevation, right elevation, rear elevation, bottom left isometric, bottom plan, and bottom right isometric views of the tail unit in FIGS. 12A-12D, illustrating the overall design.
Figure 21B:
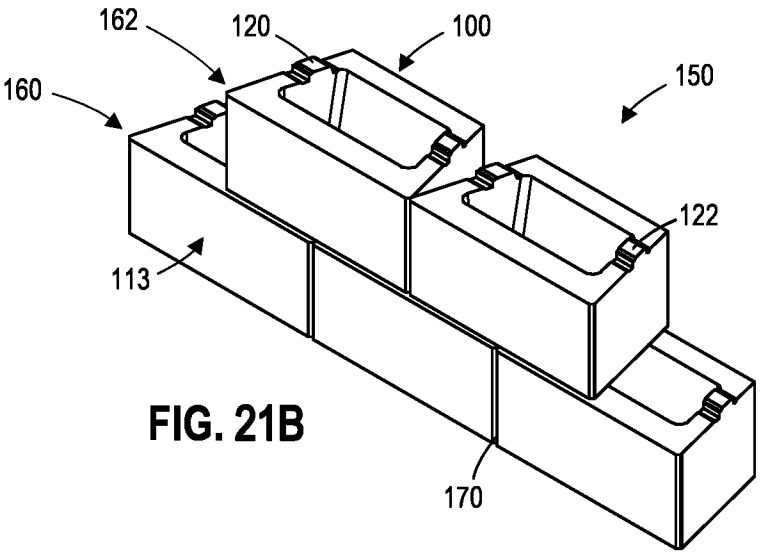
FIGS. 21A-21D are top plan, isometric, front elevation and side elevation views of a segmented wall system assembled from a number of blocks according to FIGS. 20A-20D.
Figure 21D:
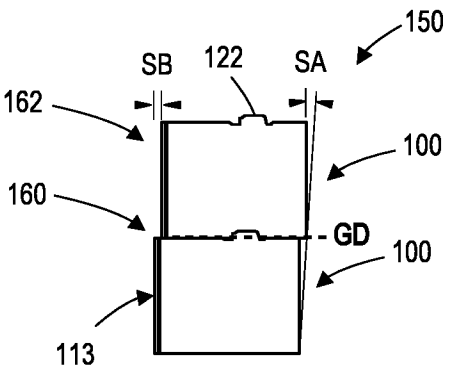
Figure 21A:
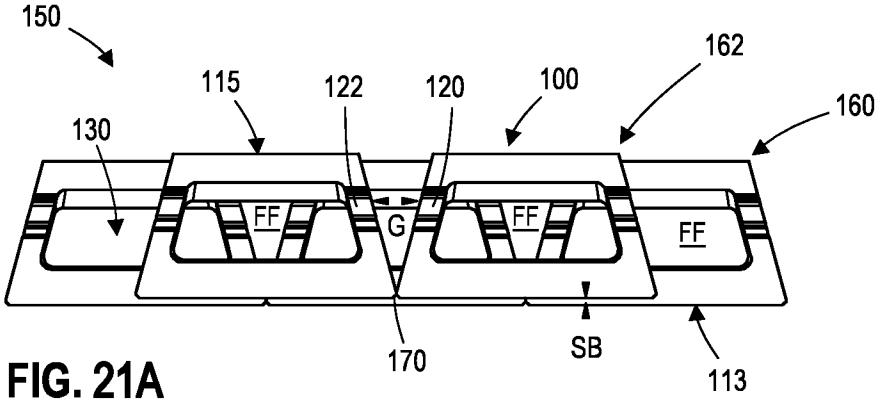
Figure 21C:
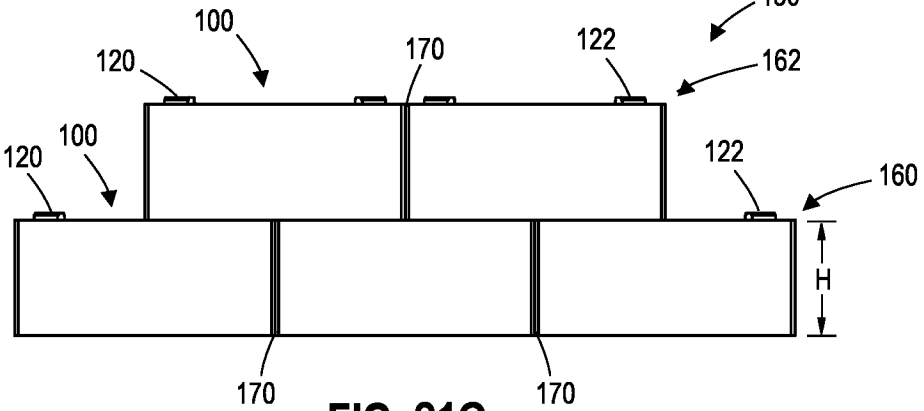

FIGS. 19A-19C are top left isometric, top plan, and top right isometric views of a tail unit 400 as shown in FIGS. 12A-102, illustrating the overall design. FIGS. 18D-18G are left, front, right, and rear elevation views of the tail unit 400, and FIGS. 18H-18J are bottom left isometric, bottom plan, and bottom right isometric views, respectively.

Additional Applications

FIGS. 20A-20D are top plan, isometric, front elevation and side elevation views of a landscaping block 100 for a segmented wall system, with parallel, beveled inter-block engagement processes (lugs) 120, 122. In these examples, engagement lugs 120, 122 are formed along the respective block sidewalls 116, 118, extending upward from the top surface 104 of block 100.

Blocks 100 can be made of durable, rugged, weather resistant materials selected for strength and structural integrity, and with similar physical features according to other blocks 100, 200, 300, 500 and 600, as described herein. The width (W, W1), depth (D, D2), and height (H, H1) dimensions may vary, depending on application.

As shown in FIGS. 20A-20D, block 100 is formed of a front wall portion 112, defining the front face 113 of block 100, and a back wall or rear portion 114, defining the back surface 115, substantially parallel to front face 113. Block sidewalls 116, 118 extend transversely between front and back wall portions 112, 114, defining a block side angle (A) as measured from a perpendicular to the front face 113 (FIG. 20A).

Engagement lugs 120, 122 are defined on the block sidewalls 116, 118, extending upward from the top surface 104, opposite the bottom surface 106. As shown in FIGS. 20A and 20B, lugs 120, 122 are provided with a symmetric bevel B2 along the back surface, oriented toward the back wall section 114 of block 100, and symmetric as reflected about block centerline CL. Lugs 120, 122 have substantially parallel side surfaces, extending flush with the outer surfaces of block sidewalls 116, 118 and along the opposing inner surfaces 137, 139 of opening 130, disposed about the block center of gravity CG.

One or more grooves or channel features 125 can be formed in either or both of the block sidewalls 116, 118 during the manufacturing process, for example adjacent to the engagement lugs 120, 122, or spaced along the top surface 104. The beveled back surfaces of lugs 120, 122 can also be offset from the back wall portion 114 of block 100, e.g., at a selected distance (OF) as shown in FIG. 20D.

Lugs 120, 122 are adapted to engage one or more of the rear surface 135 and adjacent side surfaces 137, 139 of the opening 130 in one or more adjacent blocks 100, for example in a pair of horizontally adjacent blocks 100 in an upper course of a segmented wall system, when arranged on top of the block 100 in a vertically adjacent lower course, as shown in FIGS. 21A-21D.

FIGS. 21A-21D are top plan, isometric, front elevation and side elevation views of a segmented wall system 150 assembled from a number of blocks 100, for example according to FIGS. 20A-20D. Blocks 100 can be arranged into any number of layers or courses 160, 162, including one or more lower courses 160, and one or more vertically adjacent upper courses 162.

Adjacent blocks 100 abut at interfaces 170. A fill material (FF) can also be provided in the openings 130 of one or more of the blocks 100, and a geogrid material (GD) can be installed between courses 160, 162, as described herein.

Engagement lugs 120, 122 on adjacent blocks 100 are separated by a gap (G), which is defined by the block side angle and block depth (see FIG. 20A), and the curvature of wall system 150. The gap can be selected for the lugs 120, 122 of a block 100 in a lower course 160 to engage the openings in one or more blocks 100 of an adjacent upper course 162, for example along the rear or adjacent side surfaces of the openings two adjacent upper-course blocks 100. Conversely, the lugs 120, 122 on adjacent blocks in the lower course 160 can engage the opening 130 of a single block 100 in the upper course 162, improving structural stability of the wall system 150 as described herein.

Figure 22A:
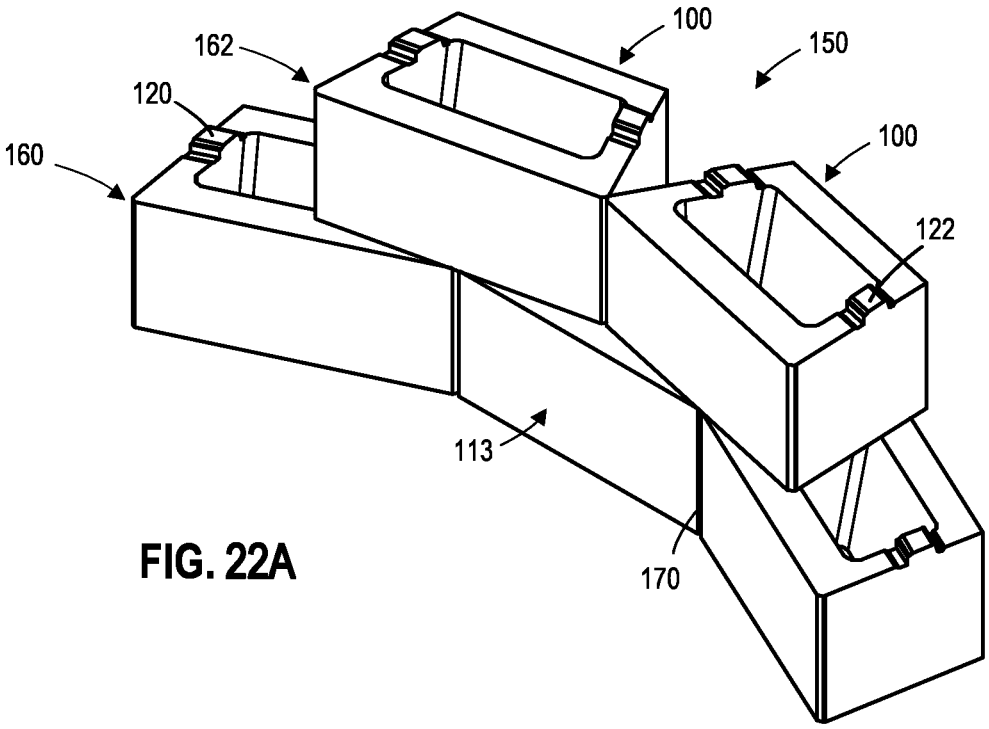
FIGS. 22A and 22B are isometric views of the segmented wall system, in curved wall applications.
Figure 22B:
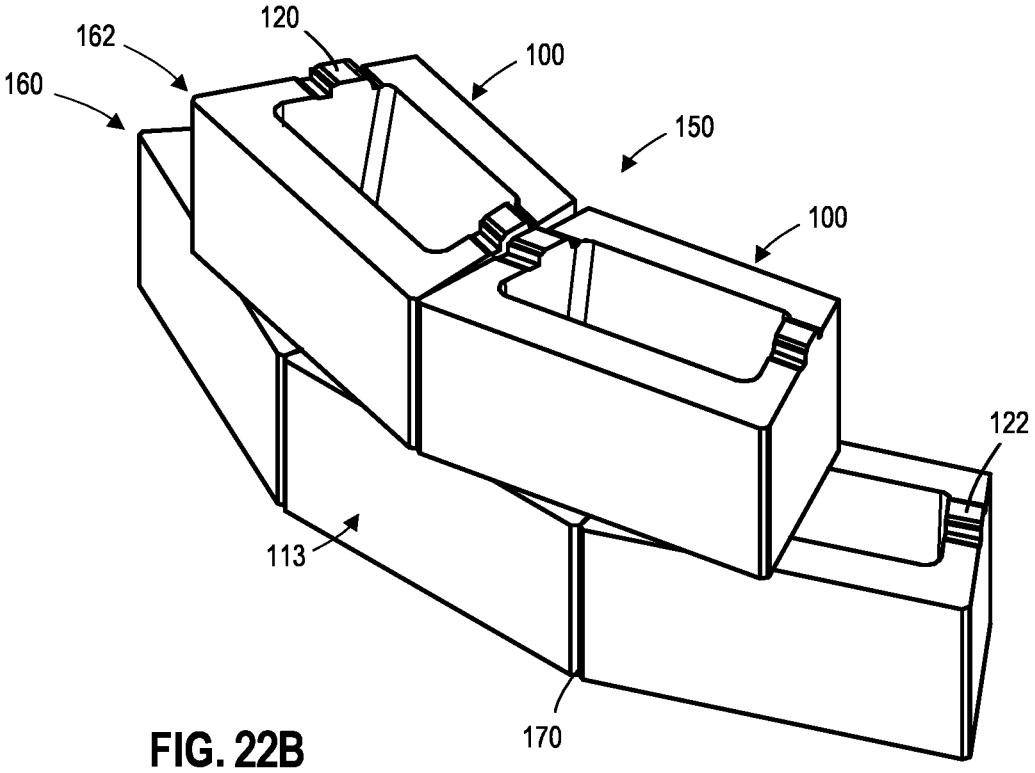

FIGS. 22A and 22B are isometric views of the segmented wall system 150, in curved wall applications. For example, blocks 100 can define a convex curvature as shown in FIG. 22A, corresponding to an inside radius of curvature extending along one or both courses 160, 162. Similarly, blocks 100 can also define a concave curvature as shown in FIG. 22B, corresponding to an outside radius of curvature along one or both courses 160, 162.

The radius of curvature may vary. For example, an inside radius of curvature (FIG. 22A) can define a maximum concave block wall angle at which the gap between engagement lugs 120, 122 on adjacent blocks 100 in a lower course 160 approaches the width defined along the back surface of the opening in an adjacent block 100 in an upper course 162, so that the lugs 120, 122 on adjacent lower-course blocks 100 fit inside the same opening of the same upper course block 100. Similarly, an outside radius of curvature (FIG. 22B) can define a maximum convex block wall angle at which the gap between the engagement lugs 120, 122 on adjacent blocks 100 approaches zero (that is, where the block sidewalls touch).

Suitable wall systems 150 can be formed with any number of courses 160, 162, each having any number of blocks 100. The blocks 100 can be arranged to provide sections of wall system 150 with linear or nonlinear geometry, straight segments, corners, convex or concave curvature, or any combination thereof. Wall systems 150 can also be assembled from any combination of landscaping blocks, tail units and corner blocks described herein, in any suitable geometry.

Figure 23C:
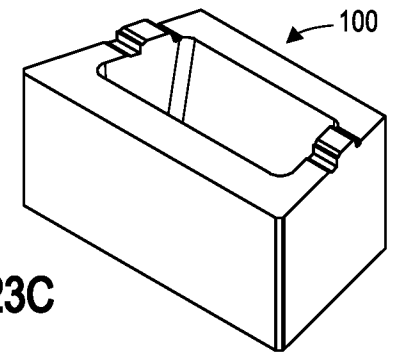
FIGS. 23A-23J are top left isometric, top plan, top right isometric, left elevation, front elevation, right elevation, rear elevation, bottom left isometric, bottom plan, and bottom right isometric views of the block in FIGS. 20A-20D, illustrating the overall design.
Figure 23G:
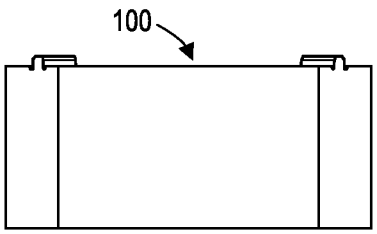
Figure 23J:
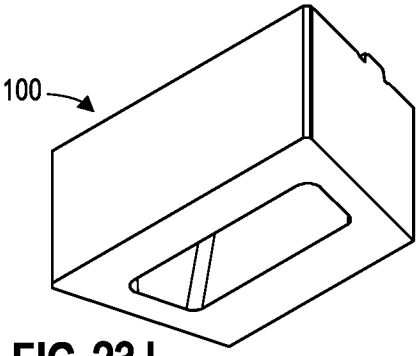
Figure 23F:
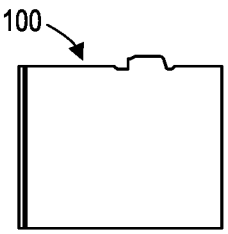
Figure 23B:
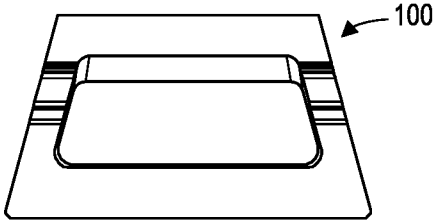
Figure 23E:
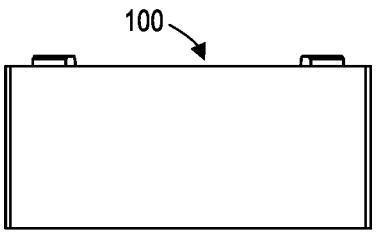
Figure 23I:
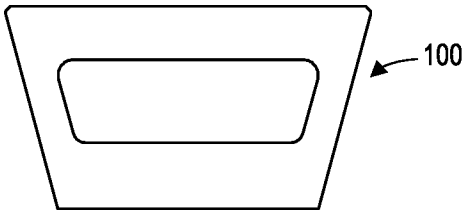
Figure 23A:
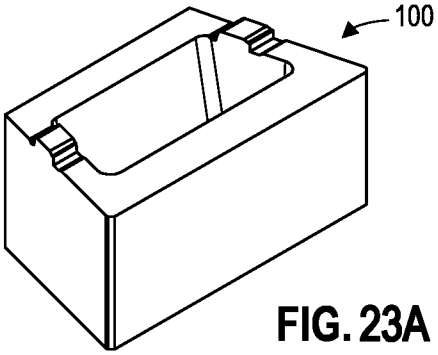
Figure 23D:
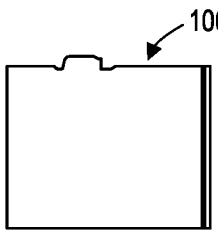
Figure 23H:
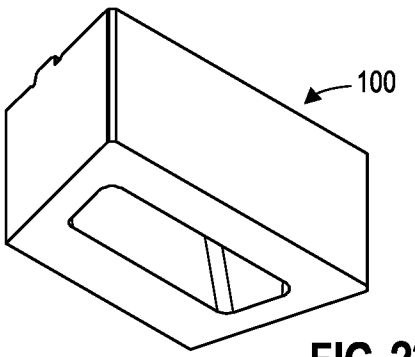
Figure 26B:
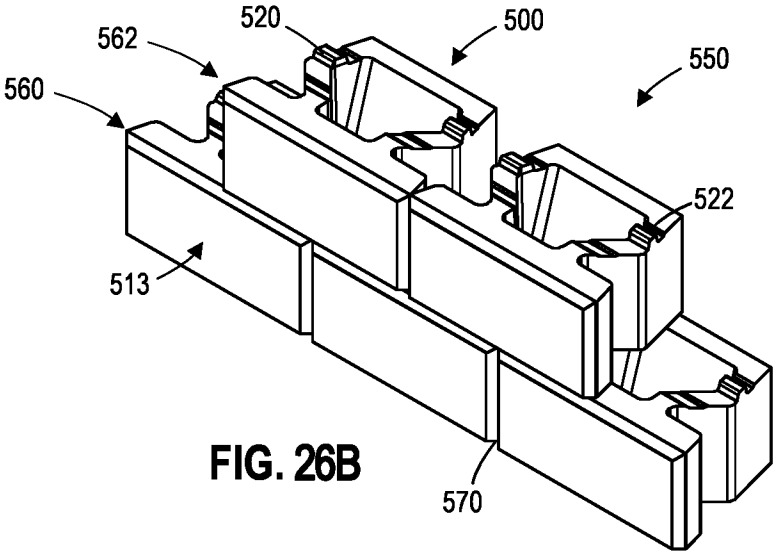
FIGS. 26A-26D are top plan, isometric, front elevation and side elevation views of a segmented wall system assembled from a number of blocks according to FIGS. 25A-25D.
Figure 26D:
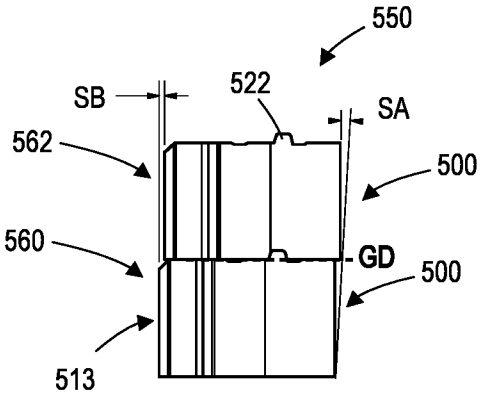
Figure 26A:
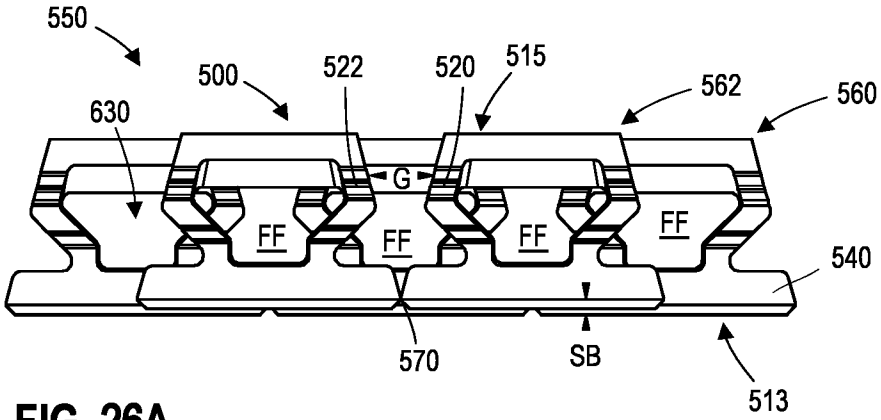
Figure 26C:
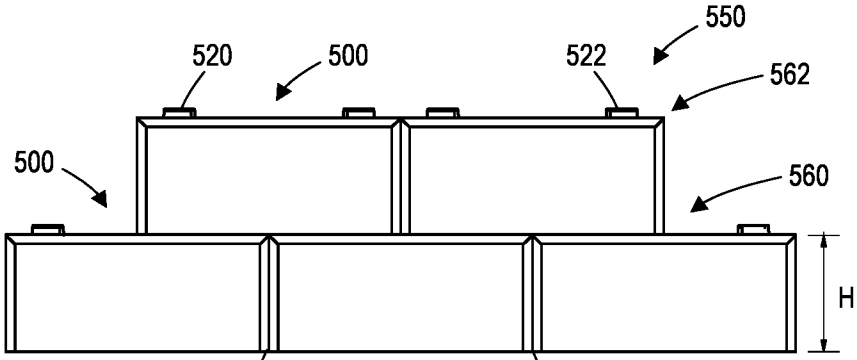

FIGS. 23A-23C are top left isometric, top plan, and top right isometric views of a landscaping block 100, e.g., as shown in FIGS. 20A-20D, illustrating the overall block design. FIGS. 23D-23G are left elevation, front elevation, right elevation and rear elevation view of the block 100, and FIGS. 23H-23J are bottom left isometric, bottom plan, and bottom right isometric views, respectively.

FIGS. 24A-24D are top plan, isometric, front elevation and side elevation views of a manufacturing module for blocks 100; e.g., according to FIGS. 20A-20D. In these examples, a number of blocks 100 (e.g. two) can be arranged face-to-face along a split line SL. The module 180 can be divided along line SL to form a pair of blocks 100, each with a hard-split surface texture.

FIGS. 25A-25C are top plan, isometric, and front elevation views of a landscaping block or wall block 500 for a segmented wall system, with nesting inter-block engagement processes (lugs) 520, 522. FIG. 25D is a section view, taken along line A-A of FIG. 25C.

As shown in FIGS. 25A-25D, block 500 is formed of a front wall portion 512 defining the front face 513, and a back wall or rear portion 514 defining the back surface 515, substantially opposed to and parallel with the front face 513. Block sidewalls ("leg" or "neck" portions) 516, 518 extend transversely between front and back walls 512, 514.

Blocks 500 can be made of durable, rugged, weather resistant materials selected for strength and structural integrity, and with similar physical features according to other blocks 100, 200, 300, 500 and 600, as described herein. The width (W, W1), depth (D, D2), and height (H, H1) dimensions may vary, depending on application.

As shown in FIGS. 25A-25D, blocks 500 are formed of a front wall portion 512 defining the front face 513 of block 500, and a back wall portion 514 defining the back surface 515, substantially parallel to front face 513. Lateral extensions 540 can be defined on the front portion 512 of block 500, extending outward of the connections to block sidewalls 516, 518.

Engagement lugs 520, 522 are defined on the sidewalls or side portions 516, 518 of block 500, extending upward from the top surface 504, opposite the bottom surface 506. One or more central openings or cavities 530 can be defined between the front, back and opposing side wall portions 512, 514, 516, 518 of block 500; e.g., disposed about the center of gravity CG, with the perimeter of opening 530 defined along the corresponding inside front, rear, and sidewall surfaces 533, 535, 537 and 539.

Lugs 520, 522 can be provided with a symmetric bevel B2 along the back surface, as reflected about block centerline CL. Lugs 520, 522 can have substantially parallel side surfaces extending flush to the outer surfaces of block sidewalls 516, 518, and along the opposing inner surfaces 537, 539 of opening 530. One or more grooves or channel features 526 can be formed in either or both of the block sidewalls 516, 518 during the manufacturing process, for example spaced from the engagement lugs 520, 522 along the top surface 504.

The beveled back surfaces of lugs 520, 522 can be offset from the back wall portion 514 of block 500, for example by a selected distance (OF) along the respective block sidewalls 516, 518 as shown in FIG. 25D. The bevel B2 can be adapted to engage the rear or adjacent side surfaces 535, 537 and 539 of the openings 530 in one or more adjacent blocks 500 in the upper course of a segmented wall system, for example when arranged on top of a block 500 in a corresponding lower course, as further illustrated in FIGS. 26A-26D.

As shown in FIGS. 25A and 25B, block sidewalls 516, 518 extend transversely between the front and back wall portions 512, 514, in two "reverse-angled" sections disposed forward and rearward of a medial corner or apex. The block side angle (A) can be defined along the rear sections of each sidewall 516, 518, adjacent the back wall 514 of block 500, and measured from a perpendicular to the front face 513 according to FIG. 25A. The front and rear sections of each sidewall 516, 518 may have the same wall thickness (e.g., T3, T4, respectively), or the thickness may vary between the front and rear sections.

The reverse angle of the front portions of the block sidewalls 516, 518 can be adapted to form nesting structures 528 along the exterior surface of the front portions of block sidewalls 516, 518, and along the adjacent (rear) surface of front wall extension 540 (or along either or both surfaces), as shown in FIG. 25A. The nesting structures 528 can be adapted to accommodate the lugs 520, 522 of a vertically adjacent block 500 when stacked on a pallet or otherwise arranged for shipping, for example with the beveled structure of the lugs 520, 522 engaging one or more corresponding exterior surfaces of the block sidewalls 516, 518 and front wall extension 540, as further illustrated in FIGS. 28A and 28B.

FIGS. 26A-26D are top plan, isometric, front elevation and side elevation views of a segmented wall system 500 assembled from a number of blocks 500, for example according to FIGS. 25A-25D. Blocks 500 can be arranged into any number of layers or courses 560, 562, for example one or more lower courses 560, and one or more vertically adjacent upper courses 562.

Adjacent blocks 500 abut at interfaces 570. A fill material (FF) can be provided in the openings 530 of one or more of the blocks 500, and a geogrid material (GD) can be installed between courses 560, 562, for example to strengthen the assembled wall system 550 and improve drainage.

Engagement lugs 520, 522 on adjacent blocks 500 are separated by a gap (G), which is defined by the block side angle and block depth (see FIG. 25A), and the curvature of wall system 550. The gap can be selected for the lugs 520, 522 of a block 500 in a lower course 560 to engage the openings in one or more blocks 500 of an adjacent upper course 562, for example along the rear or adjacent side surfaces of the openings in two adjacent upper-course blocks 500, improving structural stability of the wall system 550 as described herein. The sidewalls 516, 518 of blocks 500 in adjacent layers can also abut in the vertical direction, defining a shared loading path extending vertically through the wall system 550.

Figure 27A:
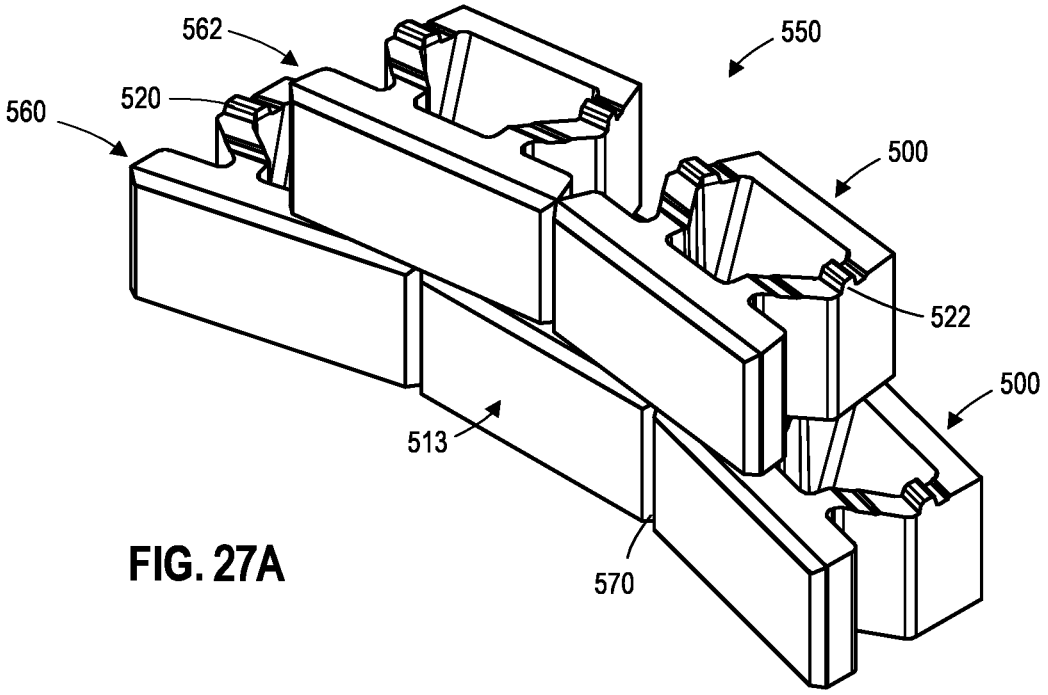
FIGS. 27A and 27B are isometric views of the segmented wall system, in curved wall applications.
Figure 27B:
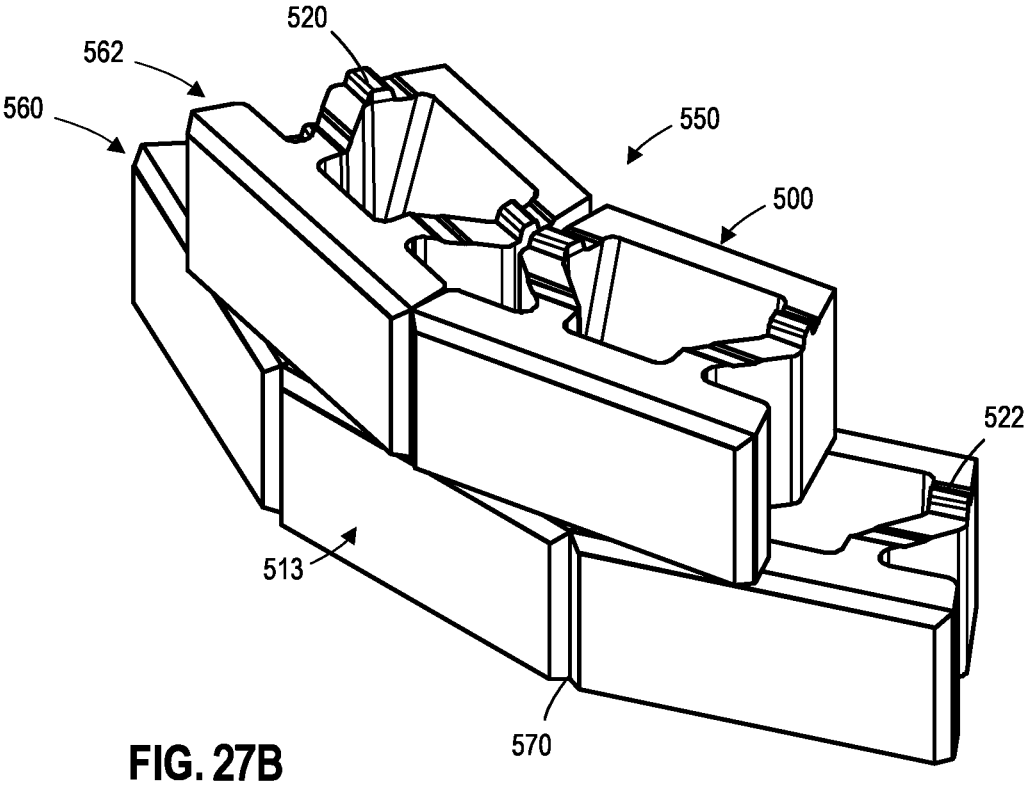

FIGS. 27A and 27B are isometric views of the segmented wall system 550, in curved wall applications. For example, blocks 500 can define a convex structure as shown in FIG. 27A, corresponding to an inside radius of curvature extending along a selected course 560, 562. Similarly, blocks 500 can also define a concave structure as shown in FIG. 27B, corresponding to an outside radius of curvature along courses 560, 562.

The radius of curvature may vary according to maximum convex and concave block wall angles, as described herein. Wall systems 550 can also be assembled from any combination of landscaping blocks, tail units and corner blocks described herein, with linear or nonlinear geometry, straight segments, corners, convex or concave curvature, or any combination thereof.

Figure 28A:
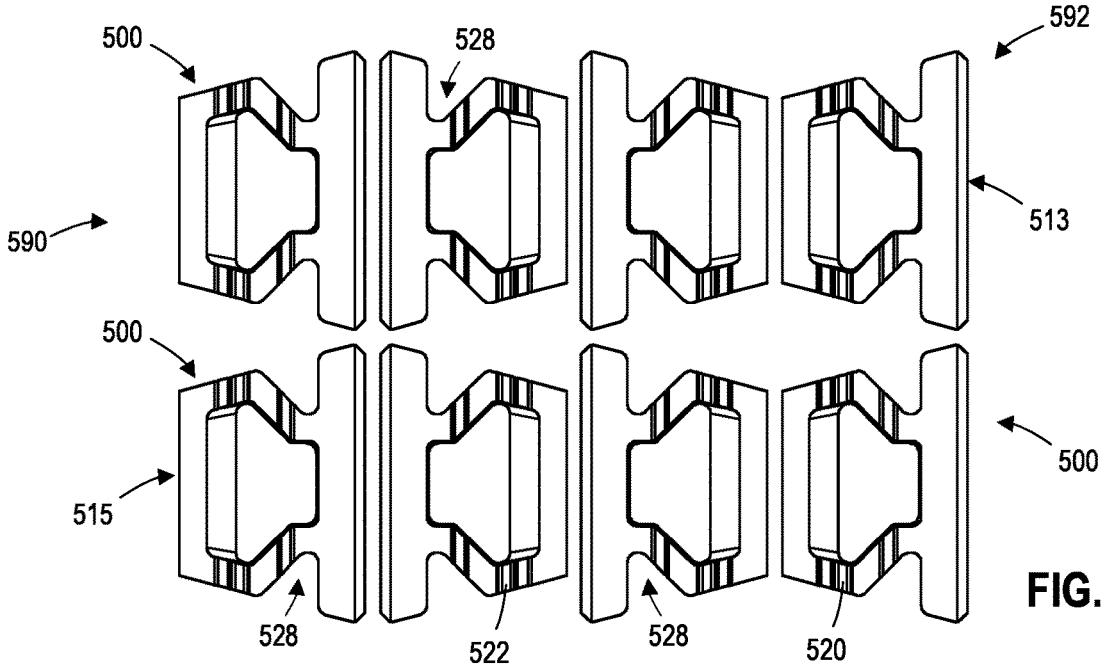
FIGS. 28A and 28B are top plan and isometric views of a nested pallet layout for the block in FIGS. 25A-25D.
Figure 28B:
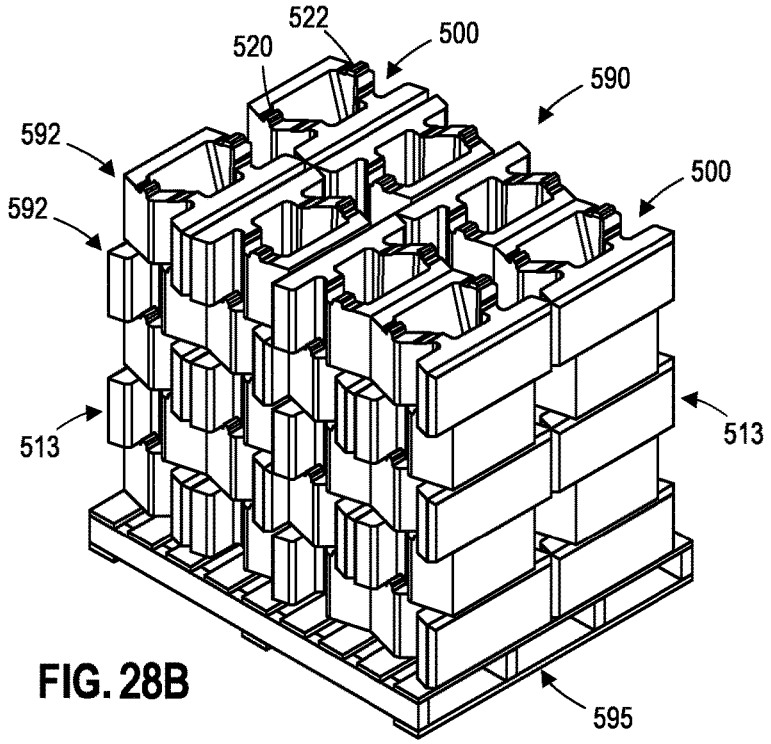

FIG. 28A is a top plan view of a nested pallet or shipping layout 590 for a number of blocks 500 according to FIGS. 25A-25D, showing a single block layer 592. FIG. 28B is an isometric view of the layout 590, with multiple layers 592 of blocks 500.

As shown in FIGS. 28A and 28B, blocks 500 can be arranged in a nesting configuration for shipping on a wooden pallet 595, or other structure. For example, blocks 500 can be arranged in a reversed face-to-face or spaced orientation in each layer 592, so that the lugs 520, 522 of blocks 500 in successive layers 592 are disposed within the nesting structures 528 of the blocks 500 in an adjacent layer 592.

The surfaces of the lugs 520, 522 and the angles of the corresponding sidewall sections of the blocks 500 can be further adapted for the lugs 520, 522 to engage with the exterior sidewalls and adjacent surfaces of an overlaying, stacked block 500 (compare, e.g., FIG. 25A). For example, the orientations of the blocks 500 in each adjacent layer 592 can be reversed or rotated by 180 degrees, so that the lugs 520, 522 are engaged in the nesting structures of the blocks 500 in an adjacent layer 592. As a result, the height of each layer 592 of the layout 590 can be reduced to the installed height of the blocks 500, with the lugs 520, 522 accepted into the nesting structures 538. This configuration also limits the range of relative motion for individual blocks 500 in each adjacent layer 592, improving structural stability and reducing the risk of damage to lugs 520, 522 and other structural features of the blocks 500 during shipment, storage and handling.

Figure 29B:
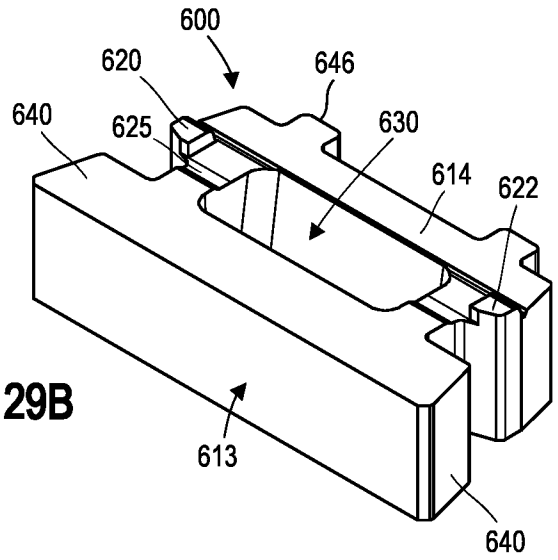
FIGS. 29A-29D are top plan, isometric, front elevation and side section views of a landscaping block for a segmented wall system, in a straight keycut face configuration with nesting lugs.
Figure 29D:
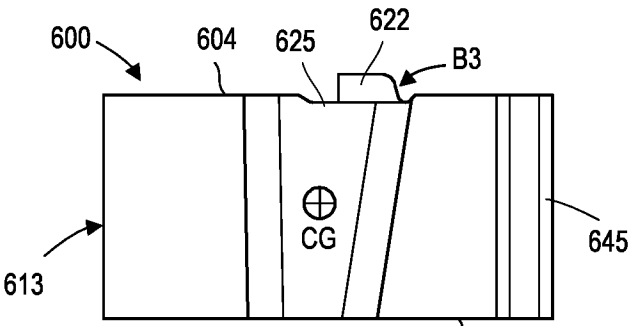
Figure 29A:
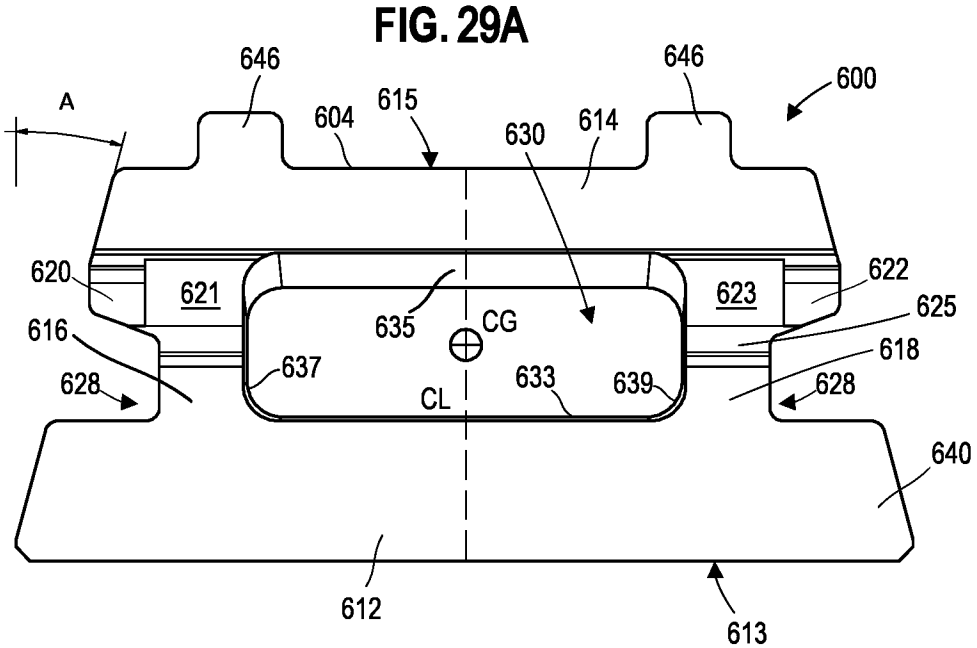
Figure 29C:
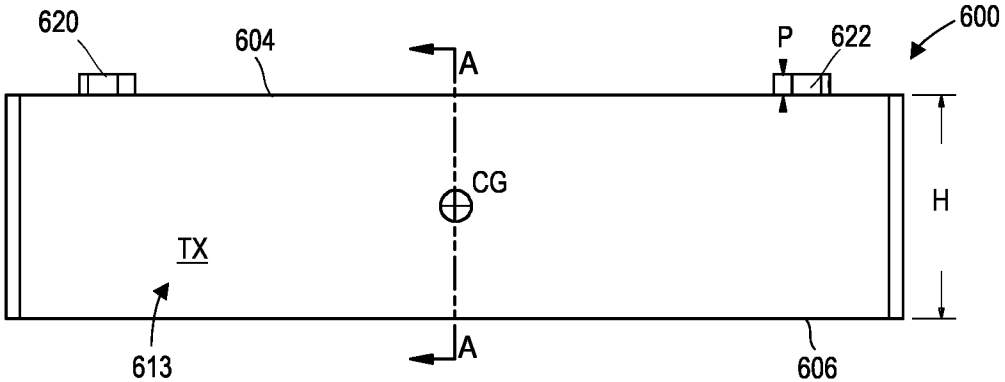
Figure 30B:
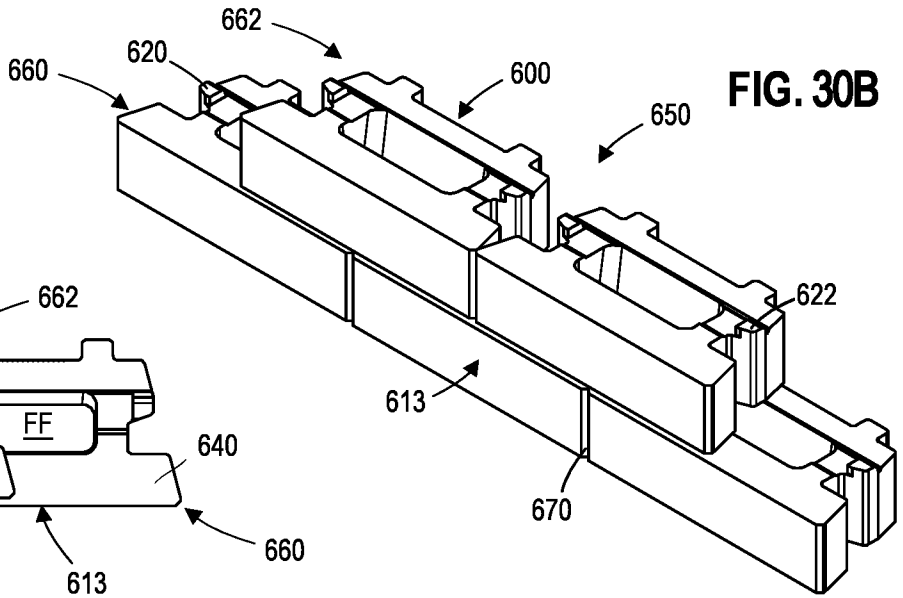
FIGS. 30A-30D are top plan, isometric, front elevation and side elevation views of a segmented wall system assembled from a number of blocks according to FIGS. 29A-29D.
Figure 30A:
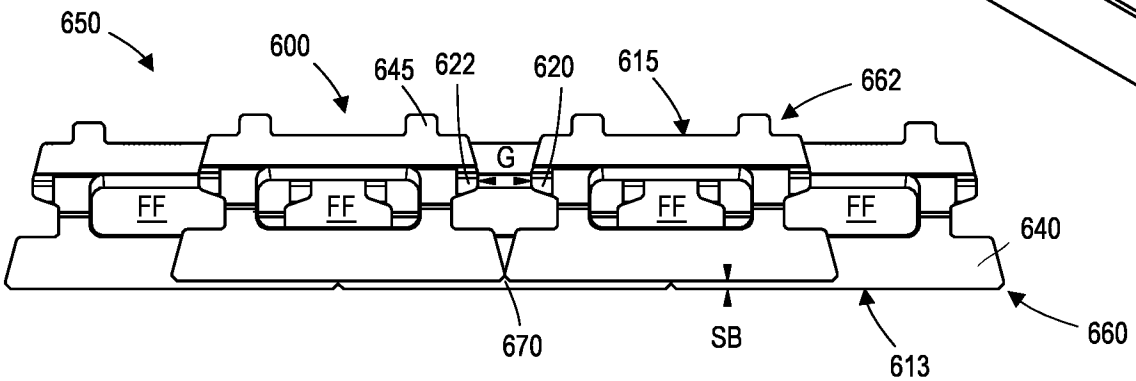
Figure 30D:
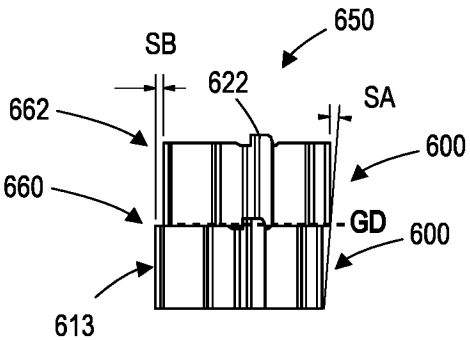
Figure 30C:
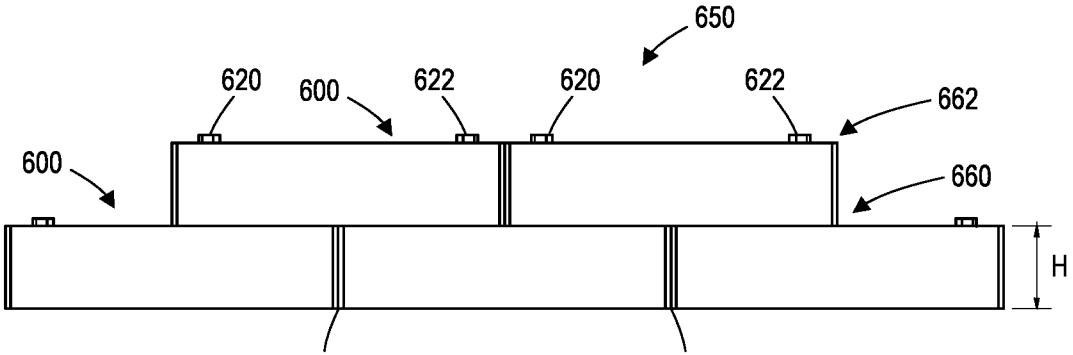

FIGS. 29A-29C are top plan, isometric, and front elevation views of a landscaping block or wall block 600 for a segmented wall system, in a straight keycut face configuration with nesting inter-block engagement processes (lugs) 620, 622. FIG. 29D is a section view, taken along the line A-A of FIG. 25C.

Blocks 600 can be made of durable, rugged, weather resistant materials selected for strength and structural integrity, and with similar physical features according to other blocks 100, 200, 300, 500 and 600, as described herein. The width, depth, and height (H) may vary, depending on application.

As shown in FIGS. 29A-29D, blocks 600 are formed of a front wall portion 612 defining the front face 613, and a rear wall or back portion 614 defining the back surface 615, substantially opposed to and parallel with the front face 613. Block sidewalls ("leg" or "neck" portions) 616, 618 extend transversely between the front wall 612 and back portion 614. The block side angle (A) is defined along the back portion 614 of block 600, measured from a perpendicular to the front face 613 as shown in FIG. 29A.

In particular examples, engagement lugs 620, 622 are disposed on the outer surfaces of block sidewalls 616, 618, extending upward from the top surface 604 of block 600 adjacent the back portion 614. Lateral extensions 640 can be defined on the front wall portion 612 of block 600, extending outward of the connections to block sidewalls 616, 618. Transverse processes 646 can be defined on the back portion 614, for example extending rearward (transverse to back wall portion 614) as shown in FIG. 29A. A central cavity or opening 630 can be defined between the opposing front wall, back and side portions 612, 614, 616, 618 of block 600; e.g., disposed about the center of gravity CG, with perimeter defined along the corresponding inside front, rear, and sidewall surfaces 633, 635, 637 and 639.

Engagement lugs 620, 622 are defined on outer edges of block sidewalls 616, 618, extending upward from the top surface 604, adjacent the back portion 614. Lugs 620, 622 can be provided with an outside bevel B3; e.g., oriented toward the back portion 614 of block 600 and extending symmetrically along the back surface and outside edges of lugs 620, 622, as reflected about block centerline CL.

Depending on application, the inside edges of lugs 620, 622 can be defined along the adjacent flat structures 621, 623, disposed on the inside edges of block sidewalls 616, 618, adjacent opening 630 and back portion 614. For example, flats 621, 623 can be formed onto block sidewalls 616, 618 by a double-action head or by machining, or a combination thereof, so that flats 621, 623 have approximately the same height (or are approximately even with) the top surface 604 of block 600.

One or more grooves or channel features 625 can also be formed in block sidewalls 616, 618, for example adjacent the front edge of engagement lugs 620, 622. Bevel B3 can be adapted to engage one or more rear or side surfaces 635, 637 and 639 of the openings 630 in one or more vertically adjacent blocks 600, for example when stacked in successive courses of a segmented wall system 650 as further illustrated in FIGS. 30A-30D. The beveled surfaces of lugs 620, 622 can be substantially flush with the rear surfaces 635 of opening 630, or offset from rear surface 635 and the back portion 614 of block 600, along the respective block sidewall 616, 618.

Nesting structures 628 can be formed along the exterior surfaces of the front portions of block sidewalls 616, 618, extending to or along the adjacent (rear) surface of front wall extension 640 (or along either or both surfaces), as shown in FIG. 29A. The nesting structures 628 can be adapted to accommodate lugs the 620, 622 of a vertically adjacent block 600 when stacked on a pallet for shipping, for example with the beveled structure of the lugs 620, 622 engaging one or more corresponding exterior surfaces of the block sidewalls 616, 618 and front wall extension 640, as further illustrated in FIGS. 32A and 32B.

FIGS. 30A-30D are top plan, isometric, front elevation and side elevation views of a segmented wall system 650 assembled from a number of blocks 600, for example according to FIGS. 29A-29D. Blocks 600 can be arranged into any number of layers or courses 660, 662, for example one or more lower courses 660, and one or more vertically adjacent upper courses 662.

Adjacent blocks 600 abut at interfaces 670. A fill material (FF) can be provided in the openings 630 of one or more of the blocks 600, and a geogrid material (GD) can be installed between courses 660, 662, as described herein.

The engagement lugs 620, 622 on adjacent blocks 600 are separated by a gap (G), as defined by the block side angle and depth (see e.g. FIG. 29A), and the curvature of wall system 650. The gap can be selected for the lugs 620, 622 of a block 600 in a lower course 660 to engage the openings in one or more blocks 600 of an adjacent upper course 662, for example along the rear or adjacent side surfaces of the openings in two adjacent upper-course blocks 600. Conversely, the lugs 620, 622 on adjacent lower-course blocks 600 can be engaged within the opening 630 of a single upper-course block 600, improving structural stability of the wall system 650 as described herein.

Figure 31A:
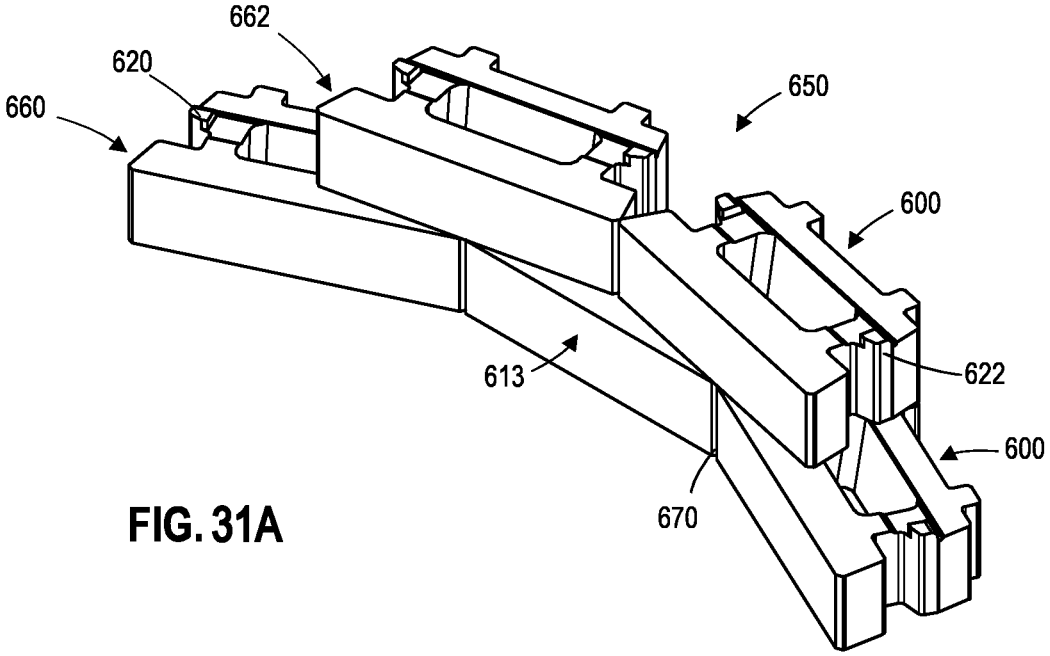
FIGS. 31A and 31B are isometric views of the segmented wall system, in curved wall applications.
Figure 31B:
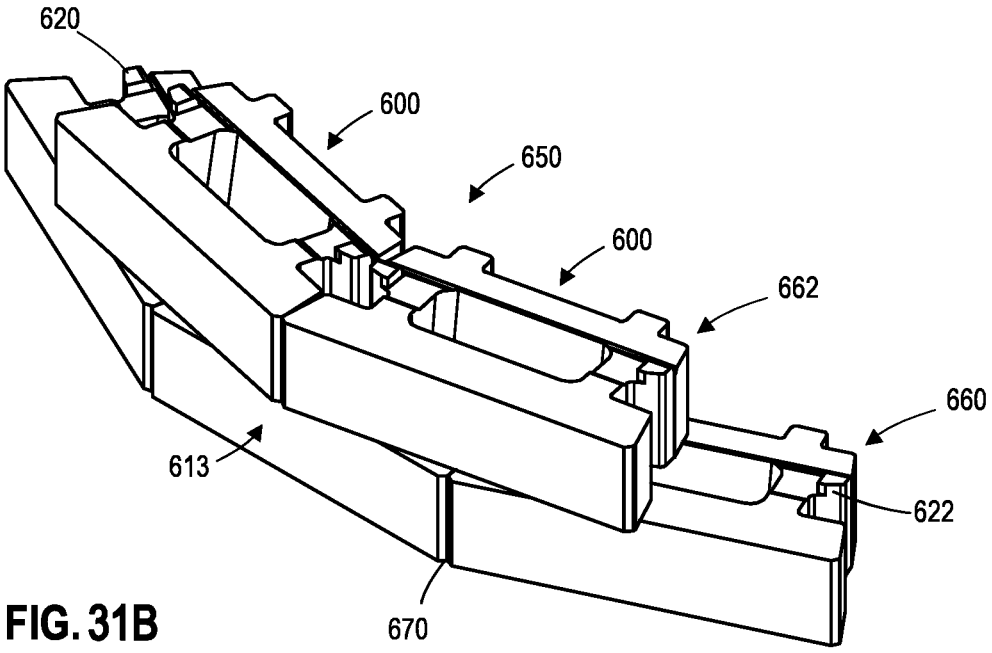

FIGS. 31A and 31B are isometric views of the segmented wall system 650, in curved wall applications. For example, blocks 600 can define a convex structure as shown in FIG. 31A, corresponding to an inside radius of curvature extending along a selected course 660, 662. Similarly, blocks 600 can also define a concave structure as shown in FIG. 31B, corresponding to an outside radius of curvature along courses 660, 662

Figure 32A:
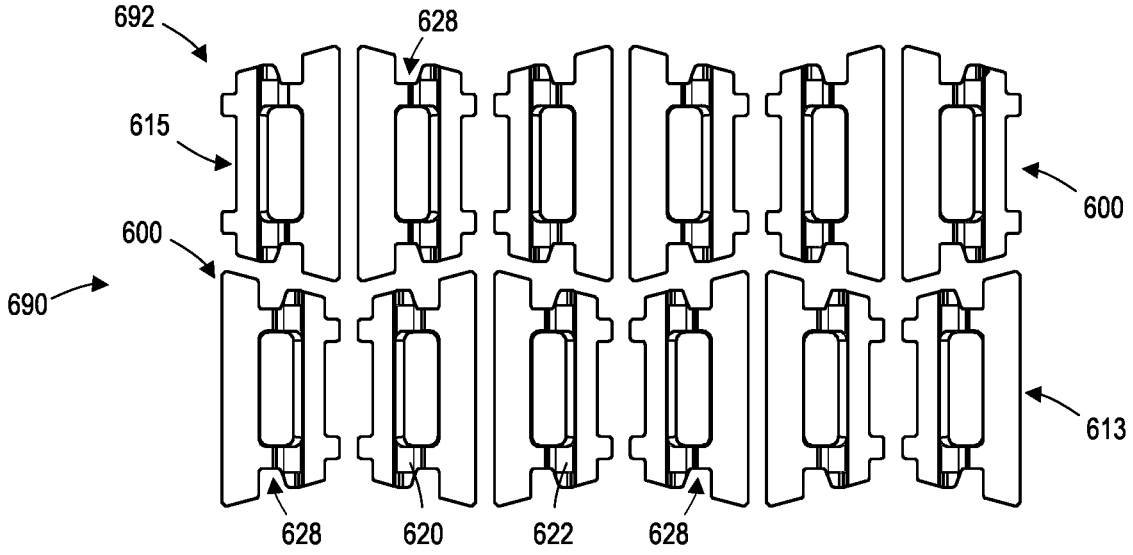
FIGS. 32A and 32B are top plan and isometric views of a nested pallet layout for the block in FIGS. 29A-29D.
Figure 32B:
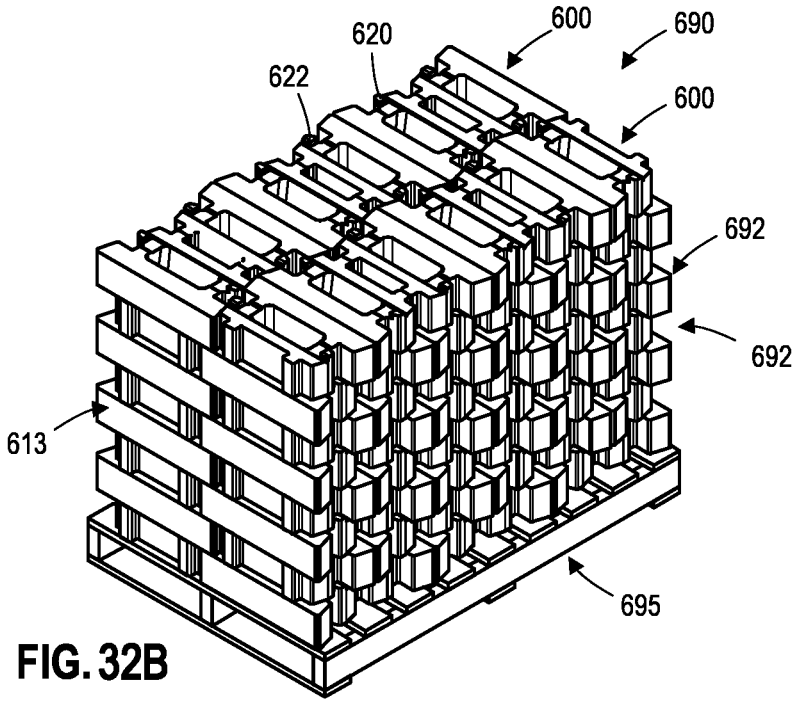

FIG. 32A is a top plan view of a nested pallet or shipping layout 690 for a number of blocks 600 according to FIGS. 29A-29D, showing a single block layer 692. FIG. 32B is an isometric view of the layout 690, with multiple layers 692 of blocks 600.

As shown in FIGS. 32A and 32B, blocks 600 can be arranged in a nesting configuration for shipping on a wooden pallet or other structure 695. For example, blocks 600 can be arranged in a reversed face-to-face or spaced orientation, so that the lugs 620, 622 of blocks 600 in successive layers 692 are disposed within the nesting structures 628 of blocks 600 in the adjacent layers 692.

The beveled surfaces of lugs 620, 622 and the angles of the corresponding sidewall sections of each block 600 can be further adapted for the lugs 620, 622 to engage with the exterior sidewall and adjacent surfaces forming the nesting structures 628 in the overlaying, stacked layer 692 of blocks 600 (compare, e.g., FIG. 29A). The blocks 600 in each adjacent layer 692 can have reversed or rotated orientations; e.g. by 180 degrees. The height of layers 692 in the shipping layout 690 can be reduced to the installed height of the blocks 600, with the lugs 620, 622 accepted into the nesting structures 628 of the adjacent, stacked (and reversed or rotated) blocks 600. This configuration also limits the range of relative motion for individual blocks 600 in each adjacent layer 692, improving structural stability while reducing the risk of damage to the lugs 620, 622 and other structural features of blocks 600 during shipment, storage and handling.

Figure 33B:
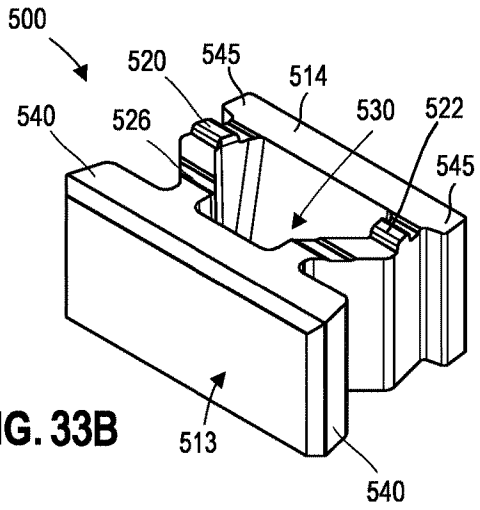
FIGS. 33A-33D are top plan, isometric, front elevation and side section views of a landscaping block for a segmented wall system, in a board machine configuration with nesting lugs.
Figure 33D:
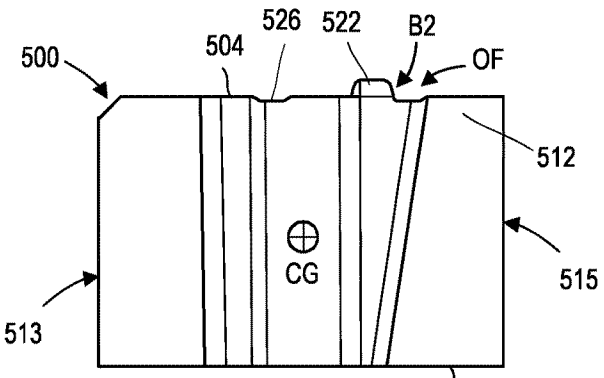
Figure 33A:
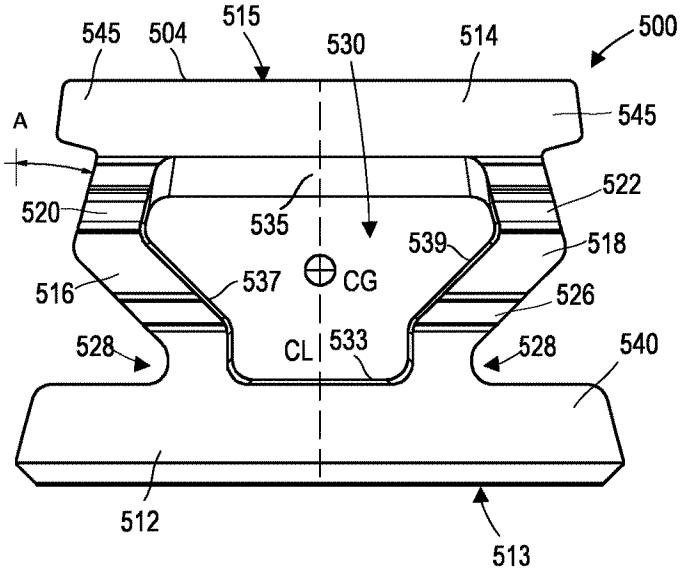
Figure 33C:
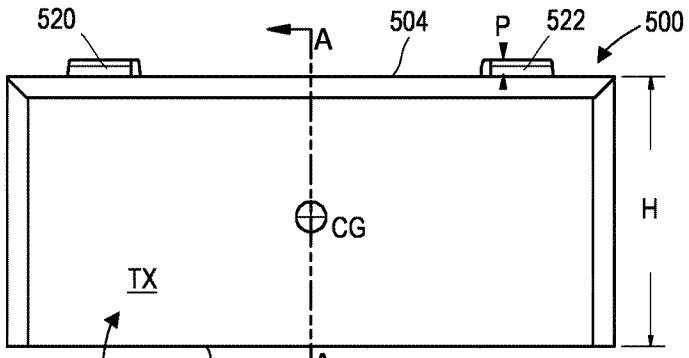
Figure 34B:
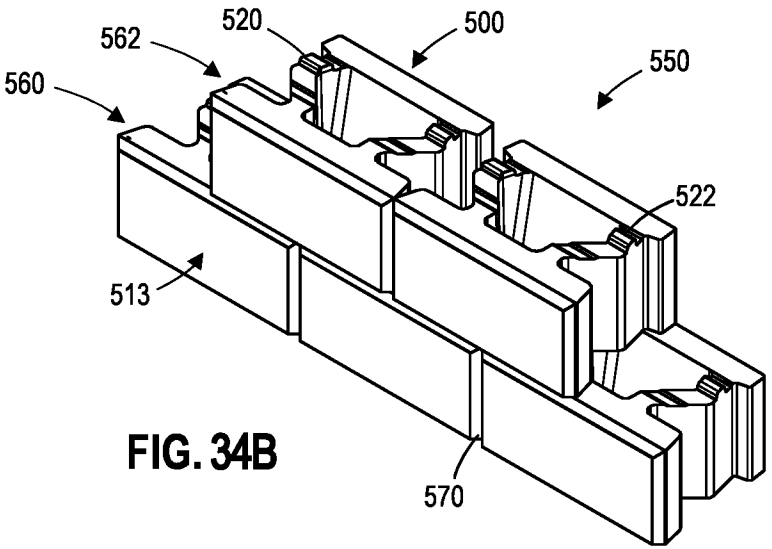
FIGS. 34A-34D are top plan, isometric, front elevation and side elevation views of a segmented wall system assembled from a number of blocks according to FIGS. 33A-33D.
Figure 34D:
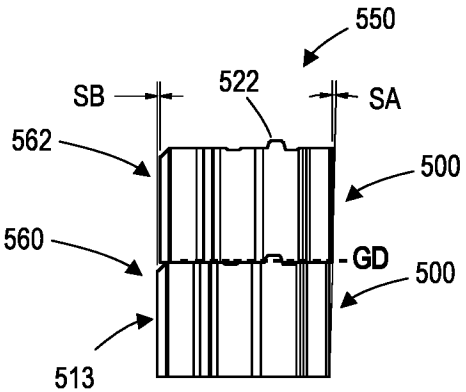
Figure 34A:
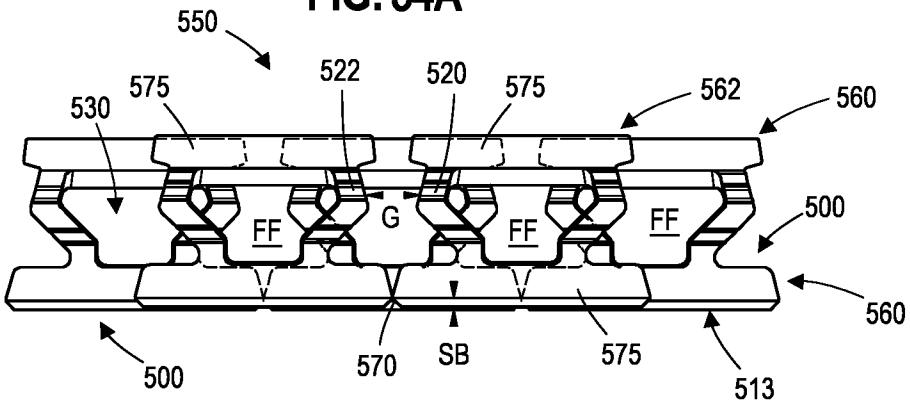
Figure 34C:
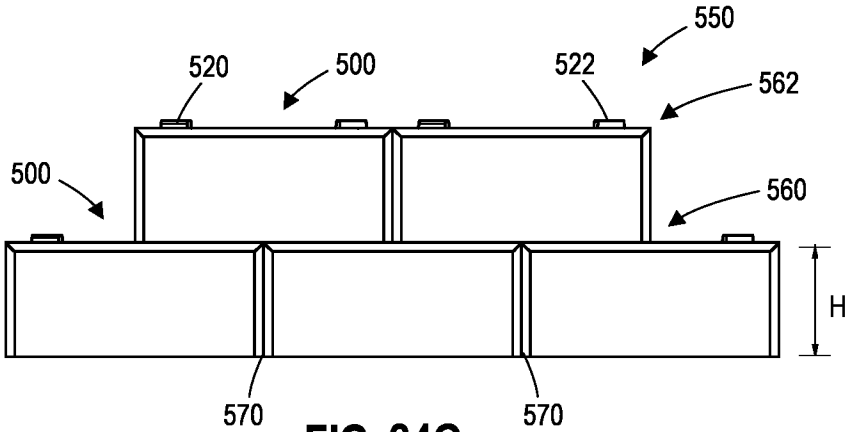

FIGS. 33A-33C are top plan, isometric, and front elevation views of a landscaping block 500 for a segmented wall system, in a hard split configuration with nesting inter-block engagement processes (lugs) 520, 522. FIG. 33D is a section view, taken along line A-A of FIG. 33C.

Blocks 500 can be made of durable, rugged, weather resistant materials selected for strength and structural integrity, and with similar physical features according to other blocks 100, 200, 300, 500 and 600, as described herein. The width, depth, and height (H) may vary, depending on application.

As shown in FIGS. 33A-33D, blocks 500 are formed of a front wall portion 512 defining the front face 513, and a back wall portion 514 defining the back surface 515, substantially opposed to and parallel with the front face 513. Reverse-angled block sidewalls 516, 518 extend transversely between front and back walls 512, 514.

Lateral extensions or processes 540, 545 can be defined on the front and back wall portions 512, 514 of block 500, respectively, extending outward of the connections to the block sidewalls 516, 518. One or more central openings or cavities 530 can be defined between the front, back and opposing side walls 512, 514, 516, 518; e.g., disposed about the center of gravity CG, with the perimeter of opening 530 defined by the corresponding inside front, rear, and sidewall surfaces 533, 535, 537 and 539.

A block side angle (A) can be defined along the rear section of sidewalls 516, 518. Nesting structures 528 can be defined along the exterior surface of the front portions of block sidewalls 516, 518, and along the adjacent (rear) surface of front wall extension 540 (or along either or both surfaces), as shown in FIG. 33A. The nesting structures 528 can be adapted to accommodate the lugs 520, 522 of additional, vertically stacked blocks 500, as described herein, and as further illustrated in FIGS. 36B and 36C.

FIGS. 34A-34D are top plan, isometric, front elevation and side elevation views of a segmented wall system 550 assembled from a number of blocks 500, for example according to FIGS. 33A-33D. Blocks 500 can be arranged into any number of lower courses 560 and vertically adjacent upper courses 562.

Adjacent blocks 500 abut at interfaces 570. A fill material (FF) can be provided in the openings 530 of one or more of the blocks 500, and a geogrid material (GD) can be provided between courses 560, 562.

Contact areas 575 between blocks 500 in adjacent courses 560, 562 are shown with dashed lines. Contact areas 575 indicate the vertical loading path when blocks 500 are assembled into wall system 500, and vary accordingly for the other wall systems and block elements described herein, depending on individual block geometry and wall system configuration.

Engagement lugs 520, 522 on adjacent blocks 500 are separated by a gap (G), as defined by the block side angle and block depth (see e.g. FIG. 33A), and the curvature of wall system 550. The gap can be selected for the lugs 520, 522 of blocks 500 in one course 560 to engage the openings in one or more blocks 500 of a successive course 562, improving the structural stability of wall system 550 as described herein.

Figure 35A:
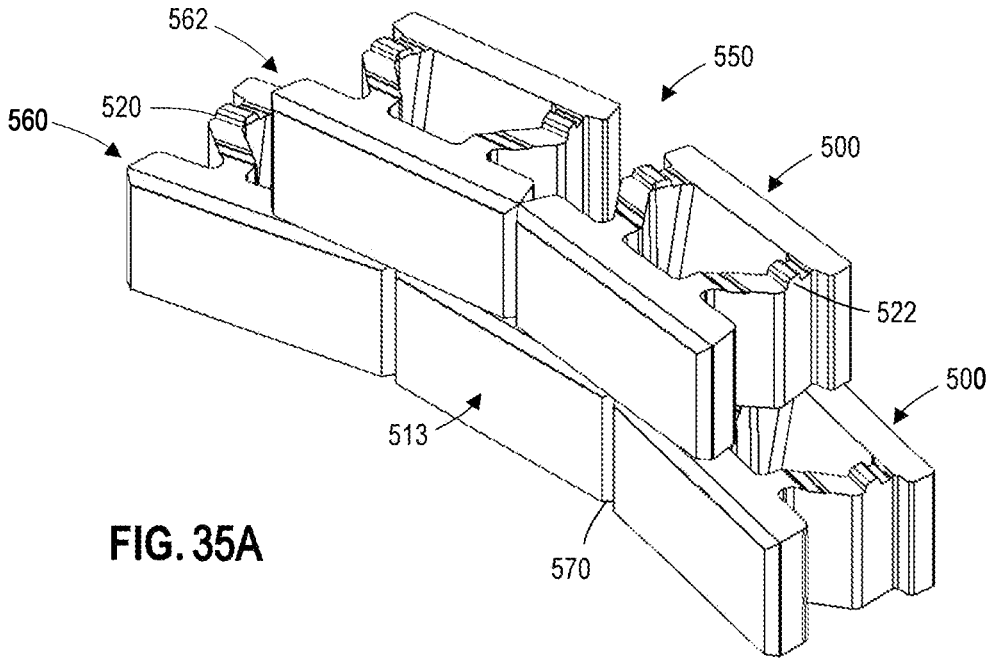
FIGS. 35A and 35B are isometric views of the segmented wall system, in curved wall applications.
Figure 35B:
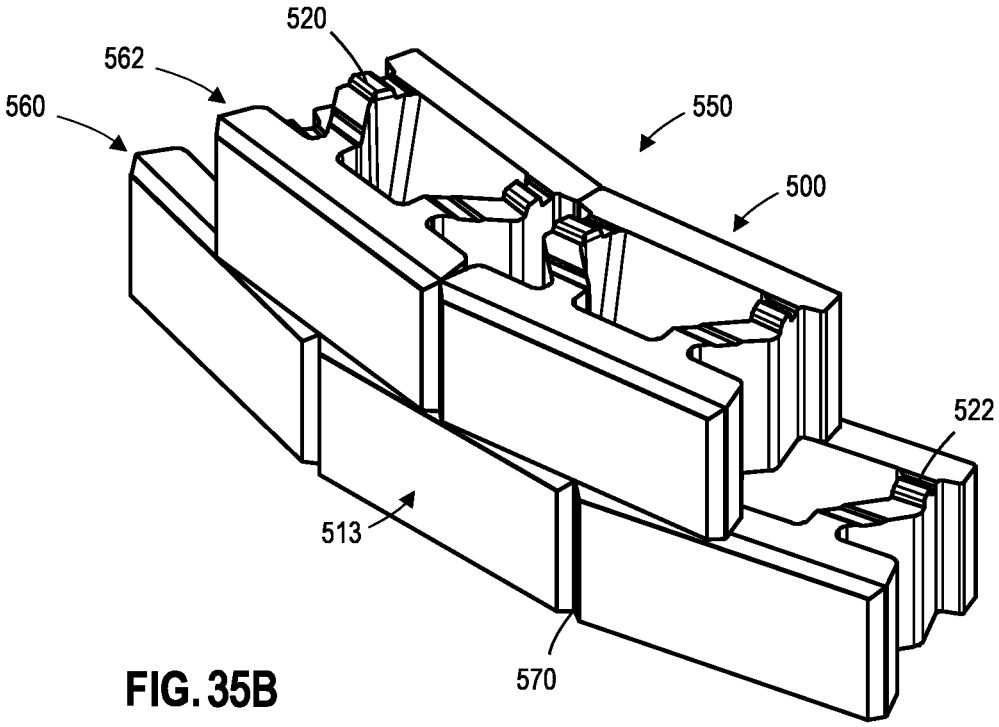

FIGS. 35A and 35B are isometric views of the segmented wall system 550, in curved wall applications. For example, blocks 500 can define a convex structure according to FIG. 35A, corresponding to an inside radius of curvature, and blocks 500 can define a concave structure according to FIG. 35B, corresponding to an outside radius of curvature.

Figure 36A:
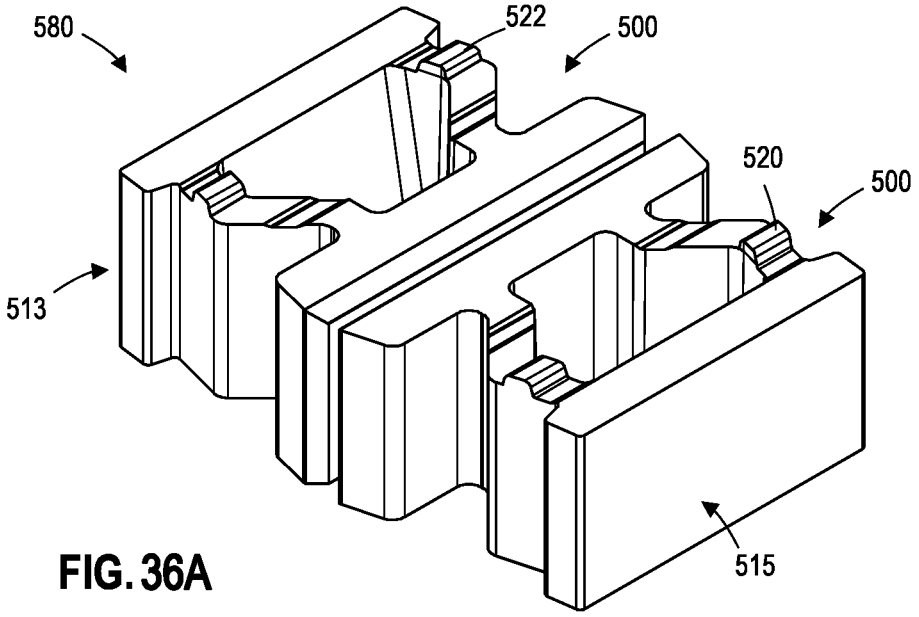
FIGS. 36A and 36B are isometric and top plan views of manufacturing layouts for the blocks in FIGS. 37A-37D and FIGS. 33A to 33D, respectively.
Figure 36B:
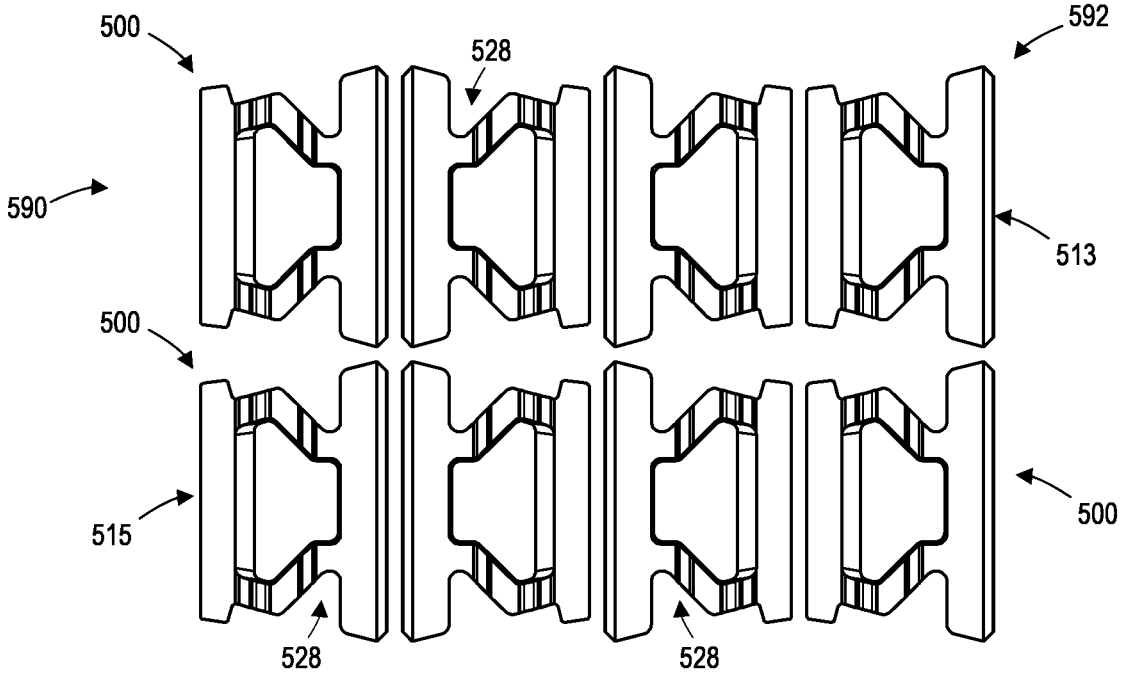

FIG. 36A is an isometric view of manufacturing layout 580 for blocks 500, for example as shown in FIGS. 37A-37D. FIG. 36B is a top plan view of manufacturing layout 380 for a number of blocks 500, e.g., as shown in FIGS. 33A-33D.

Figure 36C:
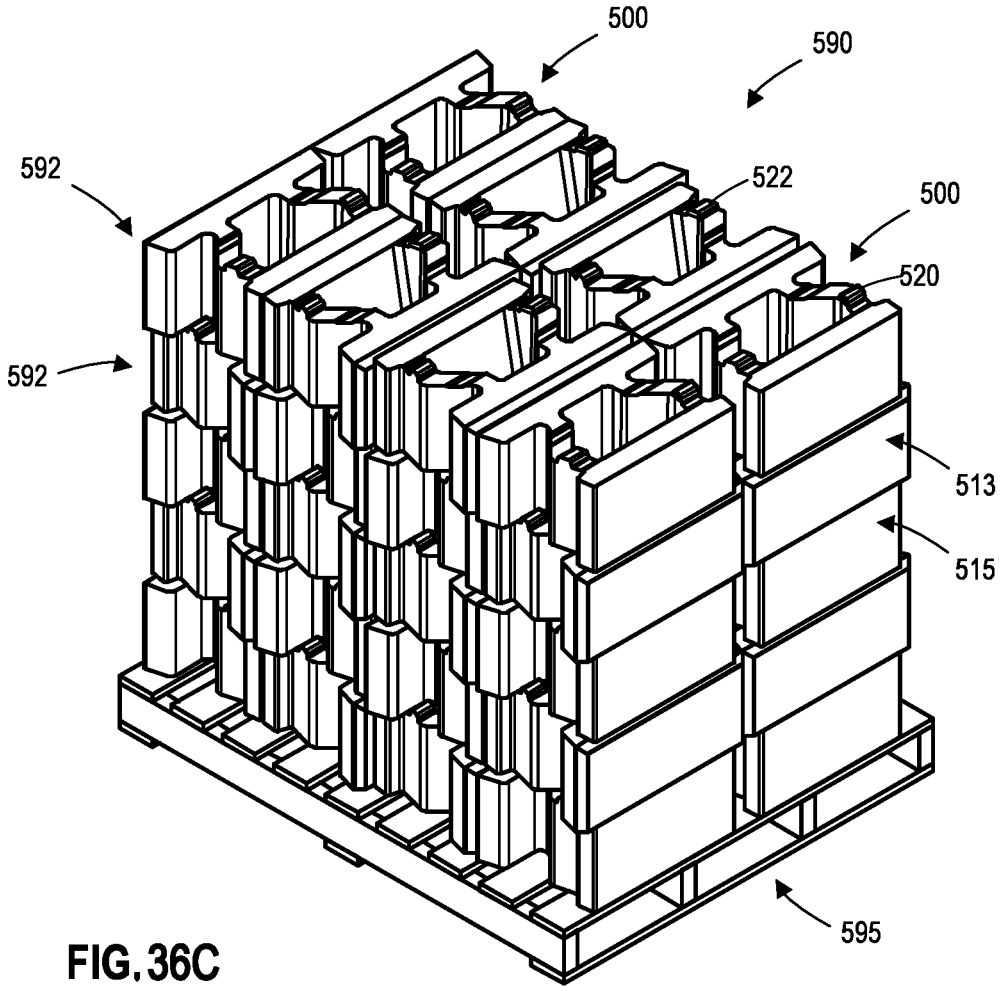
FIG. 36C is an isometric view of a nested pallet layout for a number of blocks according to FIG. 36A or 36B.

Alternatively, FIG. 36B can be used to illustrate a single layer 592 of a nested pallet or shipping layout 590 for a block 500 according to either FIG. 36A or 36B. FIG. 36C is an isometric view of a shipping or pallet layout 590, for a number of blocks 500 according to either FIG. 36A or 36B.

Blocks 500 can be arranged in a reversed face-to-face orientation so that the lugs 520, 522 of blocks 500 in successive layers 592 are disposed within the nesting structures 528 of blocks 500 in an adjacent layer 592. The orientations of blocks 500 in adjacent layers 592 can be reversed or rotated; e.g., by 180 degrees. The surfaces of the lugs 520, 522 can be further adapted to engage along the exterior sidewall and adjacent surfaces forming the nesting structures 528 of blocks 500 in an overlaying, stacked layer 592, reducing the height of the stacked blocks and limiting the range of relative motion to reduce the risk of damage to blocks 500 during shipment, storage and handling.

Figure 37B:
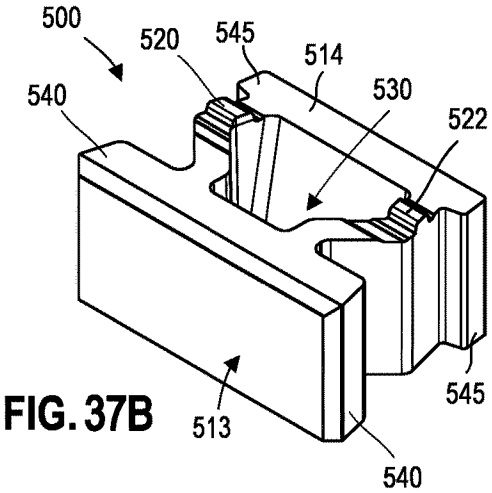
FIGS. 37A-37D are top plan, isometric, front elevation and side section views of the landscaping block in FIGS. 33A-33D, having a smooth face with chamfered face edges, in a block manufacturing configuration.
Figure 37D:
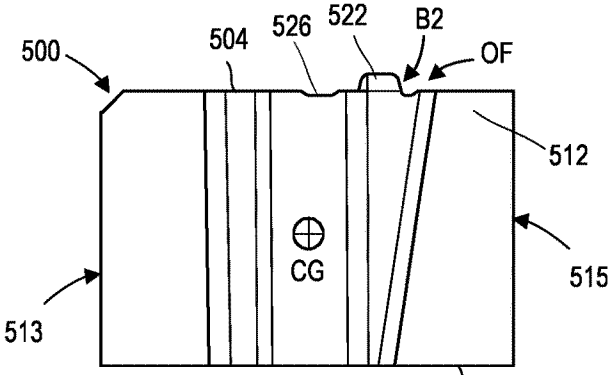
Figure 37A:
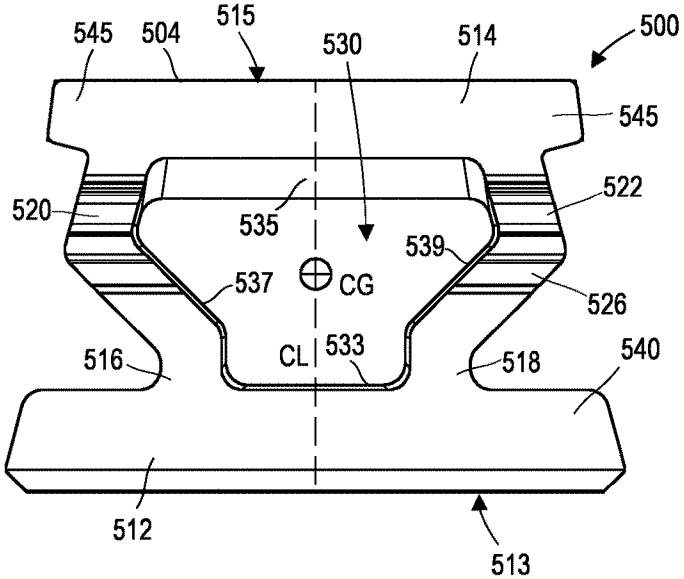
Figure 37C:
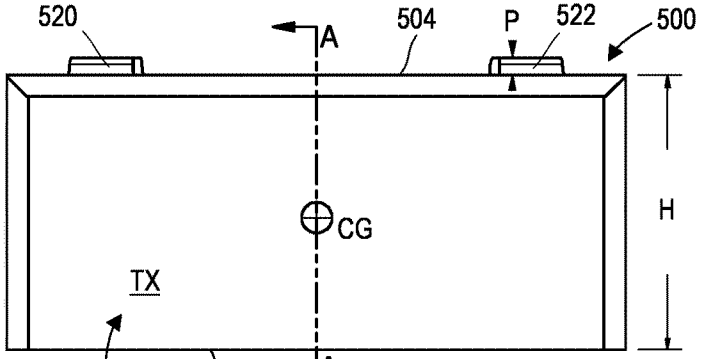

FIGS. 37A-37C are top plan, isometric, and front elevation views of a landscaping block 500 according to FIGS. 33A-33D, in a block machine manufacturing configuration. FIG. 37D is a section view, taken along line A-A of FIG. 37C.

One or more grooves or channel features 526 can be formed in either or both block sidewalls 516, 518 during the manufacturing process; e.g., spaced from lugs 520, 522 along the top surface 504 of block 500. More generally, the shape and location of manufacturing features such as channels 526 may vary, along with the precise shape, beveling, and offset (OF) of the engagement lugs 520, 522 and other physical features of block 500, as described herein, and as known in the art.

Figure 38B:
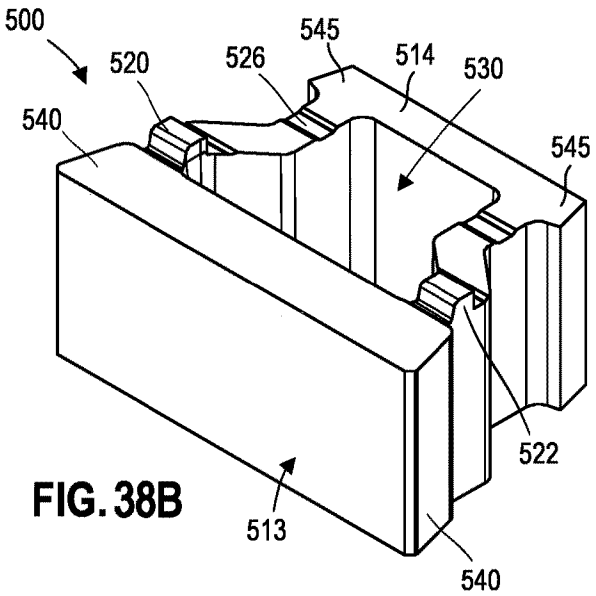
FIGS. 38A-38D are top plan, isometric, front elevation and side section views of a landscaping block for a segmented wall system, in a front lug configuration.
Figure 38D:
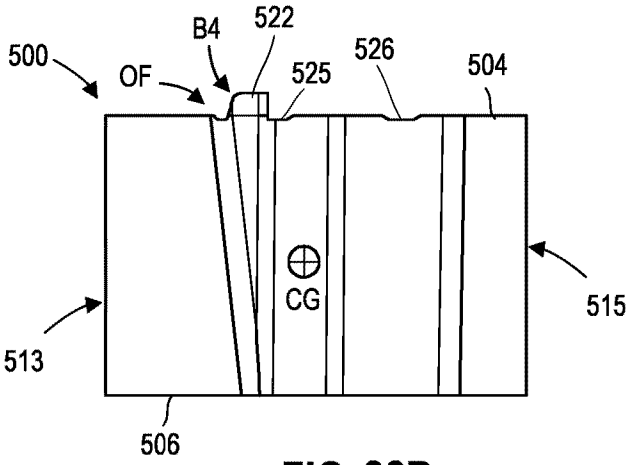
Figure 38A:
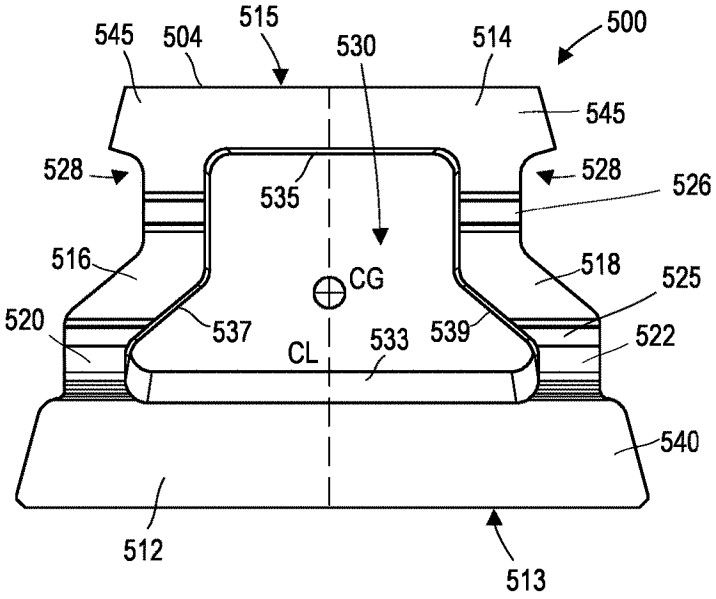
Figure 38C:
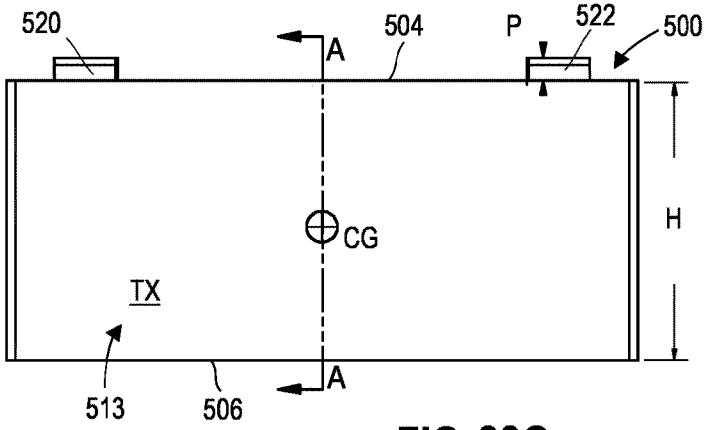
Figure 39B:
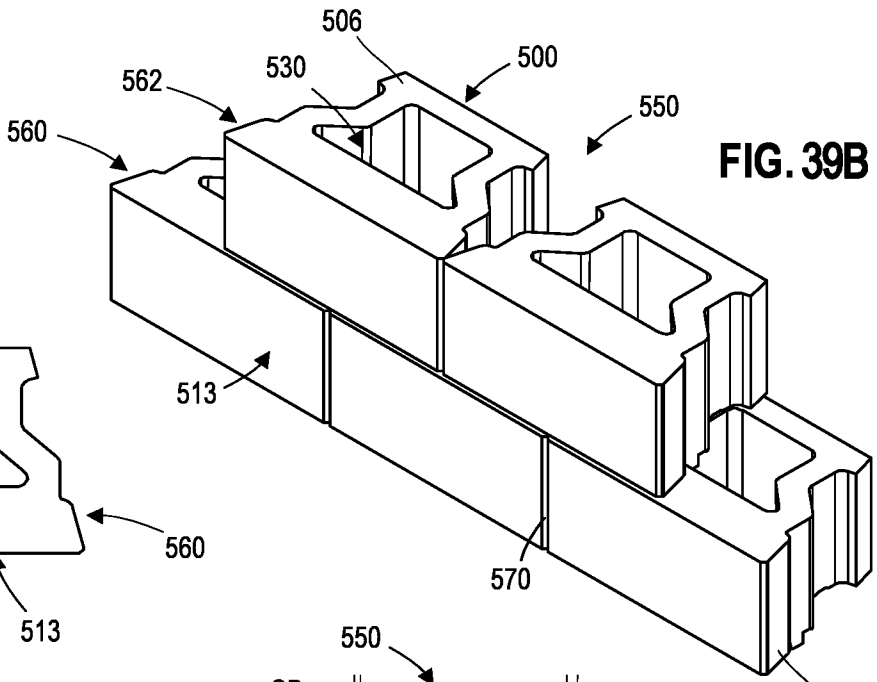
FIGS. 39A-39D are top plan, isometric, front elevation and side elevation views of a segmented wall system assembled from a number of blocks according to FIGS. 38A-38D.
Figure 39D:
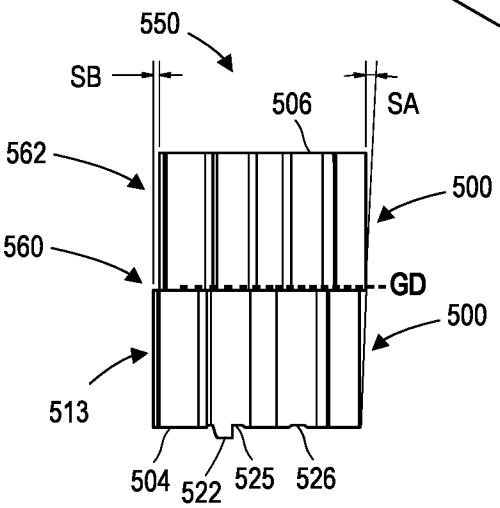
Figure 39A:
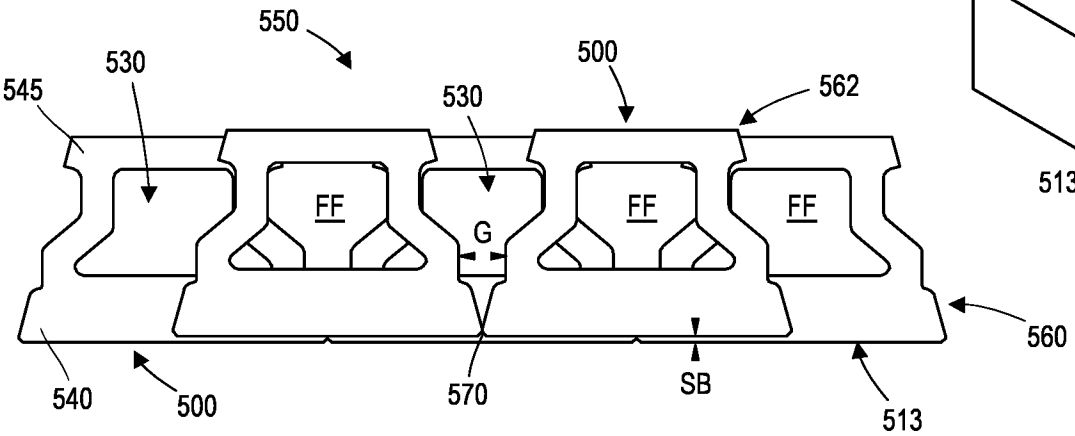
Figure 39C:
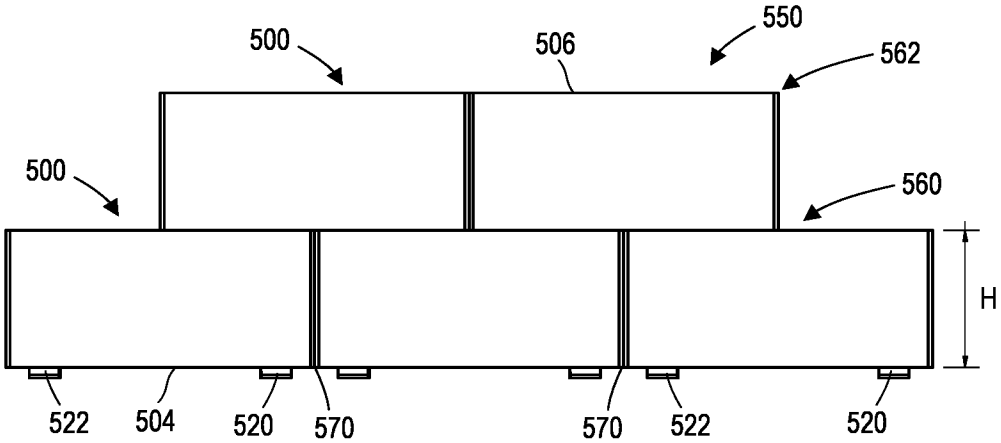

FIGS. 38A-38C are top plan, isometric, and front elevation views of a landscaping block 500 for a segmented wall system, in a front lug configuration. FIG. 38D is a section view, taken along line A-A of FIG. 38C.

Blocks 500 can be made of durable, rugged, weather resistant materials selected for strength and structural integrity, and with similar physical features according to other blocks 100, 200, 300, 500 and 600, as described herein. The width, depth, and height (H) may vary, depending on application.

One or more central openings or cavities 530 can be defined between the front, back and opposing side walls 512, 514, 516, 518; e.g., disposed about the center of gravity CG, with the perimeter of opening 530 defined by the corresponding inside front, rear, and sidewall surfaces 533, 535, 537 and 539. One or more grooves or channel features 525, 526 can be formed in either or both block sidewalls 516, 518 during the manufacturing process; e.g., adjacent lugs 520, 522 (channel 525), or spaced from lugs 520, 522 along the top surface 504 (channel 526).

In particular examples, inter-block engagement processes (lugs) 520, 522 can be disposed along the front sections of block sidewalls 516, 518, extending from the first (e.g., top) surface 504 of block 500 adjacent to or offset (OF) from the front wall portion 512. Lugs 520, 522 can further be provided with a front bevel B4; e.g., with parallel sides extending flush with the respective block sidewalls, generally similar to those or parallel bevel B2, and with a bevel provided on the front surfaces of lugs 520, 522. Front bevel B4 can thus be oriented toward the front wall portion 512 of block 500, and adapted for engagement along the front surfaces 533 of the openings 530 in similar blocks 500, when vertically stacked upon one another in a segmented wall system 550.

As illustrated by these examples, the top and bottom surfaces 504 and 506 of block 500 may be considered arbitrarily, and can be interchanged without loss of generality. In addition, lugs 520, 522 can be oriented toward the front or back of block 500, and blocks 500 can be inverted when assembled into a segmented wall system 550, as further illustrated in FIGS. 39A-39D.

Similarly, nesting structures 528 can be formed along the exterior surfaces of either the front or rear portions of block sidewalls 516, 518; e.g., extending to or along the adjacent (front) surface of rear wall extension 545 (or along either or both surfaces), as shown in FIG. 38A. Nesting structures 528 can thus be adapted to accommodate front-facing lugs 520, 522 of similar, vertically adjacent blocks 500 when stacked for shipping and storage. In these examples, the front-beveled structure B4 of lugs 520, 522 can be adapted to engage along the corresponding exterior surfaces of the rear portions of block sidewalls 516, 518, or the adjacent (front) surface of rear wall extension 545, or both, as further illustrated in FIGS. 42A and 42B.

FIGS. 39A-39D are top plan, isometric, front elevation and side elevation views of a segmented wall system 550 assembled from a number of blocks 500, for example according to FIGS. 38A-38D. In these examples, blocks 500 can be arranged with the top and bottom surfaces 504, 506 exchanged, so that the engagement lugs 520, 522 are disposed along the lower surfaces of each successive course 560, 562.

Adjacent blocks 500 abut at interfaces 570. A fill material (FF) can be provided in the openings 530 of one or more of the blocks 500, and a geogrid material (GD) can be provided between courses 560, 562.

The engagement lugs 520, 522 on adjacent blocks 500 are separated by a gap (G), which is defined by the block side angle and block depth. In this "inverted" configuration, the gap can be selected for lugs 520, 522 of a block 500 in an upper course 562 to engage the front portions of the openings 530 in one or more blocks 500 of an adjacent lower course 560. For forward-facing lugs 520, 522, the beveled surfaces can be adapted to engage along the front or adjacent side surfaces of the openings 530 in one or more lower-course blocks 500, as further illustrated in FIGS. 40A and 40B, and as described herein.

Figure 40A:
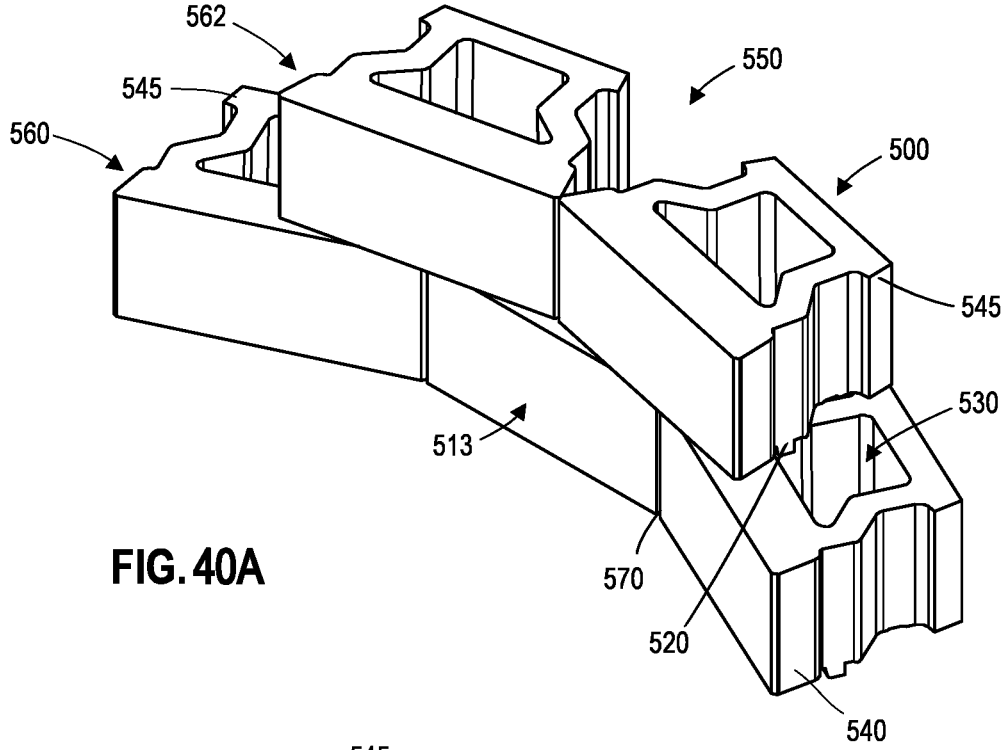
FIGS. 40A and 40B are isometric views of the segmented wall system, in curved wall applications.
Figure 40B:
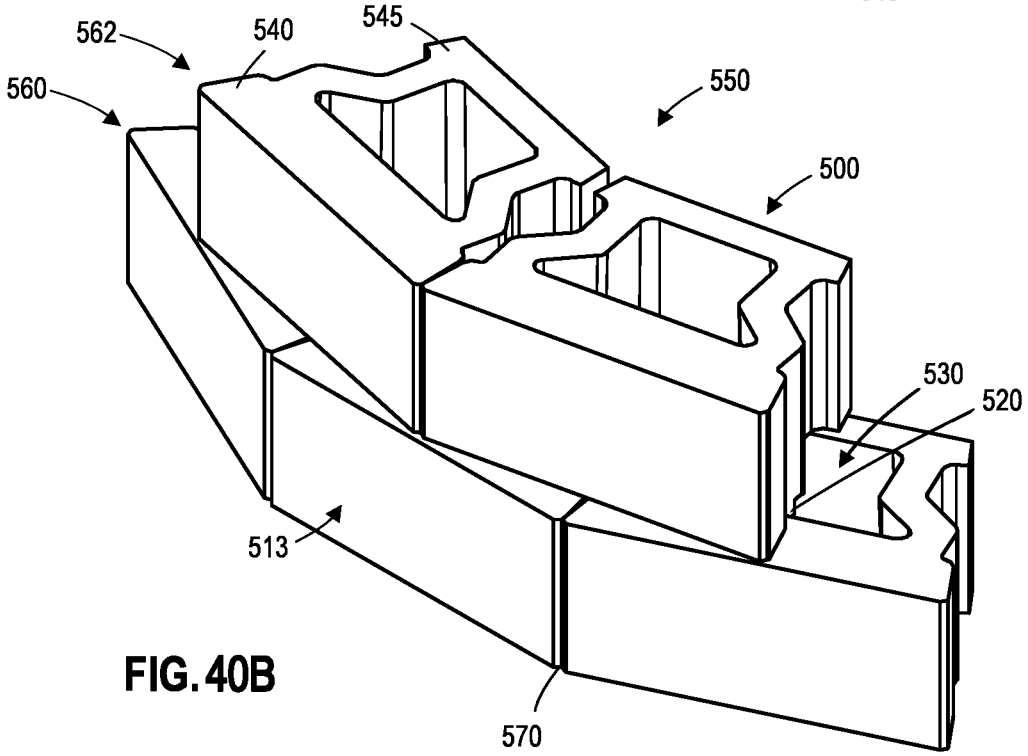

FIGS. 40A and 40B are isometric views of the segmented wall system 550, in curved wall applications. For example, blocks 500 can define a convex structure according to FIG. 40A, or a concave structure according to FIG. 40B.

As shown in FIGS. 40A and 40B, the lugs 520 (and 522, behind front face 513) of each block 500 in one (e.g., upper) course 562 of wall system 550 can be disposed inside the central openings 530 in one or more blocks 500 of an adjacent (e.g., lower) course 560. In this front-lug configuration, the bevel on lugs 520 (and 522) is adapted to the front surfaces of openings 530, and optionally one or more adjacent side surfaces, as defined by the block sidewalls.

Depending on block spacing, the lugs on a selected block 500 in an upper course 562 can be engaged in the openings 530 of adjacent blocks 500 in a lower course 560. For example, the front bevel on the lugs can be adapted to engage along the front surfaces of the respective openings 530. Conversely, the lugs on adjacent blocks 500 in upper course 562 can be engaged in the opening 530 of the same block 500 in lower course 560.

Blocks 500 can thus be engaged in a complementary fashion with respect to rearward-oriented lug configurations. The vertical orientation of blocks 500 and courses 560, 562 can also be reversed, without loss of generality.

Figure 41B:
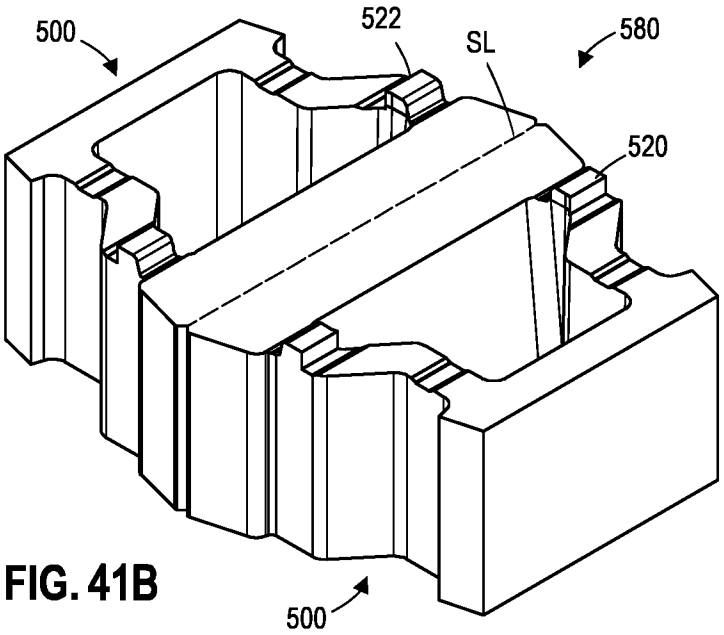
FIGS. 41A-41C are top plan, isometric and front elevation views of a manufacturing module for forming blocks according to FIGS. 38A-38D.
Figure 41A:
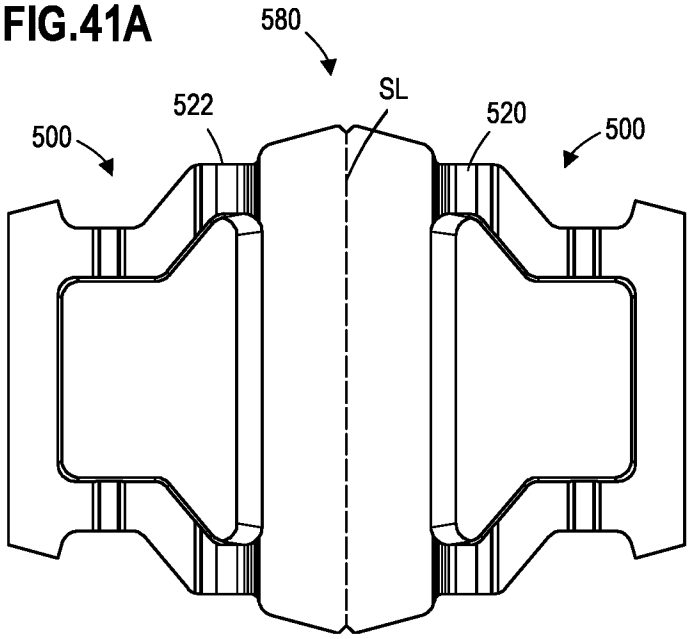
Figure 41C:
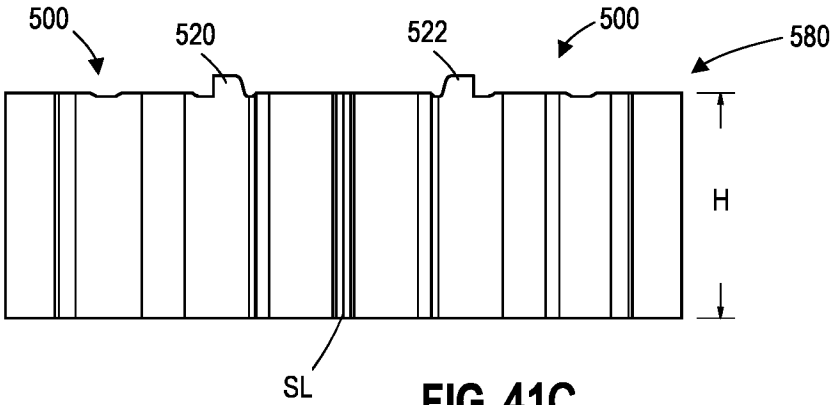

FIGS. 41A-41C are top plan, isometric and front elevation views of a manufacturing module 580 for blocks 500; e.g., according to FIGS. 38A-38D. In these examples, a number of blocks 500 (e.g. two) can be arranged face-to-face along a split line SL. The module 580 can be divided along line SL to form a pair of blocks 500, each with a straight, hard-split surface texture.

Figure 42A:
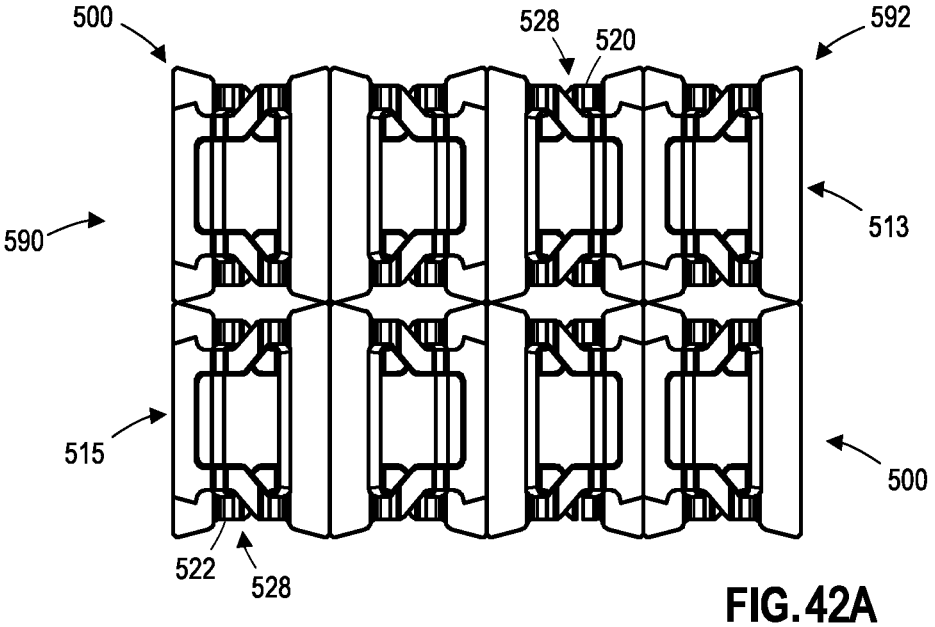
FIGS. 42A and 42B are top plan and isometric views of a nested pallet layout for the blocks in FIGS. 38A-38D.
Figure 42B:
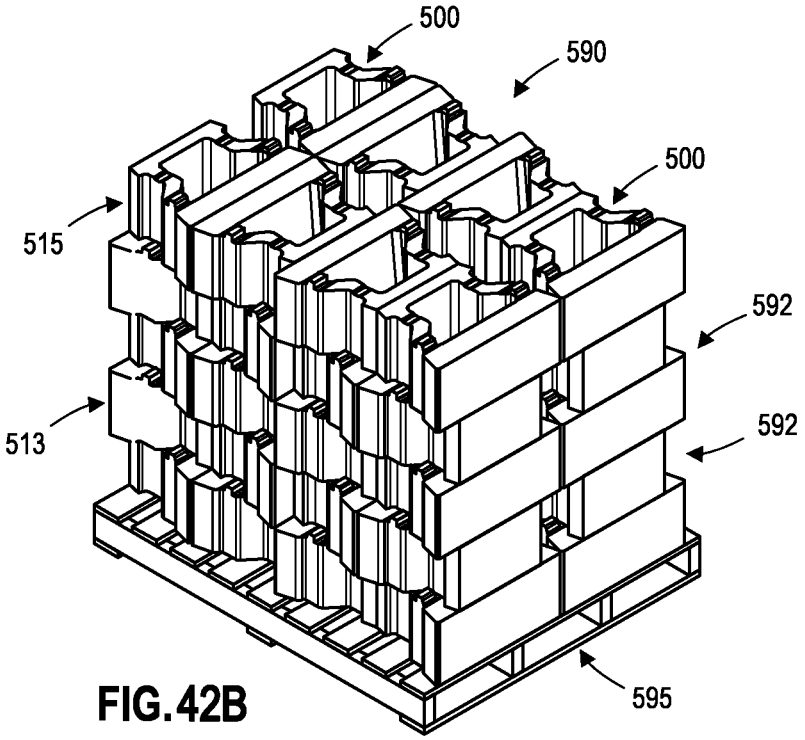

FIG. 42A is a top plan view of a nested pallet or shipping layout 590 for a number of blocks 500 according to FIGS. 38A-38D, showing a multiple block layers 592. FIG. 42B is an isometric view of the layout 590, with additional layers 592.

The forward-facing lugs 520, 522 can be adapted to engage the corresponding nesting structures 528 defined along the exterior surfaces of the rear sidewall sections of overlaying, stacked blocks 500, as shown in FIG. 42A. For example, the blocks 500 can be oriented with the lugs 520, 522 facing up, so that the blocks 500 in the lowest layer 592 rest with the front, back and sidewall portions on the pallet 595, rather than on the lugs.

Figure 48A:
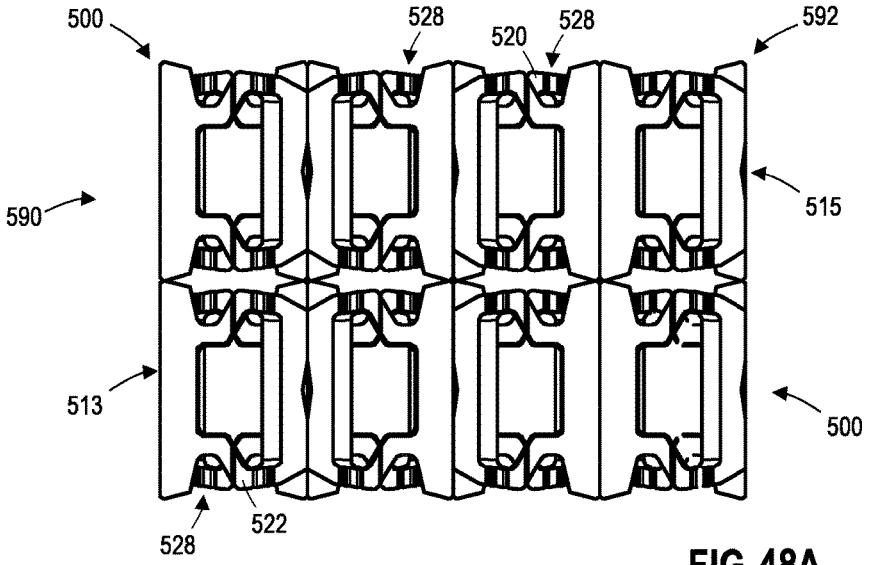
FIGS. 48A-48C are top plan, side elevation and isometric views of a nested pallet layout for the blocks in FIGS. 43A-43D.
Figure 48B:
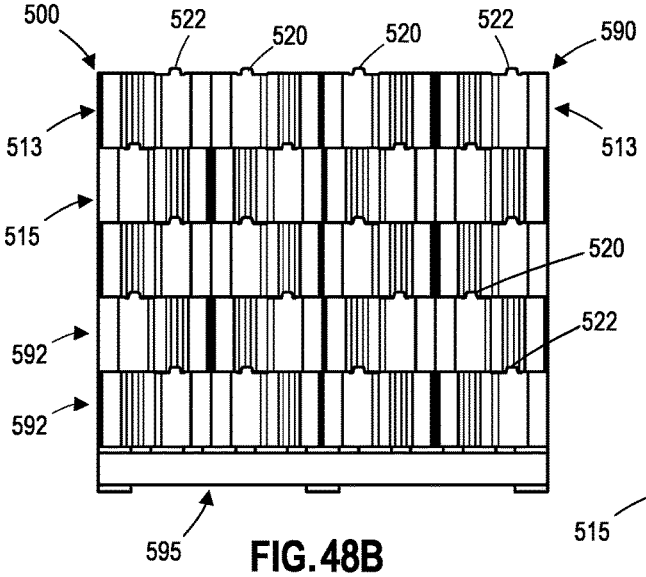
Figure 48C:
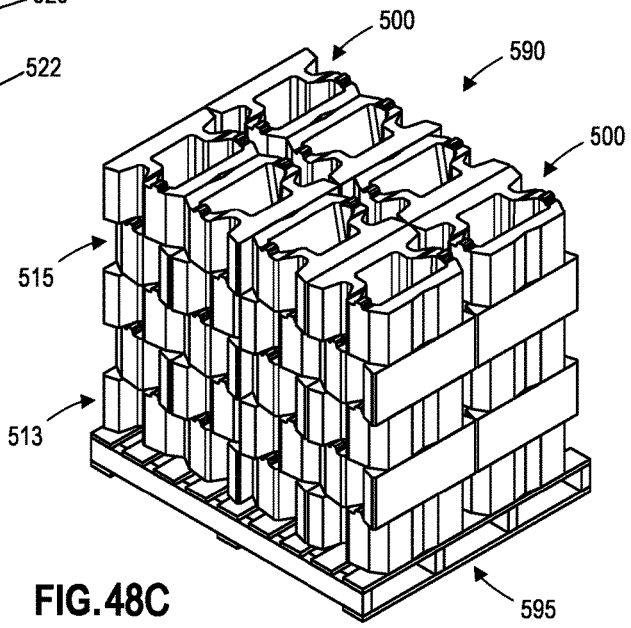

Alternatively, rear-facing lugs 520, 522 can be adapted to engage the corresponding nesting structures 528 defined along the exterior surfaces of the forward sidewall sections of the overlaying stacked blocks 500, as further illustrated in FIGS. 48A-48C. The upper and lower surfaces of block 500 can also be considered arbitrary, and may be interchanged without loss of generality.

If lugs 520, 522 are oriented down, for example, the pallet 595 can be adapted to receive the lugs on the blocks 500 of the lowest layer 592, so that the blocks 500 still rest on the front, back and sidewall portions. The adjacent layers 592 of blocks 500 can thus be considered to be stacked above or below one another, depending on preference.

In either case the nesting capability of the blocks 500 reduces the height of the shipping layout 590 to the installed height (H), while improving structural stability, and limiting the range of relative motion for the blocks 500 in each adjacent layer 592. This compares to an un-nested configuration, or without nesting capability, where the stacked layer height would be (H+P); that is, the installed height (H), plus the lug process height (P). The nested configuration also substantially reduces the risk of damage to lugs 520, 520 and the other structural components of blocks 500 during shipment, storage and handling.

Figure 43B:
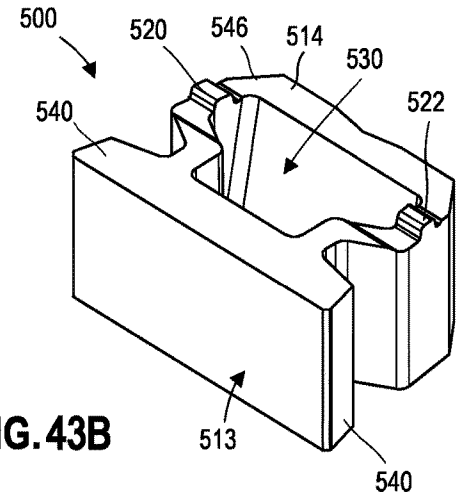
FIGS. 43A-43D are top plan, isometric, front elevation and side section views of a landscaping block for a segmented wall system, in nested-lug, hard-split block manufacturing configuration.
Figure 43D:
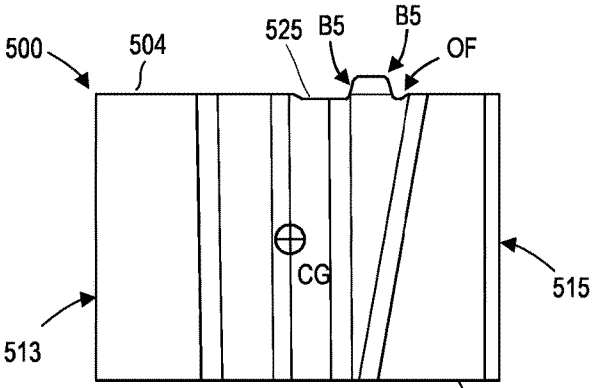
Figure 43A:
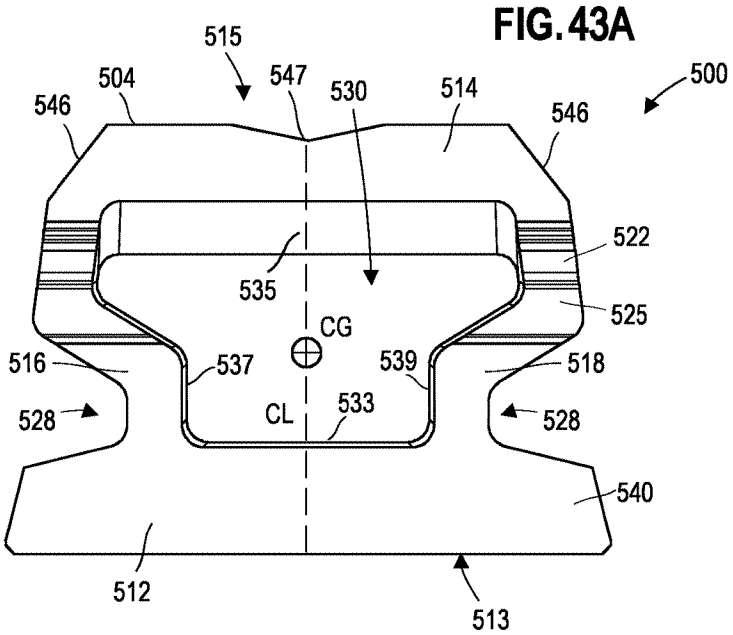
Figure 43C:
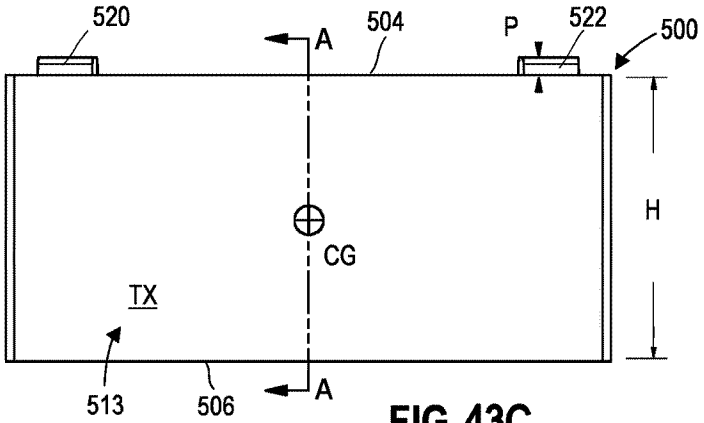
Figure 44B:
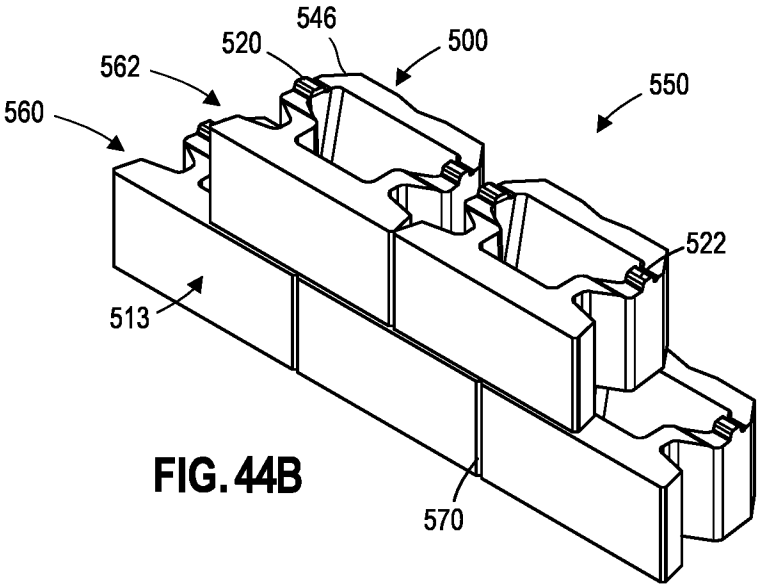
FIGS. 44A-44D are top plan, isometric, front elevation and side elevation views of a segmented wall system assembled from a number of blocks according to FIGS. 43A-43D.
Figure 44D:
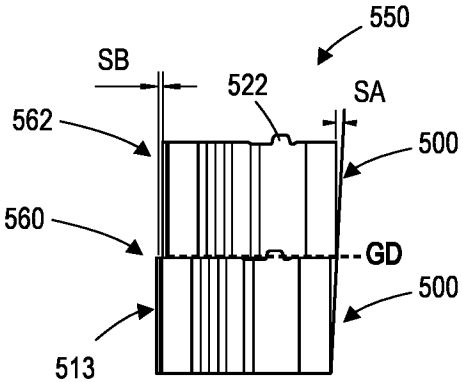
Figure 44A:
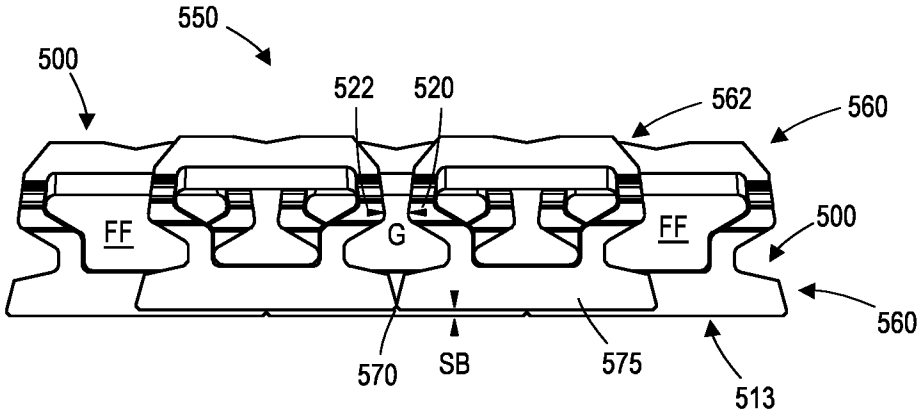
Figure 44C:
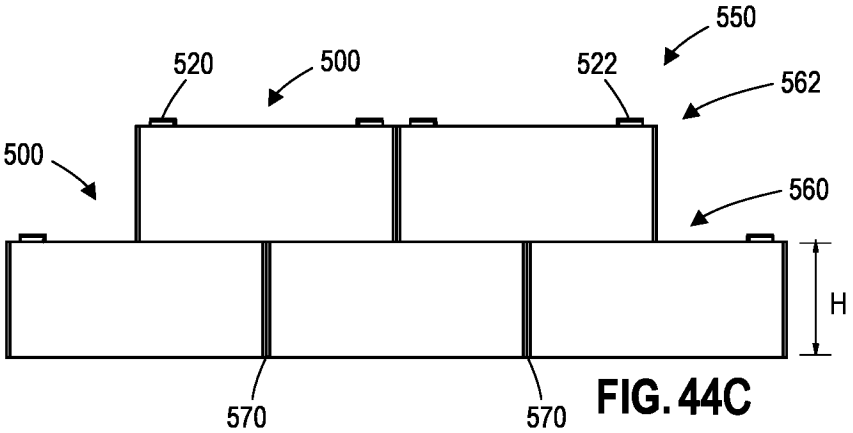
Figure 45B:
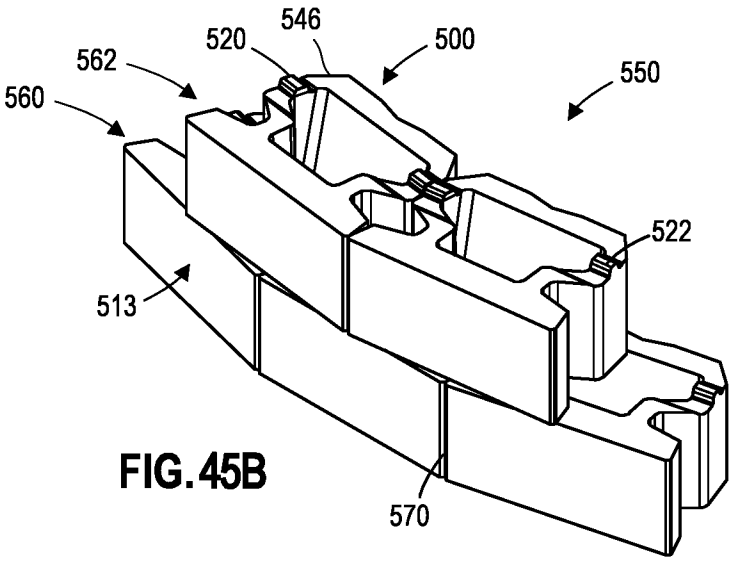
FIGS. 45A-45C are top plan, isometric, and front elevation views of the segmented wall system, in a curved wall application.
Figure 45A:
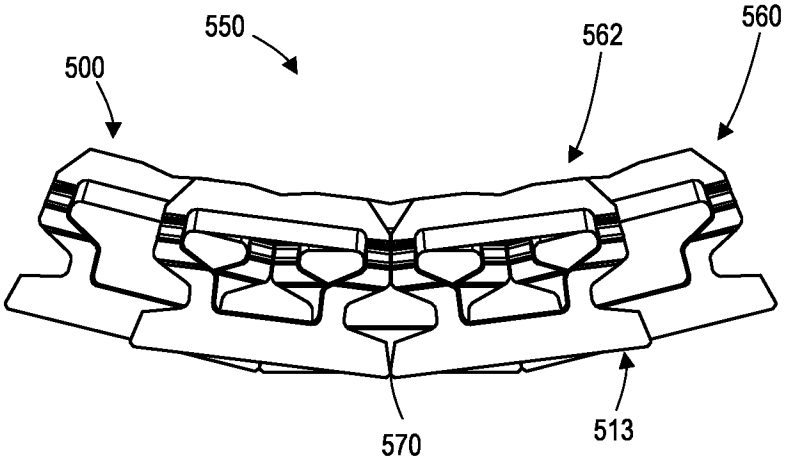
Figure 45C:
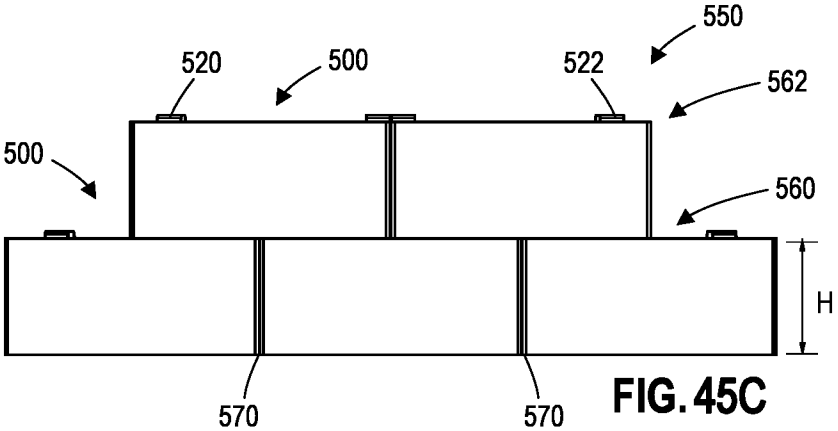
Figure 46B:
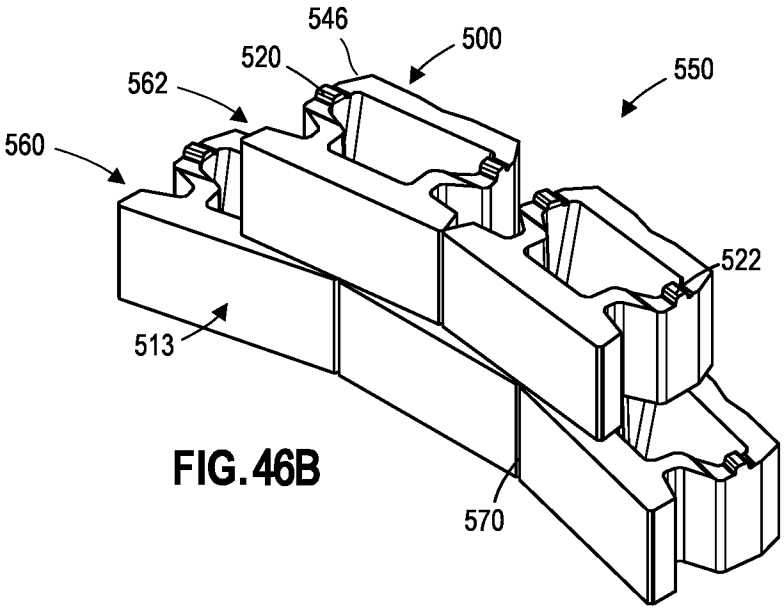
FIGS. 46A-46C are top plan, isometric, and front elevation views of the segmented wall system, with different curvature.
Figure 46A:
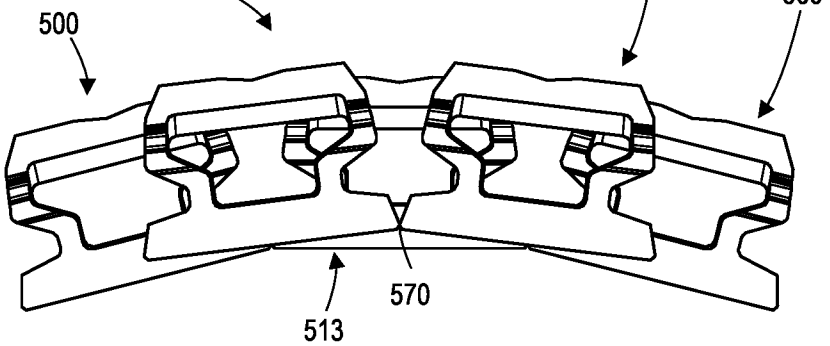
Figure 46C:
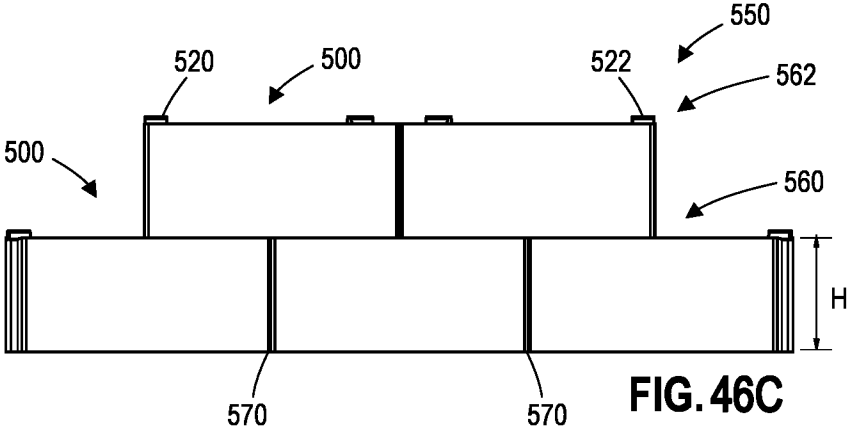

FIGS. 43A-43C are top plan, isometric, and front elevation views of a landscaping block 500 for a segmented wall system, in nested lug configuration with symmetrical bevel B5. FIG. 43D is a section view, taken along line A-A of FIG. 43C.

Blocks 500 can be made of durable, rugged, weather resistant materials selected for strength and structural integrity, and with similar physical features according to other blocks 100, 200, 300, 500 and 600, as described herein. The width, depth, and height (H) may vary, depending on application.

One or more central openings or cavities 530 can be defined between the front, back and opposing side walls 512, 514, 516, 518; e.g., disposed about the center of gravity CG, with the perimeter of opening 530 defined by the corresponding inside front, rear, and sidewall surfaces 533, 535, 537 and 539. One or more grooves or channel features 525 can be formed in either or both block sidewalls 516, 518 during the manufacturing process; e.g., adjacent lugs 520, 522, or spaced from lugs 520, 522 along the top surface 504.

In particular examples, inter-block engagement processes (lugs) 520, 522 can be disposed along the back sections of block sidewalls 516, 518, extending from the first (e.g., top) surface 504 of block 500 adjacent to or offset (OF) from the back portion 514. Lugs 520, 522 can further be provided with a symmetrical bevel B5; e.g., with parallel sides extending flush with the respective block sidewalls 516, 518, generally similar to those of parallel bevel B2, and with bevels provided on the front and rear surfaces of lugs 520, 522. Symmetric bevel B5 can be oriented toward the front or back wall portion 512, 514 of block 500, and adapted for engagement along the front surface 533 of the openings 530 in similar blocks 500, when vertically stacked upon one another in a segmented wall system 550.

As shown in FIGS. 43A, the back portion 514 of block 500 has symmetric, corner wedge angle 546 and a wedge-shaped cutout 547 in the rear surface 515 of block 500, along the block centerline CL. These angled, wedge-shaped structures 546, 547 can be adapted to define a "tail" structure on the back portion 514 of block 500, for example to remove weight (e.g., to attain specific target weight for shipping). The angles and widths of these features 546, 547 can also be adapted to match the distance between the corresponding tail structures on vertically adjacent blocks 500, e.g., in a course above or below block 500, to provide a built-in visual image of the assembled wall structure, being on perfect running bond. The top and bottom surfaces 504 and 506 of block 500 also can be interchanged without loss of generality, with lugs 520, 522 oriented toward the front or back of block 500, and blocks 500 can be inverted when assembled into a segmented wall system 550, all without loss of generality.

Nesting structures 528 can be formed along the exterior surfaces of either the front or rear portions of block sidewalls 516, 518; e.g., extending to or along the adjacent (back) surface of front wall extension 540, as shown in FIG. 43A. Nesting structures 528 can be adapted to accommodate lugs 520, 522 of similar, vertically adjacent blocks 500 when stacked for shipping and storage. In these examples, the symmetrically-beveled structure B5 of lugs 520, 522 can be adapted to engage along the corresponding exterior surfaces of the block sidewalls 516, 518.

FIGS. 44A-44D are top plan, isometric, front elevation and side elevation views of a segmented wall system 550 assembled from a number of blocks 500, for example according to FIGS. 43A-43D. In these examples, blocks 500 can be arranged so that the engagement lugs 520, 522 are disposed along the upper surfaces of each successive course 560, 562.

Adjacent blocks 500 abut at interfaces 570. A fill material (FF) can be provided in the openings 530 of one or more of the blocks 500, and a geogrid material (GD) can be provided between courses 560, 562.

The engagement lugs 520, 522 on adjacent blocks 500 are separated by a gap (G), which is defined by the block side angle and block depth. The gap can be selected for lugs 520, 522 of a block 500 in a lower or upper course 560, 562 to engage the perimeters of the openings 530 in one or more blocks 500 of an adjacent upper or lower course 562, 560. For rear-facing lugs 520, 522, the beveled surfaces can be adapted to engage along the rear surface and adjacent side surfaces of the openings 530 in one or more vertically adjacent, stacked blocks 500.

FIGS. 45A-45C and 46A-46C are isometric views of the segmented wall system 550, in curved wall applications. For example, blocks 500 can define a convex structure according to FIGS. 45A-45C, or a concave structure according to FIGS. 46A-46C.

As illustrated in FIGS. 45A-45C and 46A-46C, the lugs 520 and 522 on each block 500 in one (e.g., lower) course 560 of wall system 550 can be disposed inside the central openings 530 in one or more blocks 500 of an adjacent (e.g., upper) course 562. In this rear-facing lug configurations, the symmetric bevel on lugs 520, 522 is adapted to engage one or more of the rear surfaces of openings 530, and the adjacent side surfaces defined by the block sidewalls.

Depending on block spacing, the lugs on a selected block 500 in a lower course 560 can be engaged in the openings 530 of adjacent blocks 500 in an upper course 562. For example, the symmetric bevel on the lugs can be adapted to engage along one or more of the rear and adjacent side surfaces of the respective openings 530. Conversely, the lugs on adjacent blocks 500 in lower course 560 can be engaged in the opening 530 of the same block 500 in upper course 562.

Blocks 500 can thus be engaged in a complementary fashion with either front or rear-oriented lug configurations. The vertical orientation of blocks 500 and courses 560, 562 can also be reversed, without loss of generality.

Figure 47B:
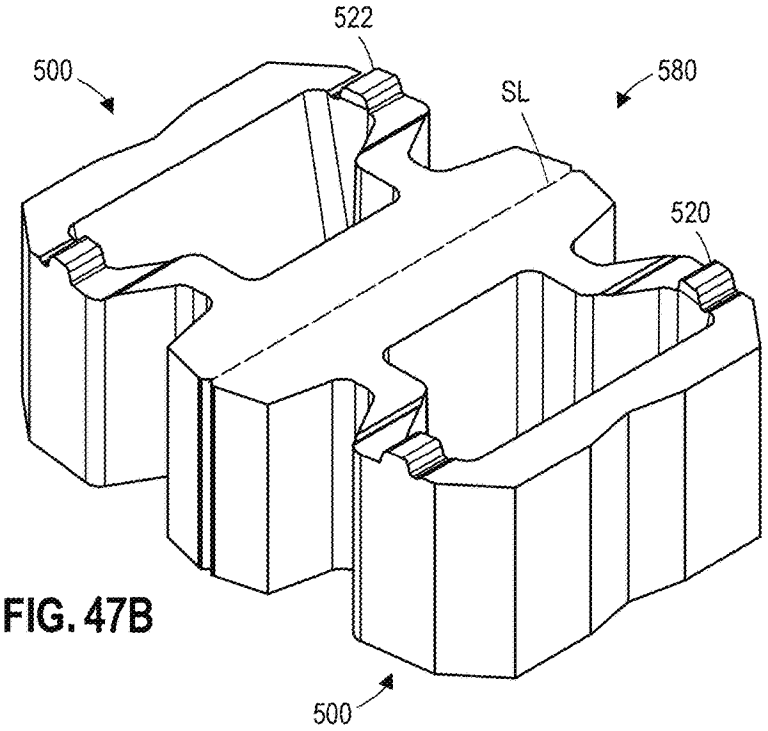
FIGS. 47A-47C are top plan, isometric and front elevation views of a manufacturing module for forming blocks according to FIGS. 43A-43D.
Figure 47A:
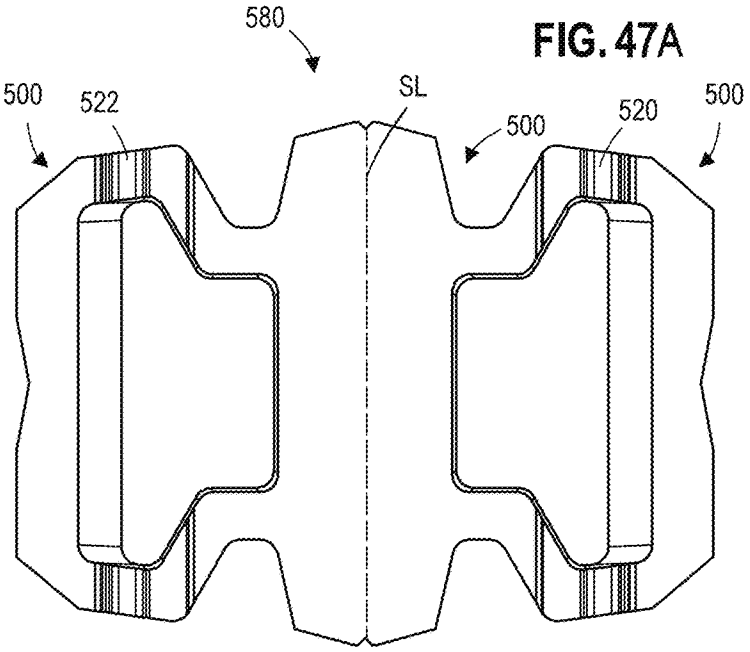
Figure 47C:
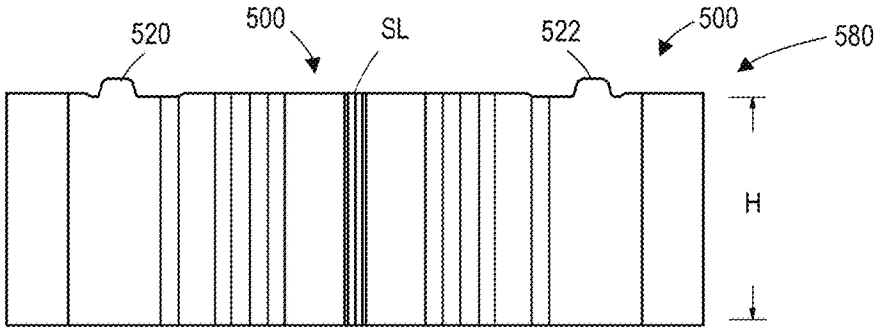

FIGS. 47A-47C are top plan, isometric and front elevation views of a manufacturing module 580 for blocks 500; e.g., according to FIGS. 43A-43D. In these examples, a number of blocks 500 (e.g. two) can be arranged face-to-face along a split line SL. The module 580 can be divided along line SL to form a pair of blocks 500, each with a hard-split surface texture.

FIG. 48A is a top plan view of a nested pallet or shipping layout 590 for a number of blocks 500 according to FIGS. 43A-43D, showing a multiple block layers 592. FIGS. 48B and 48C are side elevation and isometric views of the layout 590, with additional layers 592.

As illustrated in FIGS. 48A-48C, the upper and lower surfaces of block 500 can be considered arbitrary, and may be interchanged without loss of generality. The lugs 520, 522 can be adapted to engage with the corresponding sections of the exterior sidewalls (or the adjacent surfaces) of an overlaying or underlying stacked block 500.

Depending on application and block configuration, the adjacent layers 592 of blocks 500 can thus optionally be considered to be stacked either above or below one another, depending on preference. In either case the height of the shipping layout 590 can be reduced (e.g., to the installed height), while improving structural stability, and limiting the range of relative motion for the blocks 500 in each adjacent layer 592, further reducing the risk of damage to blocks 500 during shipment, storage and handling.

EXAMPLES

In various exemplary applications, a segmented wall system comprises a first course extending in a first direction and comprising a first block; e.g., where the first block has a pair of lug processes extending above a top surface of opposing sidewall portions of the first block. A second course can be stacked on the first course; e.g., where the second course comprises a second block having an aperture formed through a center of the second block, and where a first one of the pair of lug processes is configured to engage a rear surface of the aperture of the second block, when installed.

The segmented wall system can have a third block with an aperture formed through a center thereof; e.g., where a second one of the pair of lug processes of the first block is configured to engage a rear surface of the aperture of the third block, when installed. Each of the pair of lug processes of the first block can include a rounded inside, rear corner having a radius that matches a radius of a rear corner of the aperture of the second block.

The first block can include an aperture formed through a center thereof; e.g., where each of the pair of lug processes are positioned forward of the rear surface of the aperture of the first block, on the top surface of the opposing sidewall portions. The each of pair of lug processes can has a flat top surface. One or more of the blocks can include a groove across the top surface of each of the opposing sidewall portion; e.g., forward of the pair of lug processes.

In any of these applications the blocks can include a front portion, a rear portion, and two opposing sidewall portions extending between the front portion and the rear portion to form an aperture extending from a top surface to a bottom surface. A pair of lug processes can extend above a top surface of the opposing sidewall portions; e.g., forward of a rear surface of the aperture.

A first one of the pair of lug connections can be configured to engage a rear surface of an aperture of another block stacked thereon. A second one of the pair of lug processes can be configured to engage a rear surface of an aperture of a second block stacked thereon.

Each of the pair of lug processes of the first block can include a rounded inside, rear corner having a radius that matches a radius of a rear corner of the aperture of the second block, or the sides of the lugs can be parallel, and flush with one or more of the sidewall surfaces. Each of the pair of lug processes can have a flat top surface. A groove can be provided across the top surface of each of the opposing sidewall portions; e.g., forward of the pair of lug processes.

Additional exemplary applications include any block described here, any tail block or tail unit described here, or any block system or apparatus. Methods of manufacturing, shipping and assembling the block systems and also included.

Although this description includes specific examples and embodiments, the scope of the disclosure also includes modifications and equivalents thereof, as understood by those of skill in the art. The disclosed structures, functions and features can also be combined with or substituted for one another, without limit to the scope of invention, as defined by the recited language of the claims.

TABLE 1

| Drawing References | |
|---|---|
| 100, 200, 300, 500, 600 landscaping block | 400 tail unit (tail block) |
| 104, 204, 304, 504, 604 top of block | 404 top of tail unit |
| 106, 206, 306, 506, 606 bottom of block | 406 bottom of tail unit |
| 112, 212, 312, 512, 612 front wall of block | 412 front portion of tail unit |
| 113, 213, 313, 513, 613 front face of block | |
| 114, 214, 314, 514, 614 back portion of block | 414 back portion of tail unit |
| 115, 215, 515, 615 back surface of block | |
| 116, 216, 316, 516, 616 block sidewall (1st) | 416 side portion of tail unit (1st) |
| 118, 218, 318, 518, 618 block sidewall (2nd) | 418 side portion of tail unit (2nd) |
| 120, 220, 320, 520, 620 engagement lug (1st) | |
| 122, 222, 322, 522, 622 engagement lug (2nd) | |
| 125, 225, 325, 525, 625 groove or channel | |
| 126, 326, 327, 526 groove or channel (add'l) | |
| 130, 230, 330, 530, 630 opening or cavity | 430 opening in tail unit |
| 133, 233, 333, 533, 633 front of opening | |
| 135, 235, 335, 535, 635 rear of opening | |

TABLE 1-continued

| Drawing References | |
|---|---|
| 137, 237, 337, 537, 637 side of opening (1st) | |
| 139, 239, 339, 539, 639 side of opening (2nd) | |
| 150, 250, 350, 550, 650 segmented wall | 450 corner block |
| 160, 260, 360, 560, 660 lower course | |
| 162, 262, 362, 562, 662 upper course | |
| 170, 270, 370, 570, 670 block interface | 575 contact area |
| 180, 580 manufacturing module/layout | |
| 380 block coupling | 480 block coupling (tail unit) |
| 528, 628 nesting structure | 485 complementary coupling |
| 540, 640 extension/process (front) | 440/445 extension/wing (front/rear) |
| 545, 646 extension/process (rear) | 546, 547 wedge/cutout features |
| 590, 690 shipping layout | 592, 692 block layer |
| 595, 695 pallet | |

TABLE 2

| Drawing Symbols | |
|---|---|
| A block side angle | OF lug offset |
| AB block wall angle | P process height (lug) |
| B1 bevel (corner) | R1, R2 radius of curvature (variable) |
| B2 bevel (parallel) | SA setback angle |
| B3 bevel (outside) | SB setback distance |
| B4 bevel (front) | SL split line |
| B5 bevel (symmetric) | T1 block wall thickness (front) |
| CG block center of gravity | T2 block wall thickness (back) |
| D block depth | T3 sidewall thickness (1st side) |
| D1 front face to CG | T4 sidewall thickness (2nd side) |
| FF fill material | TX surface texture |
| G gap | W block width |
| GD geogrid/reinforcement | W1 back face width |
| H block height (installed) | W2 opening width |
| H1 height of CG | W3 tail unit width |
| LT Tail unit length | |

The invention claimed is:

1. A wall system comprising:

a plurality of landscaping blocks, each comprising:

a front portion, a back portion, and first and second sidewall portions extending between the front portion and the back portion;

an opening having a perimeter defined along inner surfaces of the front, back and first and second sidewall portions, respectively; and a lug process extending from each of the first and second sidewall portions;

a first course comprising a first number of said landscaping blocks; and a second course comprising a second number of said landscaping blocks, stacked vertically with respect to the first course;

wherein each lug process extends from the inner surface to an outer surface of the respective sidewall portion;

wherein the lug processes have beveled surfaces adapted to engage the openings along one or more of the respective inner surfaces;

wherein the lug processes extending from the first and second sidewall portions of a landscaping block in the first course engage different openings in an adjacent pair of the landscaping blocks in the second course.

2. The wall system of claim 1, wherein the lug processes on adjacent sidewall portions of an adjacent pair of the landscaping blocks in the first course engage a same opening of a single landscaping block in the second course.

3. The wall system of claim 1, wherein the beveled surfaces of the lug processes are symmetric about a centerline extending between the front and back portion of the landscaping block.

4. The wall system of claim 3, wherein the beveled surfaces are oriented toward the back portion of the landscaping block, and configured to engage the different openings along the inner surfaces of the respective back portions of the landscaping blocks in the second course.

5. The wall system of claim 3, wherein the beveled surfaces are oriented toward the front portion of the landscaping block, and configured to engage the perimeters of said openings along the inner surfaces of the respective front portions of the landscaping blocks in the second course.

6. The wall system of claim 1, wherein the first and second sidewall portions of the landscaping block in the first course are configured share a load path with at least one sidewall portion of each of the adjacent pair of landscaping blocks in the second course.

7. The wall system of claim 1, wherein:

at least one side of each lug process extends flush with the inner surface of the respective sidewall portion; and at least one other side of each lug process extends flush with the outer surface of the respective sidewall portion.

8. The wall system of claim 1, further comprising a groove formed on each of the first and second sidewall portions of the landscaping blocks, adjacent a front edge of each of the lug processes.

9. The wall system of claim 1, further comprising:

a nesting structure defined along one or more exterior surfaces of the first and second sidewall portions of the landscaping block;

wherein the nesting structure is adapted to receive a lug process of an additional instance of said plurality of landscaping blocks, when stacked in an adjacent layer for shipping or storage.

10. The wall system of claim 9, wherein the nesting structure is adapted for landscaping blocks in the adjacent layer to have a reversed or rotated orientation when stacked for shipping or storage, or a stacked shipping or storage height that is the same as an installed height of the landscaping blocks in the first and second courses.

11. The wall system of claim 9, wherein the nesting structure is adapted to limit lateral motion of landscaping blocks in the adjacent layer during shipping by engaging the respective lugs thereof.

12. The wall system of claim 1, wherein:

the second course is stacked vertically above and adjacent the first course; or the lug processes are offset from the back portions of the landscaping blocks along the respective sidewall portions, such that the second course is horizontally offset from the first course.

13. The wall system of claim 1, wherein:

the first course is stacked vertically above and adjacent the second course; or the lug processes are offset from the front portions of the landscaping blocks along the respective sidewall portions, such that the first course is horizontally offset from the second course.

14. The wall system of claim 1, further comprising one or more angled or wedge structures defined on the back portion of one or more landscaping blocks in the first course, having a width selected to match a distance between the back portions of the adjacent pair of the landscaping blocks in the second course.

15. A landscaping block comprising:

a front wall portion;

a back portion;

first and second sidewall portions extending between the front wall portion and the back portion;

an opening defined between the front wall portion, the back portion and the first and second sidewall portions, and having a perimeter defined along inner surfaces thereof; and lug processes extending from each of the first and second sidewall portions;

wherein the lug processes are configured to extend from a bottom surface of the landscaping block when installed in a course of a wall system, offset from the front portion along the respective sidewall portion;

wherein the lug processes have beveled surfaces configured to engage different openings in an adjacent pair of such landscaping blocks, when stacked in adjacent course of a wall system; and wherein the beveled surfaces are oriented toward the front wall portion of the landscaping block, and configured to engage the perimeters of said different openings along the inner surfaces of the respective front wall portions of the adjacent pair of landscaping blocks.

16. The landscaping block of claim 15, wherein the beveled surfaces of the lug processes are symmetric about a centerline extending between the front wall portion and the back portion of the landscaping block.

17. The landscaping block of claim 15, wherein the beveled surfaces are configured for the lug processes on adjacent sidewalls of a pair of such landscaping blocks to engage a same opening of a single such landscaping block, when stacked in the adjacent courses of the wall system.

18. The landscaping block of claim 15, wherein the first and second sidewall portions are configured to share a load path with at least one sidewall portion of each of the adjacent pair of landscaping blocks, when stacked in the adjacent courses of the wall system.

19. The landscaping block of claim 15, wherein:

each lug process extends from the inner surface to an outer surface of the respective sidewall portion; or opposing sides of each lug process extend flush with opposing sides of the respective sidewall portion.

20. The landscaping block of claim 15, further comprising a groove formed on each of the first and second sidewall portions of the landscaping block, adjacent a front edge of each of the lug processes.

21. The landscaping block of claim 15, further comprising a nesting structure defined along one or more exterior surfaces of each of the first and second sidewall portions, wherein the nesting structures are adapted to receive lug processes of additional instances of said landscaping block, when stacked in an adjacent layer for shipping or storage.

22. The landscaping block of claim 21, wherein the nesting structures are adapted for landscaping blocks in the adjacent layer to have reversed or rotated orientations when stacked for shipping or storage, or a stacked shipping or storage height that is the same as an installed height of the landscaping block when assembled into a course of a wall system.

23. The landscaping block of claim 21, wherein the nesting structures are adapted to limit lateral motion of the landscaping blocks in the adjacent layer by engagement with the respective lugs thereof.

24. A wall system comprising a plurality of landscaping blocks according to claim 15, stacked in first and second adjacent courses, wherein the lug processes on a single landscaping block in the first course engage the different openings in the adjacent pair of landscaping blocks in the second course.

25. The wall system of claim 24, further comprising one or more angled or wedge structures defined on the back portion of one or more of the landscaping blocks in the first course, having a width selected to match a distance between the back portions of the adjacent landscaping blocks in the second course.

26. A landscaping block comprising:

a front wall portion;

a back portion;

first and second sidewall portions extending between the front wall portion and the back portion;

an opening defined between the front wall portion, the back portion and the first and second sidewall portions, and having a perimeter defined along inner surfaces thereof;

lug processes extending from each of the first and second sidewall portions; and nesting structures defined along exterior surfaces of the first and second sidewall portions, wherein the nesting structures are adapted to receive lug processes of additional instances of said landscaping block, when stacked in an adjacent layer for shipping or storage.

27. The landscaping block of claim 26, wherein the nesting structures are adapted for landscaping blocks in the adjacent layer to have reversed or rotated orientations when stacked for shipping or storage.

28. The landscaping block of claim 26, wherein the nesting structures are adapted for the landscaping blocks in the adjacent layer to have a stacked shipping or storage height that is the same as an installed height of the landscaping block, when assembled into a course of a wall system.

29. The landscaping block of claim 26, wherein the nesting structures are adapted to limit lateral motion of the landscaping blocks in the adjacent layer by engagement with the respective lugs thereof.

30. A storage system comprising a plurality of landscaping blocks according to claim 26, stacked in first and second adjacent layers, wherein the nesting structures of said landscaping blocks in the first layer engage the respective lug structures of said landscaping blocks in the second layer to limit lateral motion thereof.

31. The storage system of claim 30, wherein the first and second layers have a same stacked shipping or storage height as an installed height of the landscaping blocks, when assembled into adjacent courses of a wall system.

32. The landscaping block of claim 26, wherein the lug processes have beveled surfaces configured to engage different openings in an adjacent pair of such landscaping blocks, when stacked adjacent the landscaping block in a wall system.

33. A wall system comprising a plurality of landscaping blocks according to claim 32, stacked in first and second adjacent courses, wherein the lug process on one of the landscaping blocks in the first course engage the different openings in the adjacent pair of landscaping blocks in the second course.

34. The wall system of claim 33, wherein:

the first and second sidewall portions of the landscaping blocks in the second course are configured to engage at least one sidewall portion of each of the adjacent pair of landscaping blocks in the second course; or wherein one or more angled or wedge structures are defined on the back portion of one or more landscaping blocks in the first course, having a width selected to match a distance between the back portions of the adjacent pair of landscaping blocks in the second course.

35. A landscaping block comprising:

a front wall portion;

a back portion;

first and second sidewall portions extending between the front wall portion and the back portion;

an opening defined between the front wall portion, the back portion and the first and second sidewall portions, and having a perimeter defined along inner surfaces thereof; and lug processes extending from each of the first and second sidewall portions;

wherein the lug processes are configured to extend from a top surface of the landscaping block when installed in a course of a wall system, offset from the back portion along the respective sidewall portion;

wherein the lug processes have beveled surfaces configured to engage different openings in an adjacent pair of such landscaping blocks, when stacked in adjacent course of a wall system; and wherein the beveled surfaces are oriented toward the back portion of the landscaping block, and configured to engage the perimeters of said different openings along the inner surfaces of the respective back portions of the adjacent pair of landscaping blocks.

36. The landscaping block of claim 35, wherein the beveled surfaces of the lug processes are symmetric about a centerline extending between the front wall portion and the back portion of the landscaping block.

37. The landscaping block of claim 35, wherein the beveled surfaces are configured for the lug processes on adjacent sidewalls of a pair of such landscaping blocks to engage a same opening of a single such landscaping block, when stacked in the adjacent courses of the wall system.

38. The landscaping block of claim 35, wherein:

each lug process extends from the inner surface to an outer surface of the respective sidewall portion; or opposing sides of each lug process extend flush with opposing sides of the respective sidewall portion.

39. The landscaping block of claim 35, further comprising a groove formed on each of the first and second sidewall portions of the landscaping block, adjacent a front edge of each of the lug processes.

* * * * *